US011828084B2

(12) United States Patent
Chu

(10) Patent No.: US 11,828,084 B2
(45) Date of Patent: Nov. 28, 2023

(54) DOOR-UNLATCHING DEVICE

(71) Applicant: Daniel Y. Chu, Hercules, CA (US)

(72) Inventor: Daniel Y. Chu, Hercules, CA (US)

( * ) Notice: Subject to any disclaimer, the term of this patent is extended or adjusted under 35 U.S.C. 154(b) by 233 days.

(21) Appl. No.: 17/163,577

(22) Filed: Feb. 1, 2021

(65) Prior Publication Data

US 2021/0310272 A1 Oct. 7, 2021

Related U.S. Application Data

(60) Provisional application No. 63/005,200, filed on Apr. 3, 2020.

(51) Int. Cl.
*E05B 1/00* (2006.01)

(52) U.S. Cl.
CPC ..... *E05B 1/0053* (2013.01)

(58) Field of Classification Search
CPC ..... E05B 1/0053
See application file for complete search history.

(56) References Cited

U.S. PATENT DOCUMENTS 283,770 A 8/1883 Geiger
831,584 A 9/1906 Vinvent
955,125 A * 4/1910 Blackwell ..... E05B 53/001 110/178
1,172,205 A * 2/1916 Gillentine ..... E05B 53/001 292/DIG. 72
1,271,445 A * 7/1918 Diggs ..... E05B 53/001 292/255
1,603,722 A * 10/1926 Stanley ..... E05B 53/001 292/255
2,741,504 A * 4/1956 Dale ..... E05B 53/001 292/255
2,928,690 A * 3/1960 Larson ..... E05B 53/00 292/336.3
4,569,546 A * 2/1986 Howard ..... E05B 53/001 292/225
4,621,848 A * 11/1986 Pierce ..... E05B 53/001 292/336.3
5,725,263 A * 3/1998 Rodriguez ..... E05C 17/48 292/342
6,328,392 B1 * 12/2001 Whitcomb ..... F25D 23/028 312/319.9
7,270,352 B1 * 9/2007 Stuart ..... E05B 1/0053 292/336.3
2013/0318882 A1 * 12/2013 Booker ..... E05C 17/44 292/343

(Continued)

OTHER PUBLICATIONS

International Search Report, PCT/US 21/25678, dated Jul. 8, 2021.

(Continued)

*Primary Examiner* — Mark A Williams

(57) ABSTRACT

A door-unlatching device including a lower actuator including a foot-pad, an upper actuator including a lever-arm and a handle-mount attachable to a handle of door-latch, and a link coupled to the foot-pad and the lever-arm, wherein the lever-arm is movable between a first position and a second position relative to the handle-mount. It can be set to either engaged mode which allows either hand or foot to operate; or disengaged mode to allow only hand to operate which the door can also be locked from entry as by a normal door latch.

18 Claims, 32 Drawing Sheets

(56) References Cited

U.S. PATENT DOCUMENTS

2017/0218661 A1* 8/2017 Fraychineaud, Jr. ..... E05B 1/0053

OTHER PUBLICATIONS

The FootKnob seen at website: https://www.thefootknob.com/.
Assa Abloy Planet NoHander, seen at website: https://planet.ag/en/products/fuss-tueroeffner/planet-nohander/.
Prototype design on Youtube in video entitled "How To Open Doors During A Pandemic" at https://www.youtube.com/watch?v=AZzj4fFjVhg.

* cited by examiner

DOOR-UNLATCHING DEVICE

CROSS-REFERENCE TO RELATED APPLICATION

This application claims priority from U.S. Provisional Application No. 63/005,200, filed Apr. 3, 2020, the disclosure of which is incorporated herein by reference in its entirety.

FIELD OF THE ART

Apparatuses and methods relating to door latches, door unlatching, and related methods.

BACKGROUND

Doors with latches are commonly used in houses, commercial buildings and any area where open door is not desirable. Doors with latches are typically opened and closed by turning the latch handles, or knobs by hand, then push or pull to open the door for exit or entry. However, it is very often and common when one's hand to open or close the door is not possible or undesirable. For example, in a laboratory where scientists with both hands occupied with equipment and need to enter a latched room for their experiments, or when there is chance of cross-contamination at door latch such as during the worldwide coronavirus COVID-19 outbreak in year 2020, or when the individuals using public restroom try to avoid their hands touching the perceived dirty or contaminated door hardware, or when the individuals have disability which prohibits their hands to turn the latch handle or knobs.

There are power-assisted electrical or mechanical door openers for handicap access doors. However, they are complex, prone to malfunction or damage, expensive and need major modification to existing door for installation. In addition, lack of maintenance on those power-assisted door openers can cause user injury.

SUMMARY

A foot-operated door-unlatching device is disclosed which includes a foot-operated lower actuator connected by a link to a hand-operated upper actuator, and is configured to be installed in a door for connecting to the door-latch, such that the door can be unlatched to open either by foot or hand. This disclosed device can be configured to install either on both or one side of door. The link between upper and lower actuators can be connected as in engaged mode which allows either hand or foot to operate; or disconnected as in disengaged mode which does not allow foot to operate or when the door-latch needs to be locked from entry like a regular door. The device can be configured such that the ability to engaged and disengaged is controlled from inside.

FIGS. 1-10 illustrate an exemplary embodiment of a door-unlatching device 50. The door-unlatching device includes an upper actuator 300, a lower actuator 500, and a link 400. The upper actuator 300 is connected to a lower actuator 500 by a link 400. The foot-operated door-unlatching device is configured to be installed on a door with the upper actuator 300 attached to a handle of door-latch and the lower actuator attached to the door. Additional details of its operation and the ability to disengage foot actuation of the lower actuator 500 from the door latch handle will be explained with FIG. 11, FIG. 12 and FIG. 13 later.

FIG. 1 is an exploded perspective view of components in the upper actuator 300, the link 400, and the lower actuator 500. The upper actuator 300 is described in further detail below with respect to at least FIGS. 1A-1M and 7-10. The lower actuator 500 is described in further detail below with respect to at least FIGS. 3-6.

As shown on FIG. 1, the lower actuator 500 may include an inner mounting-plate 560.

The inner mounting-plate 560 has a surface for contact with and mounting to a first side of a door.

The inner mounting-plate 560 may have at least one mounting hole 564 to allow mounting to the door with screws 540. In some embodiments at least three mounting holes 564 may be provided. Alternative methods of mounting may be used, such as using adhesive or welding, which would not require the mounting holes 564.

The inner mounting-plate 560 may have a shaft-hole 561 configured to receive a part of a foot-pad 550. The inner mounting-plate 560 may have a pad-stop 566 to limit the travel of an attached foot-pad. In some embodiments, the pad-stop 566 may be a protrusion extending approximately 90 degrees relative to the door-mounting surface of the inner mounting-plate 560.

The lower actuator 500 may include an outer mounting-plate 560', which is for mounting to a second opposite side of the door.

The outer mounting-plate 560' can be a mirror image of the inner-mounting-plate, or it may have a different shape.

The lower actuator 500 may include an inner foot-pad 550 which has a pivot-axle 556.

The pivot-axle 556 passes through a shaft-hole 561 at inner mounting-plate 560, a clearance hole drilled at the door, and a corresponding shaft-hole at outer mounting-plate 560'.

At a distal end of the pivot-axle 556, the pivot-axle 556 may include a mounting-feature 558 and a threaded hole at the axle end for a screw 590.

The lower actuator 500 may include an outer foot-pad 570.

The inner foot-pad 550 and the outer foot-pad 570 may be secured to one another by way of a screw 590 and washer 580 or similar fasteners.

The outer foot-pad 570 may have a mounting-feature 572 corresponding to the mounting-feature 558 of the pivot-axle 556 of the inner foot-pad 550.

The mounting-feature 558 of the inner foot-pad 550 and the mounting-feature 572 of the outer foot-pad 570 correspond to each other such that the inner foot-pad 550 and the outer foot-pad 570 will both rotate together about the pivot-axle 556 based on actuation of either the inner foot-pad 550 or the outer foot-pad 570.

In alternative embodiments, adhesive or other securing options can be used. For example, the mounting-features 558, 572 may have corresponding geometric features, such as a rectangular projection and recess.

Alternative embodiments of the mounting-features 558, 572 may include splining or similar keying, and they can be jointed together with retaining ring and groove at end of mounting-feature 558 instead of screw and washer.

FIG. 1 shows an exemplary embodiment where the mounting-feature 558 includes a short square shaft extension and a threaded hole, and the other mounting-feature 572 is a matching square hole or recess configured to receive the mounting-feature 558.

This geometric configuration prevents slippage between the inner foot-pad 550 and the outer foot-pad 570.

In alternative embodiments, the pivot-axle 556 and related features may be reversed such that the pivot-axle 556 is on the outer foot-pad 570 instead of the inner foot-pad 550.

In some embodiments, the lower actuator 500 may only have one mounting-plate 560 and one foot-pad 550. In such a case, the foot-pad 550 would be rotatably attached to the mounting-plate 560.

In some embodiments, the mounting plate may have a screw hole to allow for rotatable attachment of the foot-pad.

In other embodiments, a short-pivot 567 may extend as an integral projection from the mounting-plate 560 and the foot-pad 550 may be rotatably attached to the short-pivot 567 of the mounting plate 560.

The upper actuator 300 of the door-unlatching device may include a lever-arm 350 and a handle-mount 380.

The handle-mount 380 is then coupled to the handle of a door-latch 200.

A link 400 used for connecting the lower actuator 500 to an upper actuator 300 is a rod with lower-end 405 and upper-end 403 (which are threaded holes in this embodiment) for connecting to a lower-swivel-joint 510 at lower actuator 500 and an upper-swivel-joint 330 at upper actuator 300.

Although a rigid rod is used as link 400 in this embodiment, since the connection is working in tension, the link 400 can also be a flexible chain, or a steel wire, or a rope with both ends that are attached to upper and lower actuator using either fasteners such as screws, rivets; or welding, crimping and clamping methods too.

A screw 530 may be used to fasten the lower-swivel-joint 510 (or ball joint rod end) to the lower actuator 500 at the lower-mounting-site 554 (a threaded hole in this configuration), and a screw 310 may pass through the hole 332 at the upper-swivel-joint 330 (or ball joint rod end) and fasten the joint to the upper actuator 300 at the upper-mounting-site 352.

The connection between the link 400 and the upper or lower actuator can be done by way of fasteners.

Alternatively, the link 400 may simply have a dogbone configuration where the ends of the links have through-bore holes for fasteners, similar to vehicle suspension dogbone links.

FIG. 1A is a bigger view of a lever-arm 350 and a handle-mount 380 as also shown in area A on FIG. 1.

The upper actuator 300 has a lever-arm 350 jointed to and rotates around a handle-mount 380.

The lever-arm 350 has an upper-mounting-site 352 (a threaded hole in this embodiment) for mounting the upper-swivel-joint 330 which is connected to the upper-end 403 of link 400.

The descriptive details which follow will be best understood by first examining the handle-mount 380 in the upper actuator 300.

FIGS. 1B-1M illustrate components of an exemplary embodiment of the upper actuator 300. FIG. 1B shows a side view of the handle-mount 380.

As shown on a side view FIG. 1B, the handle-mount 380 has a stepped cylindrical extension with the larger diameter stepped portion near one end to form a cylindrical undercut-groove 384, a beveled-edge 385 at the extension end leading to the undercut-groove 384, and two opposing flat-land 382 along the extension length.

The two flat-land 382 are configured to help forming a snap-fit rotary joint with the lever-arm 350 described further below.

FIG. 1C is a front view of the handle-mount 380 which has a hole 386 shaped to fit the handle of a door-latch mounted on a door.

As shown on a sectional top view FIG. 1D, a bottom view FIG. 1E, and a projected sectional view FIG. 1G; the handle-mount 380 has two threaded-holes 387 through which two set screws 360 will be used to secure the handle of door-latch in assembly.

In some embodiments, only one threaded-hole and set screw will be used. In some embodiments, no threaded-holes or set screws will be used.

As shown in FIG. 1D, the hole 386 shaped to fit a bent end portion of a handle of door-latch, which is angled at an angle $\alpha$ between the central plane 383 of hole 386 and a mating-surface 381 on handle-mount 380.

This is due to many door-latch handles having an angled end. By having the hole 386 angled, the upper actuator 300 is not severely skewed relative to a door and in danger of contacting the door in the upper actuator's operation.

In some embodiments, the hole 386 will be sufficiently large to accept different angled door-latch handles.

In addition, or as an alternative to the set screws, a filler material can be inserted into the hole 386 to secure the handle of door-latch to the hole 386.

For example, a hard foam or rubber insert can be used as an adapter for the door-latch handle and the hole 386.

Alternatively, in some embodiments, different handle-mount 380 components with different angles $\alpha$ will be manufactured to specifically fit particular types of door-latch handles.

The angle $\alpha$ is the angle between the axle of hole 386 with the mating-surface 381 of the handle-mount 380.

In the case of a curved handle at door-latch 200, the hole 386 may have a curved hole 386 or a hole with filler material insert to fit.

In other embodiments to fit a door-latch with straight handle without a bent end, the handle-mount 380 may have a bent section with hole 386 in line with the straight handle of door-latch; such that the central plane 383 of hole 386 may be away from and parallel with the mating-surface [381] on handle-mount 380.

In other embodiments, the handle-mount 380 may include the door-latch handle in a unitary construction. That is, the handle-mount 380 may include a door-latch handle.

FIG. 1H is a front view of the lever-arm 350; FIG. 1J, a top view; FIG. 1K, a sectional side view; FIG. 1L, a perspective view; and FIG. 1M, another perspective view.

As shown on FIG. 1H and FIG. 1K, the lever-arm 350 has a pivot-hole 354 with a split 355 which allows the pivot-hole to expand under force.

In embodiments, the pivot-hole 354 may be counter-bored. In alternative embodiments, the pivot-hole 354 may not have a split 355.

The pivot-hole 354 may be sized such that the beveled-edge 385 can be passed through the pivot-hole 354 with elastic deformation of the pivot-hole 354 at the lever-arm 350 or elastic deformation of the beveled-edge 385 at the handle-mount 380. It also has a lever-handle 359, and an upper-mounting-site 352 (which is a threaded hole in this embodiment) for mounting the upper-swivel-joint 330.

FIG. 1L is a perspective view of the lever-arm 350 attached to the handle-mount 380.

By pushing the beveled-edge 385 of the handle-mount 380 to pass through the pivot-hole 354 of the lever-arm 350, with deflection at the split 355 at lever-arm 350 under the assembling force, the undercut-groove 384 will anchor the pivot-hole 354 in place to form a rotary joint.

FIG. 1M is another perspective view of the lever-arm 350 attached to handle-mount 380.

A user can move the lever-handle 359 to turn the lever-arm 350 around handle-mount 380 within travel limit of stop 358 at lever-arm 350 which either rests on or away from the engage-direction-stop 388 at handle-mount 380.

FIG. 2 is a perspective view of the embodiment in accordance with the aspect of this disclosure, after all parts for the door-unlatching device 50 shown in FIG. 1 are installed to a hinged door 100 with a door-latch 200 to form an upper actuator 300 connected to a lower actuator 500 by a link 400.

It is in engaged mode with no external force applied for door latched.

The remaining figures address more details on components in assembly, function and advantages of the claimed device.

FIG. 3 is a top view of the lower actuator 500 and the link 400 as assembled in FIG. 2.

FIG. 4 is a front view of the lower actuator 500 and a portion of link 400. In engaged mode with no external force applied, the link 400 is pulled up by the door-latch 200 and the inner foot-pad 550 is limited by the travel-stop 562 at inner mounting-plate 560.

There is anchor 555 at the inner foot-pad 550 which can engage the anchor-hole 565 at the inner mounting-plate 560 if user applies force to rotate the inner foot-pad 550 downward for unlatching door.

This anchor 555 to anchor-hole 565 arrangement will allow more tolerances when making parts for the embodiment.

For comfortable use, a desirable rotational range of the inner foot-pad 550 is from less than 45 degrees above horizontal level to less than 30 degrees below horizontal level. The inner mounting-plate 560 has a travel-stop 562 to limit the rotational movement of inner foot-pad 550 between it and the pad-stop 566.

FIG. 5 is the side view of the lower actuator 500 and a portion of link 400. The pad-stop 566 has optional ribs 563 for strengthening the inner-mounting-plate 560 and 560' if weaker material such as injection-molded plastics is used instead of metal for making the parts.

FIG. 6 is a perspective view of the lower actuator 500 and a portion of the link 400. The inner foot-pad 550 may include a foot-placement-area 552.

The foot-placement-area 552 may include a raised serration or patterned edge 551.

The raised serration or patterned edge 551 is configured to enhance grip or traction for when a user actuates the inner foot-pad 550.

These features may be mirrored on the outer foot-pad 570. When a user operates the device, the user has to first step on either foot-pad 550 or 570 to rotate the foot-pads and cause downward movement of the link 400.

The downward movement of the link 400 rotates the lever-arm 350 and urges the handle-mount 380 and the door-latch 200 to rotate together for unlatching the door. After this, the door can be either pulled back or pushed forward to open with same foot on foot-placement-area 552 depending on door opening direction. In doing this, good traction is desirable especially when door is opened by pulling back in order to prevent slippage or the user losing control of the door.

FIG. 7 is a top view of the upper actuator 300 with the link 400 as assembled in FIG. 2. The handle of door-latch 200 fits into the handle-mount 380, and is secured by two set screws 360 at handle-mount 380 from below.

FIG. 8 is a front view of the upper actuator 300 and a portion of the link 400 as assembled in FIG. 2.

FIG. 9 is a side view of the upper actuator 300 and a portion of the link 400 as assembled in FIG. 2.

FIG. 10 is a perspective view of the upper actuator 300 and a portion of the link 400 as assembled in FIG. 2.

The lever-arm 350 has the upper-swivel-joint 330 connected to the upper-end (403) of link 400 and secured at the upper-mounting-site 352 with a screw 310.

The device is shown in engaged mode which is when the lever-arm 350 rotates around handle-mount 380 until the stop 358 rests on the engage-direction-stop 388.

In this engaged mode, applying downward movement of link 400 will rotate lever-arm 350 and urge handle-mount 380 and door-latch 200 to rotate together for unlatching the door.

It is desirable to rotate the inner foot-pad 550 at the lower actuator by foot with less than 45 degrees rotational movement for comfortable door-unlatching, but the handle at a door-latch 200 usually needs to turn more than 45 degrees for unlatching a door.

Therefore, arrangement to increase rotational movement of door-latch is made by turning the lever-arm 350, using lever-handle 359, around the handle-mount 380 and stop at the position as shown; which has the distance of upper-mounting-site 352 to the turning-axis of door-latch 200 (this distance is output moment arm) shorter than the distance of the lower-mounting-site 554 to the pivot-axle 556 at the lower actuator 500 (this distance is input moment arm).

Usually, the shorter output moment arm occurs when the upper-mounting-site 352 is between handle-mount 380 and the turning-axis of door-latch 200 as shown in FIG. 10.

With a shorter output moment arm, the handle of door-latch 200 will turn more than the rotation of inner foot-pad 550 at the lower actuator 500 for an effective unlatching.

This is similar to the effect in a planar quadrilateral linkage in convex with no two links crossing over each other, and all four internal angles are less than 180 degrees.

Planar quadrilateral linkage is a form of classical four-bar closed-chain linkage with four links connected in a loop by 4 rotating joints. Its first link is fixed as ground link (also known as the frame), then two links connected to frame are the crank (as input link), and the rocker (as output link), and the last link is floating, also called coupler which connects the other end of crank (input) and rocker (output).

Input rotational movement at crank, through the coupler will cause output rotational movement at rocker.

The crank and the rocker will rotate the same amount of angular displacement if they are of equal lengths.

However, if the rocker is shorter than the crank, then the rocker as output will rotate a bigger angle than the crank because both rocker and crank joints at coupler will travel the same arc length. For same arc length, when radius of arc decreases, the angle of arc increases.

The analogy of the embodiment in engaged mode to the planar quadrilateral linkage is as following:

a. distance of upper-mounting-site 352 to turning axis of door-latch 200 (output moment arm) is the shorter rocker link;
b. distance of lower-mounting-site 554 to pivot-axle 556 at lower actuator (input moment arm) is the crank link;
c. Link 400 is the coupler;
d. Turning-axis of door-latch 200 and the pivot-axle 556 at lower actuator are the two ends of the frame (or ground link).

FIG. 11 is a front view of embodiment as assembled in FIG. 2 which is in engaged mode, with door in latched condition, viewed towards inside surface of door.

With no external force applied, the door-latch 200 with its neutral handle position pulls the link 400 up due to the stop 358 and engage-direction-stop 388 are touching to urge force on each other as shown in on FIG. 10.

The rotational movement of the inner foot-pad 550 is limited by the travel-stop 562 at the inner mounting-plate 560.

FIG. 12 is a front view of embodiment as assembled in FIG. 2 which is in engaged mode, but also with force applied by foot to either the inner foot-pad 550 or outer foot-pad 570 which is door in unlatched condition.

A user applies force on the foot-placement-area 552 (at either inner or outer foot-pad) by foot wearing a shoe to rotate the inner foot-pad 550 which moves the link 400 downward and rotates the lever-arm 350 to urge the handle-mount 380 and the door-latch 200 to rotate together for unlatching the door.

And the door can be pulled back to open with same foot on foot-placement-area 552.

The handle of door-latch can be turned by hand in the engaged position to unlatch door too.

FIG. 13 is a front view of embodiment as assembled in FIG. 2 in disengaged mode, with door in latched condition, viewed towards inside surface of door.

A user can use the lever-handle 359 and rotate the lever-arm 350 with the stop 358 around the handle-mount 380 so that the upper-mounting-site 352 is further away from the turning axis of the door-latch 200.

Usually it is when the handle-mount 380 is between the upper-mounting-site 352 and the turning axis of the door-latch 200 as shown.

In this disengaged mode position, the distance between the upper-mounting-site 352 to the door-latch turning-axis (this distance is output-moment-arm) is increased and the stop 358 is away from the engage-direction-stop 388 at handle-mount 380, and cannot urge force on each other.

The rotational movement of the inner foot-pad 550 at the lower actuator 500, through the link 400, can only turn the lever-arm 350 around the handle-mount 380 without affecting the door-latch 200, or until the lever-handle 359 touches the handle-mount 380 as shown.

Then it still cannot urge the handle-mount 380 or the handle at the door-latch 200 to rotate far enough for unlatching the door because the increased output-moment arm at upper actuator 300 will turn a smaller angle with the same rotation of the inner foot-pad 550 at the lower actuator 500 with unchanged distance from the lower-mounting-site 554 to the pivot-axle 556 (this distance is input moment arm).

This is a planar quadrilateral linkage as used in describing the engaged mode with FIG. 10, but with a longer rocker than the crank, and the output is a smaller degree of rotation than input.

The analogy of the embodiment in disengaged mode to the planar quadrilateral linkage is as following:

a. distance of upper-mounting-site 352 to turning axis of door-latch 200 (output moment arm) is the longer rocker link;
b. distance of lower-mounting-site 554 to pivot-axle 556 at lower actuator (input moment arm) is the crank link;
c. link 400 is the coupler;
d. turning axis of door-latch 200 and the pivot-axle 556 at lower actuator are the two ends of the frame (or ground link).

Only hand can be used to unlatch the door in this disengaged mode, and the door-latch 200 can be locked to prevent entry from outside as the pivoted-footpads are not effective.

For security and cosmetics reasons, it is important that the device can be controlled from the inside (or secured side) of door to an engaged mode which allows unlatching of door by foot, or in disengaged mode to disallow unlatching door by foot for controlling outside entry by hand or foot, especially in a controlled area such as a secured laboratory with an automated-always-latched-door which only allow hand to unlatch from inside.

A foot-operated door-unlatching device which is disclosed in embodiment according to FIG. 2 meets the requirement of being able to set or configure the door-unlatching device to an engaged mode for unlatching of the door-latch by foot from either side of the door, and also easily switching back to a disengaged mode for security where actuation of the foot-pad at the door-unlatching device does not unlatch the door.

Said another way, FIGS. 11 and 12 show a first position of the link 400 relative to the handle-mount 380, where the actuation of the inner foot-pad 550 or the outer foot-pad 570 can move the lever-arm 350 and the handle-mount 380 to unlatch the door-latch 200.

FIG. 13 shows a second position of the link 400 relative to the handle-mount 380 where the actuation of the inner foot-pad 550 or the outer foot-pad 570 cannot move the handle-mount or far enough to unlatch the door-latch 200.

In a first position of the lever-arm 350 relative to the handle-mount 380, actuation of the inner foot-pad 550 or the outer foot-pad 570 moves the lever-arm 350 and the handle-mount 380.

In doing so, the actuation of the inner foot-pad 550 may be sufficient to effect unlatching the door-latch 200 by movement of the handle-mount 380 and handle of door-latch 200.

Taking a vertical axis through where the handle-mount 380 is coupled to the lever-arm 350, it can be understood that the vertical axis divides a first and a second half-disk regions on opposed sides of the vertical axis when viewed from the front view.

In the first position of the lever-arm 350 in FIGS. 11 and 12, it can be understood that the upper-mounting-site 352 of the lever-arm 350 where the link 400 is coupled to the lever-arm 350 is in the first half-disk region on one side of the vertical axis. In this configuration, the device is shown in engaged mode which is when the lever-arm 350 rotates around handle-mount 380 until the stop 358 rests on the engage-direction-stop 388.

In the second position of the lever-arm 350 in FIGS. 13, it can be understood that the upper-mounting-site 352 of the lever-arm 350 where the link 400 is coupled to the lever-arm 350 is in the second half-disk region on the other side of the vertical axis. In this configuration, the stop 358 is separated from the engage-direction-stop 388.

In a second position of the lever-arm 350 relative to the handle-mount 380, actuation of the inner foot-pad 550 or the outer foot-pad 570 is isolated from moving the handle-mount 380.

In alternative embodiments, in the second position of the lever-arm, the lever-arm 350 may be positioned such that actuation of the foot-pad 550 or 570 does not result in movement of the handle-mount 380 sufficient to unlatch the door-latch 200.

Said another way, in some embodiments, actuation of the foot-pad 550 or 570 may result in partial movement of the handle-mount 380 but only to an amount insufficient to unlatch the door-latch 200.

FIG. 14 is another embodiment of the door-unlatching device 50 showing the element-for-link 370 (a thumb-screw in this configuration) is used to engage or disengage the upper actuator 300 and the lower actuator 500.

The lower actuator 500 components are similar to those used in FIG. 2, but with a custom-made-lower-swivel-joint which is secured to the lower-mounting-site 554 (a short post with threaded hole in this configuration) at the lower actuator 500 by a screw 530 and a washer 520.

The link 400 has external threaded lower end 404 which is attached to the custom-made lower-swivel-joint 510.

The major different features are at the upper actuator 300 where the lever-arm 350 has a built-in hole 353 for attaching the handle of door-latch 200 with two set screw 360.

A long upper-swivel-joint 330 is attached to the upper-mounting-site 352 (a short post with threaded hole in this configuration) at the lever-arm 350 by a screw 310 and a washer 320.

The link 400 with a circumferential-groove 402 is secured inside a hole at the long upper-swivel-joint 330.

The element-for-link 370 (thumb-screw) at the long upper-swivel-joint 330 is tightened to secure the circumferential-groove 402 at link 400 for connecting upper and lower actuators in engaged mode to allow foot-operated door-unlatching.

The element-for-link 370 can also be slackened to allow link 440 free-sliding inside the long upper-swivel-joint 330 which disconnects the upper and the lower actuators in disengaged mode to only allow hand-operated door-unlatching, with upper end of link 440 is still inside the hole at the long upper-swivel-joint 330 without separating from it.

FIG. 15 is a perspective view of the illustrative embodiment according to FIG. 14 after all parts are put together to form the upper actuator 300 and the lower actuator 500 which are connected by the link 400; and installed in a hinged door having a door-latch with handle. The figure shows configuration in engaged mode with door in latched position.

FIG. 16 is a top view of lower actuator 500 and link 400 in the embodiment according to FIG. 14.

FIG. 17 is a front view of lower actuator 500 and a portion of link 400 in the embodiment according to FIG. 14.

FIG. 18 is a side view of lower actuator 500 and a portion of link 400 in the embodiment according to FIG. 14.

FIG. 19 is a perspective view of lower actuator 500 and a portion of link 400 in the embodiment according to FIG. 14.

FIG. 20 is a top view of the upper actuator 300 with the link 400 as assembled with parts in FIG. 14. The handle of door-latch 200 fits inside the hole 353 at the lever-arm 350, and is secured by two set screws at the lever-arm 350 from below.

FIG. 21 is sectional front view of the upper actuator 300 with a portion of link 400. The link 400 slides inside a hole at the long upper-swivel-joint 330 and stops at upper-mounting-site 352, then the element-for-link 370 (thumb-screw) at the long upper-swivel-joint 330 is tightened to secure the circumferential-groove 402 at the link 400 for connecting the upper and the lower actuators in engaged mode to allow foot-operated door-unlatching;

FIG. 22 is a side view of upper actuator 300 and a portion of link 400 in the embodiment according to FIG. 14.

FIG. 23 is a perspective view of upper actuator 300 and a portion of link 400 in the embodiment according to FIG. 14.

FIG. 24 is a front view of the embodiment according to FIG. 14 with element-for-link 370 tightened as described in FIG. 21, in engaged mode with door in latched condition with no external force applied, viewed towards inside surface of door.

FIG. 25 is a front view of the embodiment according to FIG. 14 in engaged mode with door in unlatched condition when the user applies force on the foot-placement-area 552 (at either inner or outer-footpad) by foot wearing a shoe to rotate the inner foot-pad 550.

The downward movement of the link 400 rotates the lever-arm 350 with the door-latch 200 for foot-operated door-unlatching.

And the door can be pulled back to open with same foot on foot-placement-area 552. The door-latch can be turned by hand in this engaged position too.

FIG. 26 is a front view of embodiment according to FIG. 14 in disengaged mode with door in latched condition, viewed towards inside surface of door.

The element-for-link 370 (thumb-screw) is slackened to allow the link 400 to free-sliding inside the long upper-swivel-joint-330 and disconnects the lower actuator 500 movement to the upper actuator 300.

Now only a hand can be used to unlatch the door, and the door-latch 200 can be locked to prevent entry from outside as the pivoted-footpads are not effective.

Another embodiment of the upper actuator 300 with the link 400 is shown on FIG. 27, a top view; FIG. 28, a sectional front view, FIG. 29, a side view and FIG. 30, a perspective view.

Most parts of this embodiment are similar to the earlier embodiment disclosed with FIG. 14 except the element-for-link 370 is a quick-release pin at the long-body-swivel-joint 330 (with round hole to fit the quick-release pin) as shown on FIG. 28.

The quick-release pin secures a circular-shape circumferential-groove 402 at the link 400 for connecting the upper and the lower actuators in engaged mode to allow foot-operated door unlatching.

If the element-for-link 370 (quick-release pin) is removed from long-body-swivel-joint 330 to allow the link 400 to free-sliding inside the long upper-swivel-joint 330 and disconnects the upper and the lower actuators, it will be in disengaged mode to only allow hand-operated door-unlatching.

FIG. 31 is an exploded perspective view of the upper actuator 300 with a portion of link 400 in another illustrative embodiment similar to configuration shown on FIG. 2 but adding a ring-shaped finger-guard 356 to the lever-arm 350, with new locations of travel limits for controlling rotation of the lever-arm 350, and adding an optional indent 357 to distinguish the feel of rotating the lever-arm 350 towards engage or disengaged mode.

FIG. 31A is another exploded perspective view of illustrative embodiment according to FIG. 31 showing more details.

The lever-arm 350 has a pivot-hole 354 with a split 355, and the handle-mount 380 has a beveled-edge 385 leading to an undercut-groove 384, and two flat-land 382 to form a snap-fit rotary joint with the lever-arm 350.

The upper-swivel-joint 330 is connected to the upper-end 403 of the link 400 and is fastened to the upper-mounting-site 352 (a threaded hole in this embodiment) at the lever-arm 350 by a screw 310.

The handle of door-latch 200 is secured inside hole 386 at the handle-mount 380 with two set screws 360 from below.

By pushing the beveled-edge 385 of the handle-mount 380 to pass through the pivot-hole 354 of the lever-arm 350, with deflection at the split 355 at the lever-arm 350 under the assembling force, the undercut-groove 384 will anchor the pivot-hole 354 in place to form a rotating joint as shown on FIG. 32A which is a perspective view of lever-arm 350 attached to handle-mount 380.

It is easier to see the relative position of two parts by examining following figures too:

FIG. 32B is a sectional top view of lever-arm attached to handle-mount according to FIG. 31.

FIG. 32C is a sectional side view of lever-arm attached to handle-mount according to FIG. 31.

FIG. 32D is a front view of lever-arm attached to handle-mount according to FIG. 31.

FIG. 32E is a bottom view of lever-arm attached to handle-mount according to FIG. 31.

The operation will be understood easier after the parts are assembled together to form the upper actuator 300 and in engage mode, door latched condition as shown on FIG. 33 which is a top view; FIG. 34 which is front view; and FIG. 35 which is a sectional front view.

As on FIG. 34, the lever-arm 350 is rotated around the handle-mount 380 with its built-in stop 358 and stops at the built-in engaged-direction-stop 388 at the handle-mount 380 for an engaged mode as shown in figure, which a user can apply force by foot at the lower actuator 500 to move the link 400 down to turn the lever-arm 350 with the door-latch 200 for unlatching because the stop 358 can urge force on the engaged-direction-stop 388.

The lever-arm 350 can also be rotated around the handle-mount 380 to other side with its built-in stop 358 not touching anything or with travel limited by the disengaged-direction-stop 389 for a disengaged mode as shown on FIG. 36.

FIG. 36 is the front view of the embodiment according to FIG. 31, in disengaged mode with door in latched condition, viewed towards inside surface of door.

Using the lever-handle 359, the lever-arm 350 is rotated around the handle-mount 380 so that upper-mounting-site 352 is further away from turning axis of door-latch 200.

Usually it is when the handle-mount 380 is between the upper-mounting-site 352 and the turning-axis of door-latch 200 as shown.

In this disengaged mode, the distance between the upper-mounting-site 352 to the door-latch turning-axis (also known as output-moment-arm) is increased.

Working principal of this disengaged mode is same as the earlier in another embodiment disclosed with FIG. 13.

The rotational movement of the inner foot-pad 550 at the lower actuator 500, through the link 400, can only turn the lever-arm 350 around the handle-mount 380 without affecting the door-latch 200, or until the stop 358 at the handle-mount 380 touches the disengaged-direction-stop 389.

Then it still cannot urge the handle-mount 380 or the handle at door-latch 200 to rotate far enough for unlatching the door because the increased output-moment arm will turn a smaller angle with the same rotation of the inner foot-pad 550 at the lower actuator which has same input-moment-arm, as in planar quadrilateral linkage described earlier for embodiment disclosed with FIG. 13.

Only hand can be used to unlatch door in this disengaged mode, and the door-latch 200 can be locked to prevent entry from outside as the pivoted-footpads are not effective.

FIG. 37 is an exploded perspective view of a lower actuator 500 in an embodiment which disconnects upper and lower actuators by separating the mounting-hole 512 at the lower-swivel-joint 510 from its mating lower-mounting-site 554 at inner foot-pad 550.

Disconnection can be made at an intermediary location along the link 400 or at the other end of link 400.

FIG. 38 is an exploded perspective view of an embodiment for use on one side of door only.

This embodiment has very similar parts on FIG. 2, but without the mirror image parts at lower actuator. In addition, a short-pivot 567 at inner mounting-plate 560 is used to support the pivot-hole 557 at the inner foot-pad 550.

FIG. 39 is the perspective view of the all parts assembled in the embodiment according to FIG. 38 and installed to a door with door-latch.

FIG. 40 is an exploded perspective view of another embodiment similar to earlier embodiment disclosed with FIG. 1 to FIG. 10 but instead of using a snap-fit joint to connect the lever-arm 350 and the handle-mount 380, this embodiment uses a flange 390 which has two holes 392, and 2 screws 394 to form the rotary joint between the lever-arm 350 and the handle-mount 380.

FIG. 41 shows the sectional top view of the assembled embodiment according to FIG. 40.

The lever-arm 350 has a hole for a round extension of the handle-mount 380 to pass through.

The flange 390 has an outer diameter larger than the round extension of the handle-mount 380 and with two holes 392 for screws 394.

Two screws 394 are used to hold the flange 390 and the lever-arm 350 to the handle-mount 380 which has two threaded holes to match screws 394.

This finished rotary joint subassembly will allow the lever-arm 350 to rotate around the handle-mount 380 to engaged or disengaged mode as in earlier embodiment disclosed with FIG. 1 to FIG. 10

FIG. 42 is a front view of the embodiment according to FIG. 40.

FIG. 43 is a side view of the embodiment according to FIG. 40.

Numerous modification and variation, still falling within the spirit of the scope of the door-unlatching device, will be apparent to those skilled in the art. Following are examples of modifications: In FIG. 1, instead of using two set screws 360 through the handle-mount 380 to secure a door-latch handle which will pass through the hole 386 during installation, the handle-mount 380 can be adhesive-bonded, welded, clamped to door-latch handle or as a built-in portion of the door-latch handle. Or the handle-mount 380 is modified to have a handle for securing to door-latch with knob. In FIG. 2, the door can be a sliding door instead of hinged door, if working with a door-latch having a hook-latching instead of a beveled-wedge-latching piece. In FIG. 2 where the door-unlatching device 50 is shown as installed on inside of door, the door-unlatching device 50 can be installed with the link 400 on outside of door too. In FIG. 6, instead of using flat head wood or sheet metal screws 540 as shown, long flat head machine screws through the door thickness can be used when mating threaded holes are made at either 560' or 560.

FIG. 44 is an exploded perspective of illustrative embodiment of the door-unlatching device 50 in accordance with the aspect of this disclosure which can also remove outside foot-operated-unlatching capability, which is similar to earlier embodiment disclosed with FIG. 1 to FIG. 10; but with following change:

The outer foot-pad 570 with pivot-axle 573 and mounting-feature 572 (a short square extension with threaded hole at center in this configuration) passes through a shaft hole at outer mounting-plate 560' (mirror-image part of inner mounting-plate 560), a clearance hole drilled at the door, a shaft-hole 561 at inner mounting-plate 560, a hole 553 at the inner foot-pad 550, then is secured to the coupling-plate 600 at the mounting-feature 602 (a square hole in this configuration) by a washer 580 and a screw 590, such that the coupling-plate 600 always rotates with the outside-provide-foot-pad.

The coupling-plate 600 has a lower-mounting-site 604 (threaded hole at this configuration) holding a coupling-screw 534 which can extend to connect the inner foot-pad 550 at the coupling-site 559, so that inner foot-pad 550 will turn with the outer foot-pad 570.

The coupling-screw 534 can separate from the coupling-site 559 so that the inner foot-pad 550 will rotate around pivot-axle 573 without turning the outside-foot-pad 570.

FIG. 44A is a perspective view of an illustrative embodiment according to FIG. 44, installed in a door and in engaged mode with door in latched condition, and with both outside and inside foot-operated-unlatching capability.

The coupling-screw 534 at coupling-plate 600 is extended towards and connected to the inner foot-pad 550 at the coupling-site 559, so that outer foot-pad 570 can turn with the inner-provide-foot-pad for both side foot-operated door-unlatching capability.

FIG. 45 is a perspective view of lower actuator 500 in the embodiment according to FIG. 44 at engaged mode for foot-pad 550 only, no external force condition and with the outside foot-operated-unlatching capability removed.

The coupling-screw 534 at coupling-plate 600 is slackened to separate from the inner foot-pad 550, so that the outer foot-pad 570 is not connected to inner foot-pad 550 and will drop to the lower position by itself as shown.

Instead of using a coupling-screw 534, a quick-release pin can also be arranged to connect or separate the coupling-plate 600 and the inner foot-pad 550, when holes are made at the coupling-plate 600 and the inner foot-pad 550 to fit the quick-release pin. Alternative couplers would also be understood.

FIG. 46 is an exploded perspective view of an illustrative embodiment using an external retaining ring 702 for securing the handle-mount 380 to the lever-arm 350 at the upper actuator 300.

A circular groove 700 at the handle-mount 380 is used to secure an external retaining ring 702 which keeps the handle-mount 380 attached to the lever-arm 350, and allows the handle-mount 380 to rotate on the lever-arm 350.

FIG. 47 is an assembled perspective view showing the external retaining ring securing the handle-mount 380 and the lever-arm 350 together at assembly.

FIG. 48 is another assembled perspective view showing the external retaining ring securing the handle-mount 380 and the lever-arm 350 together at assembly.

FIG. 49 is an exploded perspective view of illustrative embodiment using a hinge shaft 820 with screws 840 to connect the inner foot-pad 550 and outer foot-pad 570 at the lower actuator 500.

The hinge shaft 820 passes through a corresponding shaft-hole at the inner foot-pad 550, a corresponding shaft-hole at the inner mounting-plate 560, a clearance hole drilled at the door 100 (door 100 is not shown in FIG. 49), a corresponding shaft-hole at the outer mounting-plate 560', and a corresponding shaft-hole at the outer foot-pad 570.

Then a screw 840 passes through the hole 860 at the inner foot-pad 550 to secure one end of hinge shaft 820 at threaded hole 870, and another screw 840 passes through the hole 860 at the outer foot-pad 570 to secure the other end of hinge shaft 820 at another threaded hole 870, so that both inner foot-pad 550 and outer foot-pad 570 will both rotate together about the hinge shaft 820 based on actuation of either the inner foot-pad 550 or the outer foot-pad 570.

Other methods or fasteners such as adhesive, welding, cotter pin or clamping collar can also be used to attach either end of hinge shaft 820 to outer foot-pad 570 or inner foot-pad 550.

The fasteners, adhesive, weld, or hinge shaft 820 itself can be designed such that one can break when overloaded as an anti-theft feature by keeping the inner foot-pad 550 operating within its designed travel limits.

One of the fasteners, adhesive, weld, or hinge shaft 820 can be configured to fail if someone tampers with the door-unlatching device 50 by attempting to forcibly rotating one of the inner foot-pad 550 or outer foot-pad 770 beyond its intended range of rotation, thereby preventing unlatching.

FIG. 50 is the assembled perspective view of illustrative embodiment using a hinge shaft 820 with screws 840 to connect the inner foot-pad 550 and the outer foot-pad 570 at the lower actuator 500 according to FIG. 49.

Methods of use include a method of using a door-unlatching device comprising a lower actuator comprising a foot-pad, an upper actuator comprising a lever-arm and a handle-mount attachable to a door-latch handle, and a link coupled to the foot-pad and the lever-arm, the method comprising: moving the lever-arm between a first position and a second position relative to the handle-mount.

Methods of use include a method wherein the moving of the lever-arm is achieved by rotating the lever-arm about the handle-mount.

Methods of use include a method wherein, in the first position of the lever-arm, actuation of the foot-pad moves the lever-arm and the handle-mount, and wherein, in the second position of the lever-arm, movement of the lever-arm is disconnected from the handle-mount.

Methods of assembly include a method of assembling a door-unlatching device, the method comprising coupling a handle-mount to a lever-arm, coupling the handle-mount to a door-latch handle, coupling a link to the lever-arm, and coupling the link to a lower actuator including a footpad.

Methods of assembly include a method further comprising wherein the lever-arm is coupled such that it can move between a first position and a second position relative to the handle-mount.

Methods of assembly include a method further comprising wherein, in the first position of the lever-arm, the lever-arm is positioned such that actuation of the foot-pad moves the lever-arm and the handle-mount, and wherein, in the second position of the lever-arm, the lever-arm is positioned such that actuation of the foot-pad does not result in movement of the handle-mount sufficient to unlatch the door-latch.

A door-unlatching device (50) comprising: a lower actuator (500) comprising a foot-pad (550); an upper actuator (300) comprising a lever-arm (350) and a handle-mount (380); and a link (400) coupled to the foot-pad (550) and the lever-arm (350), wherein the lever-arm (350) is movable between a first position and a second position relative to the handle-mount (380).

The door-unlatching device (50) may further include wherein the lever-arm (350) is rotatable relative to the handle-mount (380).

The door-unlatching device (50) may further include wherein the lever-arm (350) is rotatable between the first position and the second position, wherein, in the first position of the lever-arm (350), actuation of the foot-pad (550) moves the lever-arm (350) and the handle-mount (380), and wherein, in the second position of the lever-arm (350), movement of the lever-arm (350) is disconnected from the handle-mount (380).

The door-unlatching device (50) may further include wherein the lever-arm (350) comprises an opening or pivot-hole (354) configured to receive a portion of the handle-mount (380).

The door-unlatching device (50) may further include wherein the lever-arm (350) comprises a stop (358) configured to contact the handle-mount (380).

The door-unlatching device (50) may further include wherein in the first position of the lever-arm (350), when the foot-pad (550) is actuated, thereby moving the link (400) and lever-arm (350), the handle-mount (380) is moved by the stop (358) of the lever-arm (350).

The door-unlatching device (50) may further include wherein the handle-mount (380) is integrally formed with a handle of door-latch (200)

The door-unlatching device (50) may further include wherein the handle-mount (380) is configured to be attachable to a handle of a door-latch (200), and wherein the handle-mount (380) comprises a hole (386) configured to receive a distal end of the handle of door-latch (200).

The door-unlatching device (50) may further include wherein the lower actuator (500) further comprises a mounting-plate (560).

The door-unlatching device (50) may further include wherein the lower actuator (500) further comprises a second mounting-plate (560') and a second foot-pad (570), and wherein the foot-pad (550) and the second foot-pad (570) are fixed to one another.

The door-unlatching device (50) may further include wherein the lever-arm (350) comprises a lever-handle (359) providing a feature for a user to grasp and rotation the lever-arm (350).

A door unlatching device (50) comprising a lower actuator (500) comprising a first mounting-plate (560) for attachment to a door (100), a second mounting plate (560') for attachment to the door (100), a first foot-pad (550), and a second foot-pad (570); an upper actuator (300) comprising a lever-arm (350) and a handle-mount (380) attachable to a handle of door-latch (200); and a link (400) coupled to the first foot-pad (550) and the lever-arm (350); wherein in a first position of the link (400) relative to the handle-mount (380), actuation of the first foot-pad (550) or the second foot-pad (570) moves the lever-arm (350) and the handle-mount (380) to unlatch a door-latch (200), and wherein in a second position of the link (400) relative to the handle-mount (380), actuation of the first foot-pad (550) or the second foot-pad (570) does not move the handle-mount (380) sufficient to unlatch the door-latch (200).

In some embodiments, the handle-mount (380) does not move in the second position.

In other embodiments, the handle-mount (380) may move but move insufficiently for unlatching the door-latch (200).

A door unlatching device (50) comprising a lower actuator (500) comprising a first mounting-plate (560) for attachment to a door (100), a second mounting plate (560') for attachment to the door (100), a first foot-pad (550), and a second foot-pad (570); an upper actuator (300) comprising a lever-arm (350) and a handle-mount (380); and a link (400) coupled to the first foot-pad (550) and the lever-arm (350); wherein in a first position of the link (400) relative to the handle-mount (380), actuation of the first foot-pad (550) or the second foot-pad (570) moves the lever-arm (350) and the handle-mount (380) to unlatch a door-latch, and wherein in a second position of the link (400) relative to the handle-mount (380), actuation of the first foot-pad (550) or the second foot-pad (570) does not move the handle-mount (380) sufficient to unlatch a door-latch (200).

The door-unlatching device (50) may further include wherein the lever-arm (350) comprises a stop (358) configured to contact the handle-mount (380).

The door-unlatching device (50) may further include wherein the lever-arm (350) is rotatable relative to the handle-mount (380).

The door-unlatching device (50) may further include wherein the lever-arm (350) is rotatable between a first position and a second position, wherein, in the first position of the lever-arm (350), the link (400) is in the first position of the link (400) and actuation of the first foot-pad (550) or the second foot-pad (570) moves the lever-arm (350) and the handle-mount (380); and wherein, in the second position of the lever-arm (350), the link (400) is in the second position of the link (400) and actuation of the first foot-pad (550) or the second foot-pad (570) is disconnected from movement of the handle-mount (380).

A door unlatching device (50) comprising: a lower actuator (500) comprising a first mounting-plate (560) for attachment to a door (100), a second mounting-plate (560') for attachment to the door (100), a first foot-pad (550), a second foot-pad (570); an upper actuator (300) comprising a lever-arm (350) and a handle-mount (380) attachable to a handle of door-latch (200), the lever-arm (350) being movable relative to the handle-mount (380); and a link (400) coupled to the first foot-pad (550) and the lever-arm (350); wherein in a first position of the lever-arm (350) relative to the handle-mount (380), actuation of the first foot-pad (550) or the second foot-pad (570) moves the lever-arm (350) and the handle-mount (380), and wherein in a second position of the lever-arm (350) relative to the handle-mount (380), actuation of the first foot-pad (550) or the second foot-pad (570) is isolated from moving the handle-mount (380).

A door unlatching device (50) comprising: a lower actuator (500) comprising a first mounting-plate (560) for attachment to a door (100), a second mounting-plate (560') for attachment to the door (100), a first foot-pad (550), a second foot-pad (570); an upper actuator (300) comprising a lever-arm (350) and a handle-mount (380), the lever-arm (350) being movable relative to the handle-mount (380); and a link (400) coupled to the first foot-pad (550) and the lever-arm (350); wherein in a first position of the lever-arm (350) relative to the handle-mount (380), actuation of the first foot-pad (550) or the second foot-pad (570) moves the lever-arm (350) and the handle-mount (380), and wherein in a second position of the lever-arm (350) relative to the handle-mount (380), actuation of the first foot-pad (550) or the second foot-pad (570) is isolated from moving the handle-mount (380).

DETAILED DESCRIPTION

Figures 1, 1A:
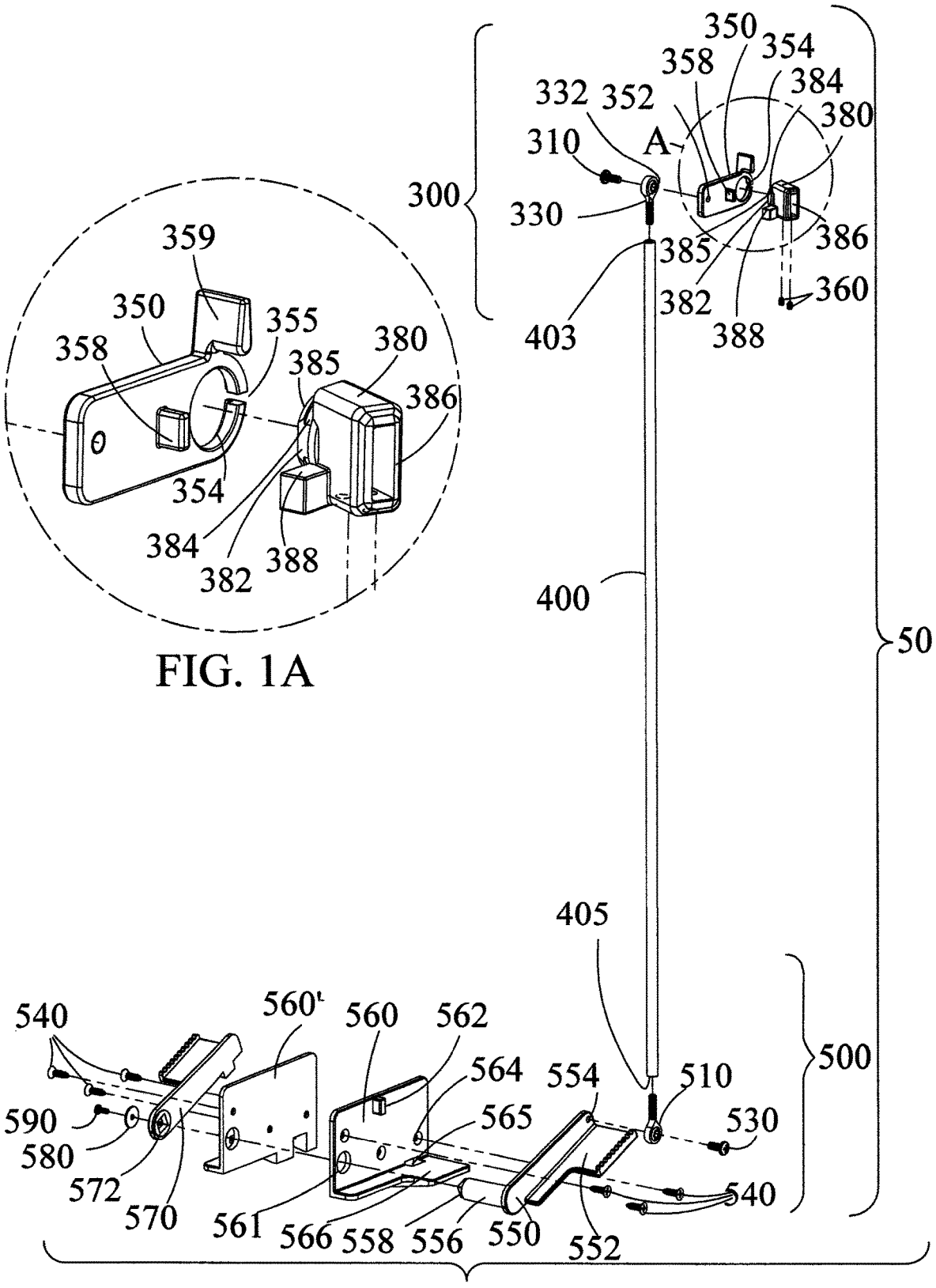
FIG. 1 is an exploded perspective view of an illustrative embodiment of a door-unlatching device in accordance with the aspect of this disclosure.
FIG. 1A is an enlarged view of portion "A" in FIG. 1.

FIGS. 1-10 illustrate an exemplary embodiment of a door-unlatching device 50. The door-unlatching device includes an upper actuator 300, a lower actuator 500, and a link 400. The upper actuator 300 is connected to a lower actuator 500 by a link 400. The foot-operated door-unlatching device (50) is configured to be installed on a door (100) with the upper actuator 300 attached to a handle of door-latch (200) and the lower actuator (500) attached to the door (100). Additional details of its operation and the ability to disengage foot actuation of the lower actuator 500 from the handle of door latch 200 will be explained with FIG. 11, FIG. 12 and FIG. 13 later.

FIG. 1 is an exploded perspective view of components in the upper actuator 300, the link 400, and the lower actuator 500. The upper actuator 300 is described in further detail below with respect to at least FIGS. 1A-1M and 7-10. The lower actuator 500 is described in further detail below with respect to at least FIGS. 3-5.

As shown on FIG. 1, the lower actuator 500 may include an inner mounting-plate 560. The inner mounting-plate 560 has a surface for contact with and mounting to a first side of a door. The inner mounting-plate 560 may have at least one mounting hole 564 to allow mounting to the door with screws 540. In some embodiments at least three mounting holes 564 may be provided. Alternative methods of mounting may be used, such as using adhesive or welding, which would not require the mounting holes 564. The inner mounting-plate 560 may have a shaft-hole 561 configured to receive a part of a foot-pad. The inner mounting-plate 560 may have a pad-stop 566 to limit the travel of an attached foot-pad. In some embodiments, the pad-stop 566 may be a protrusion extending approximately 90 degrees relative to the door-mounting surface of the inner mounting-plate 560.

The lower actuator 500 may include an outer mounting-plate 560', which is for mounting to a second opposite side of the door. The outer mounting-plate 560' can be a mirror image of the inner-mounting-plate, or it may have a different shape.

The lower actuator 500 may include an inner foot-pad 550 which has a pivot-axle 556. The pivot-axle 556 passes through a shaft-hole 561 at inner mounting-plate 560, a clearance hole drilled at the door, and a corresponding shaft-hole at outer mounting-plate 560'. At a distal end of the pivot-axle 556, the pivot-axle 556 may include a mounting-feature 558 and a threaded hole at the axle end for a screw 590.

The lower actuator 500 may include an outer foot-pad 570. The inner foot-pad 550 and the outer foot-pad 570 may be secured to one another by way of a screw 590 and washer 580 or similar fastener. The outer foot-pad 570 may have a mounting-feature 572 corresponding to the mounting-feature 558 of the pivot-axle 556 of the inner foot-pad 550. The mounting-feature 558 of the inner foot-pad 550 and the mounting-feature 572 of the outer foot-pad 570 correspond to each other such that the inner foot-pad 550 and the outer foot-pad 570 will both rotate together about the pivot-axle 556 based on actuation of either the inner foot-pad 550 or the outer foot-pad 570. In alternative embodiments, adhesive or other securing options can be used. For example, the mounting-features 558, 572 may have corresponding geometric features, such as a rectangular projection and recess. Alternative embodiments of the mounting-features 558, 572 may include splining or similar keying. FIG. 1 shows an exemplary embodiment where the mounting-feature 558 includes a short square shaft extension and a threaded hole, and the other mounting-feature 572 is a matching square hole or recess configured to receive the mounting-feature 558. This geometric configuration prevents slippage between the inner foot-pad 550 and the outer foot-pad 570.

In alternative embodiments, the pivot-axle 556 and related features may be reversed such that the pivot-axle 556 is on the outer foot-pad 570 instead of the inner foot-pad 550.

In some embodiments, the lower actuator 500 may only have one mounting-plate 560 and one foot-pad 550. In such a case, the foot-pad 550 would be rotatably attached to the mounting-plate 560. In some embodiments, the mounting plate may have a screw hole to allow for rotatable attachment of the foot-pad. In other embodiments, A short-pivot 567 may extend as an integral projection from the mounting-plate 560 and the foot-pad 550 may be rotatably attached to the short-pivot 567 of the mounting plate 560 The upper actuator 300 of the door-unlatching device may include a lever-arm 350 and a handle-mount 380. The handle-mount 380 is then coupled to the handle of a door-latch 200.

Embodiments may include coupling or connecting two or more components of the door-unlatching device 50 either directly or indirectly.

A link 400 used for connecting the lower actuator 500 to an upper actuator 300 is a rod with lower-end 405 and upper-end 403 (which are threaded holes in this embodiment) for connecting to a lower-swivel-joint 510 at lower actuator 500 and an upper-swivel-joint 330 at upper actuator 300. Although a rigid rod is used as link 400 in this embodiment, since the connection is working in tension, the link 400 can also be a flexible chain, or a steel wire, or a rope with both ends that are attached to upper and lower actuator using either fasteners such as screws, rivets; or welding, crimping and clamping methods too.

A screw 530 may be used to fasten the lower-swivel-joint 510 (or ball joint rod end) to the lower actuator 500 at the lower-mounting-site 554 (a threaded hole in this configuration), and a screw 310 may pass through the hole 332 at the upper-swivel-joint 330 (or ball joint rod end) and fasten the joint to the upper actuator 300 at the upper-mounting-site 352. The connection between the link 400 and the upper or lower actuator can be done by way of fasteners. Alternatively, the link 400 may simply have a dogbone configuration where the ends of the links have through-bore holes for fasteners, similar to vehicle suspension dogbone links.

FIG. 1A is a bigger view of a lever-arm 350 and a handle-mount 380 as also shown in area A on FIG. 1. The upper actuator 300 has a lever-arm 350 jointed to and rotates around a handle-mount 380. The lever-arm 350 has an upper-mounting-site 352 (a threaded hole in this embodiment) for mounting the upper-swivel-joint 330 which is connected to the upper-end 403 of link 400. The descriptive details which follow will be best understood by first examining the handle-mount 380 in the upper actuator 300.

Figure 1D:
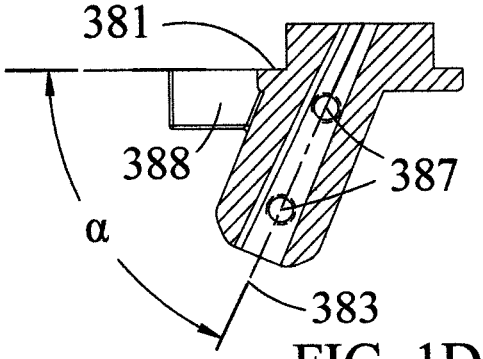
FIG. 1D is a sectional top view of handle-mount 380 in FIG. 1 taken along section line 1D-1D.
Figure 1B:
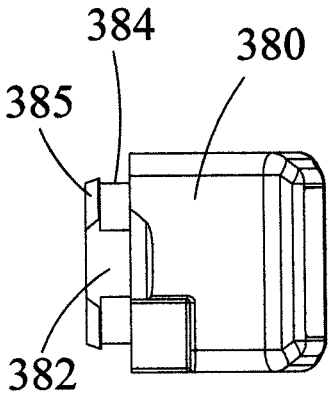
FIG. 1B is a side view of handle-mount 380 in FIG. 1.

FIGS. 1B-1M illustrate components of an exemplary embodiment of the upper actuator 300. FIG. 1B shows a side view of the handle-mount 380. As shown on a side view FIG. 1B, the handle-mount 380 has a stepped cylindrical extension with the larger diameter stepped portion near one end to form a cylindrical undercut-groove 384, a beveled-edge 385 at the extension end leading to the undercut-groove 384, and two opposing flat-land 382 along the extension length. The two flat-land 382 are configured to help forming a snap-fit rotary joint with the lever-arm 350 described further below.

Figure 1C:
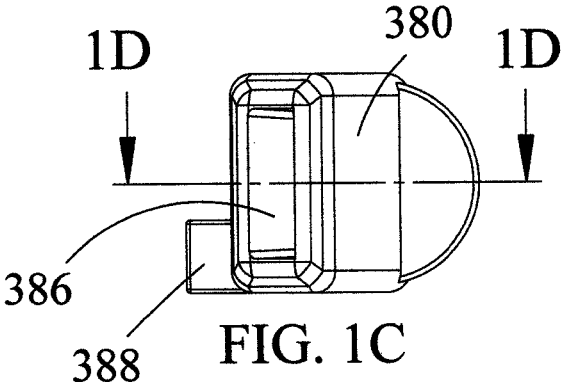
FIG. 1C is a front view of handle-mount 380 in FIG. 1.
Figure 1E:
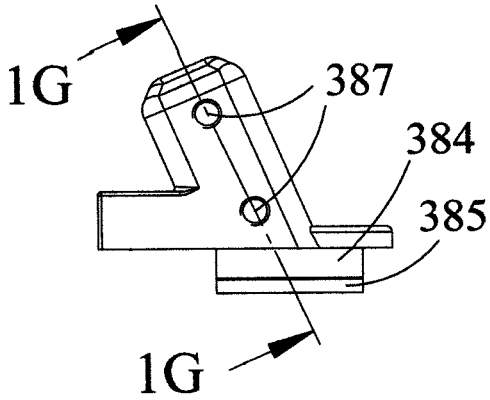
FIG. 1E is a bottom view of handle-mount 380 in FIG. 1.
Figure 1G:
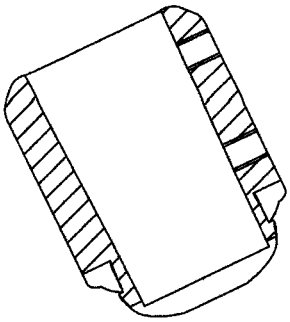
FIG. 1G is a projected sectional view of handle-mount 380 in FIG. 1 taken along section line 1G-1G.
Figure 1F:
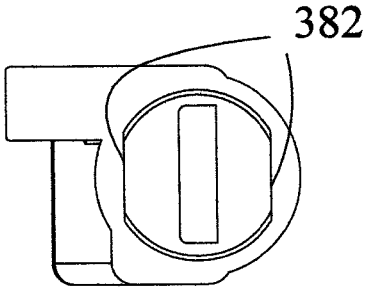
FIG. 1F is a back view of handle-mount 380 in FIG. 1.

FIG. 1C is a front view of the handle-mount 380 which has a hole 386 shaped to fit the handle of a door-latch mounted on a door. As shown on a sectional top view FIG. 1D, a bottom view FIG. 1E, and a projected sectional view FIG. 1G; the handle-mount 380 has two threaded-holes 387 through which two set screws 360 will be used to secure the handle of door-latch in assembly. In some embodiments, only one threaded-hole and set screw will be used. In some embodiments, no threaded-holes or set screws will be used.

As shown in FIG. 1D, the hole 386 shaped to fit a bent end portion of a door-latch handle, which is angled at an angle $\alpha$ between the central plane 383 of hole 386 and a mating-surface 381 on handle-mount 380. This is due to many door-latch handles having an angled end. By having the hole 386 angled, the upper actuator 300 is not severely skewed relative to a door and in danger of contacting the door in the upper actuator's operation.

In some embodiments, the hole 386 will be sufficiently large to accept different angled door-latch handles. In addition, or as an alternative to the set screws, a filler material can be inserted into the hole 386 to secure the door-latch handle to the hole 386. For example, a hard foam or rubber insert can be used as an adapter for the door-latch handle and the hole 386. Alternatively, in some embodiments, different handle-mount 380 components with different angles $\alpha$ will be manufactured to specifically fit particular types of door-latch handles. The angle $\alpha$ s the angle between the axle of hole 386 with the mating-surface 381 of the handle-mount 380. In the case of a curved handle at door-latch 200, the hole 386 may have a curved hole 386 or a hole with filler material insert to fit.

In other embodiments to fit a door-latch with straight handle without a bent end, the handle-mount 380 may have a bent section with hole 386 in line with the straight handle of door-latch; such that the central plane 383 of hole 386 may be away from and parallel with the mating-surface [381] on handle-mount 380.

In other embodiments, the handle-mount 380 may include the door-latch handle in a unitary construction. Said another way, the handle-mount 380 may be integrally formed with the door-latch handle. That is, the handle-mount 380 may include a door-latch handle as a single piece instead of a multi-part assembly with a handle fitting into a hole.

Figure 1J:
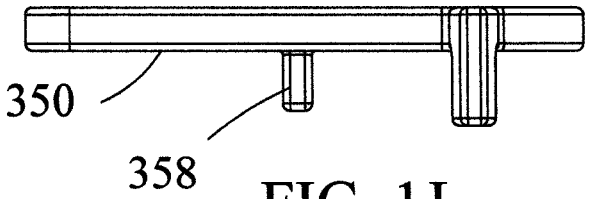
FIG. 1J is a top view of lever-arm 350 in FIG. 1.
Figure 1K:
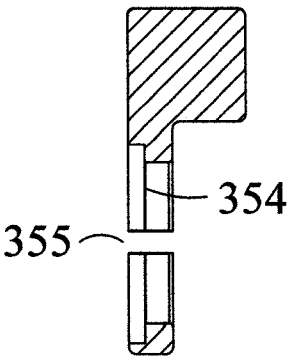
FIG. 1K is a sectional side view of lever-arm 350 in FIG. 1.
Figure 1H:
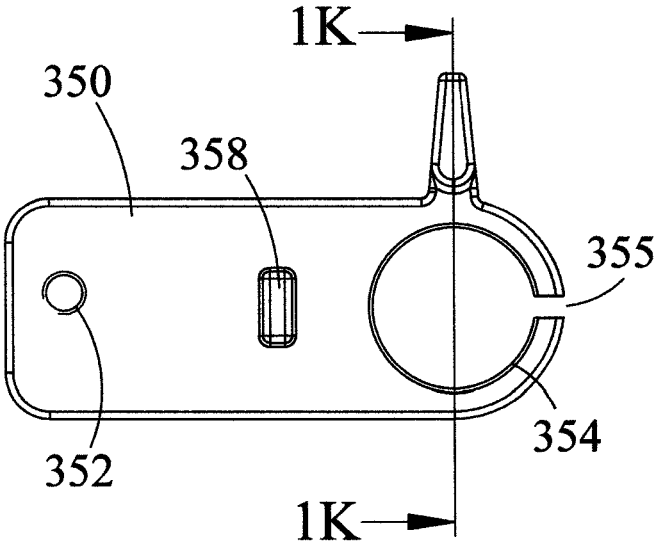
FIG. 1H is a front view of lever-arm 350 in FIG. 1.
Figure 1L:
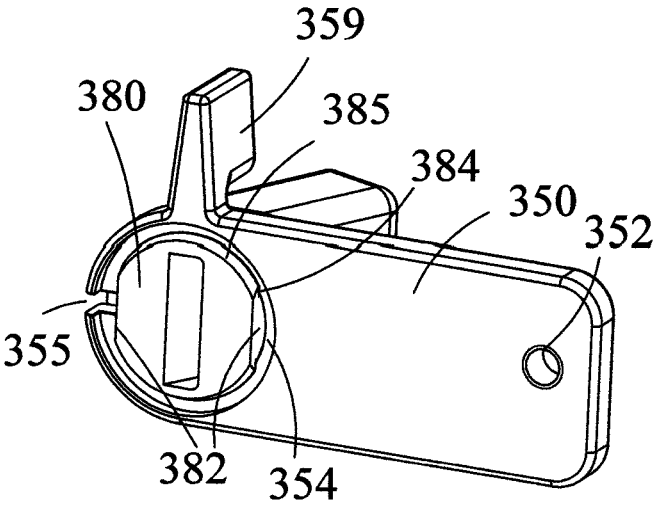
FIG. 1L is a perspective view of lever-arm 350 attached to handle-mount 380.

FIG. 1H is a front view of the lever-arm 350; FIG. 1J, a top view; FIG. 1K, a sectional side view; FIG. 1L, a perspective view; and FIG. 1M, another perspective view. As shown on FIG. 1H and FIG. 1K, the lever-arm 350 has a pivot-hole 354 with a split 355 which allows the pivot-hole to expand under force. In embodiments, the pivot-hole 354 may be counter-bored. In alternative embodiments, the pivot-hole 354 may not have a split 355. The pivot-hole 354 may be sized such that the beveled-edge 385 can be passed through the pivot-hole 354 with elastic deformation of the pivot-hole 354 at the lever-arm 350 or elastic deformation of the beveled-edge 385 at the handle-mount 380. It also has a lever-handle 359, and an upper-mounting-site 352 (which is a threaded hole in this embodiment) for mounting the upper-swivel-joint 330.

FIG. 1L is a perspective view of the lever-arm 350 attached to the handle-mount 380. By pushing the beveled-edge 385 of the handle-mount 380 to pass through the pivot-hole 354 of the lever-arm 350, with deflection at the split 355 at lever-arm 350 under the assembling force, the undercut-groove 384 will anchor the pivot-hole 354 in place to form a rotary joint.

Figure 1M:
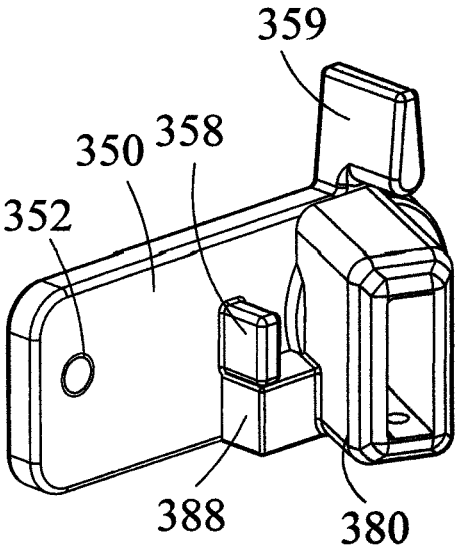
FIG. 1M is another perspective view of lever-arm 350 attached to handle-mount 380.

FIG. 1M is another perspective view of the lever-arm 350 attached to handle-mount 380. A user can use the lever-handle 359 to turn the lever-arm 350 around handle-mount 380 within travel limit of stop 358 at lever-arm 350 which either rests on or away from the engage-direction-stop 388 at handle-mount 380.

Figure 2:
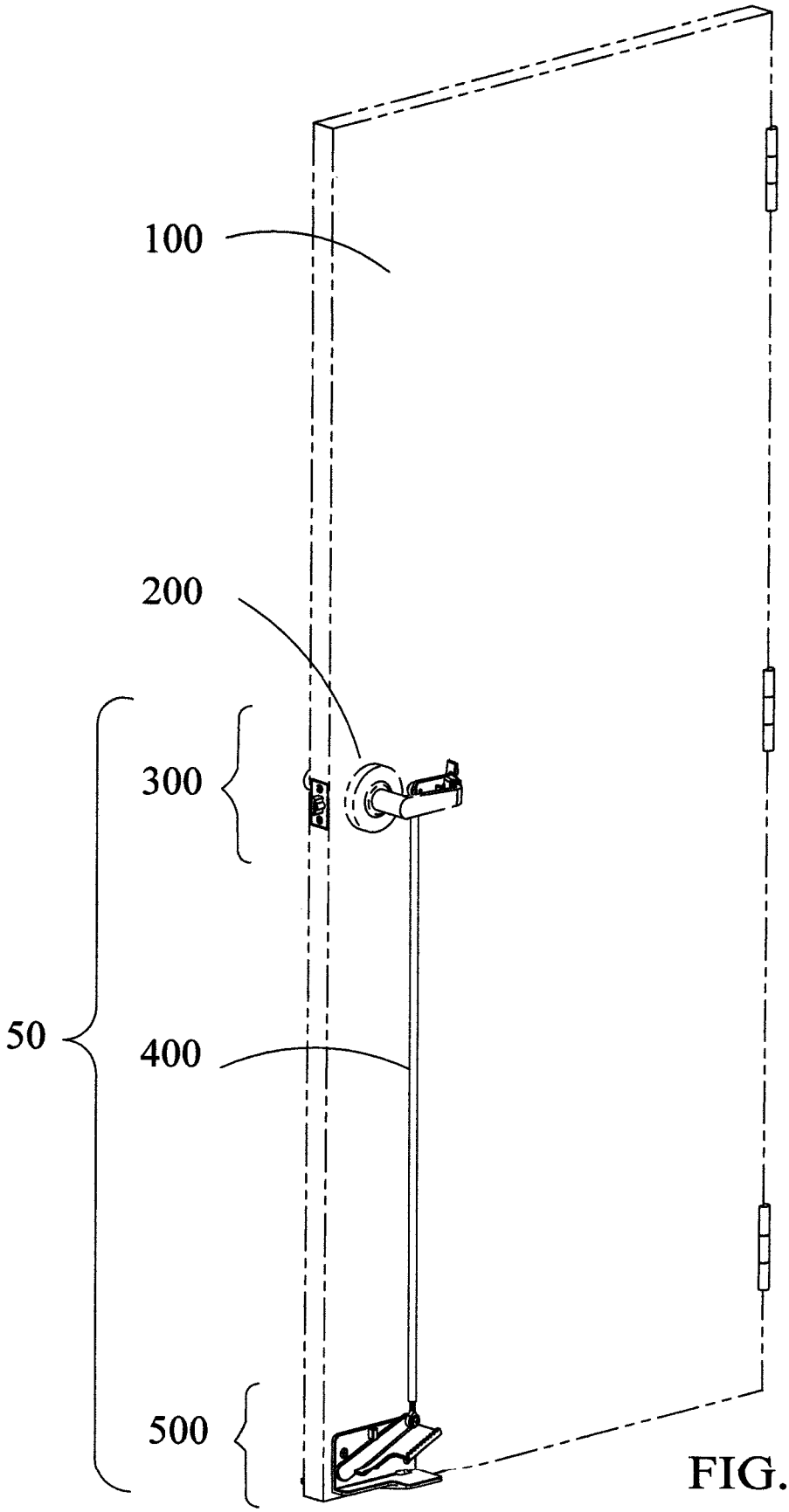
FIG. 2 is a perspective view of an illustrative embodiment of the door-unlatching device in accordance with the aspect of this disclosure, installed in a door and in engaged mode with door in latched condition. Engaged mode is when embodiment allows either hand or foot to operate the door latch.

FIG. 2 is a perspective view of the illustrative embodiment of the door-unlatching device in accordance with the aspect of this disclosure, after all parts for the door-unlatching device 50 shown in FIG. 1 are installed in a hinged door 100 with a door-latch 200 to form an upper actuator 300 connected to a lower actuator 500 by a link 400. It is in engaged mode with no external force applied for door latched.

The remaining figures address more details on components in assembly, function and advantages of the claimed device.

Figure 3:
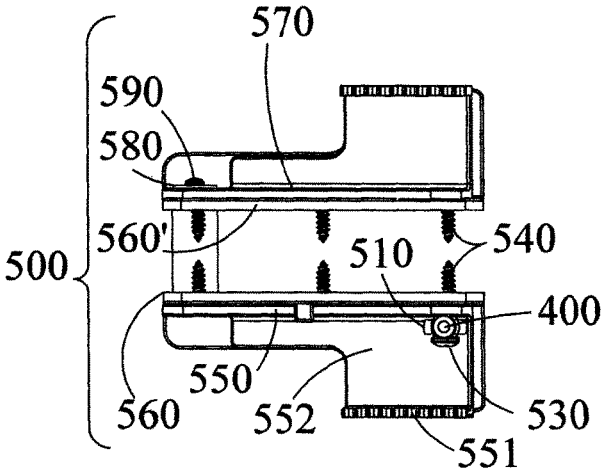
FIG. 3 is a top view of lower actuator and link in the embodiment according to FIG. 2.

FIG. 3 is a top view of the lower actuator 500 and the link 400 as assembled in FIG. 2.

Figure 4:
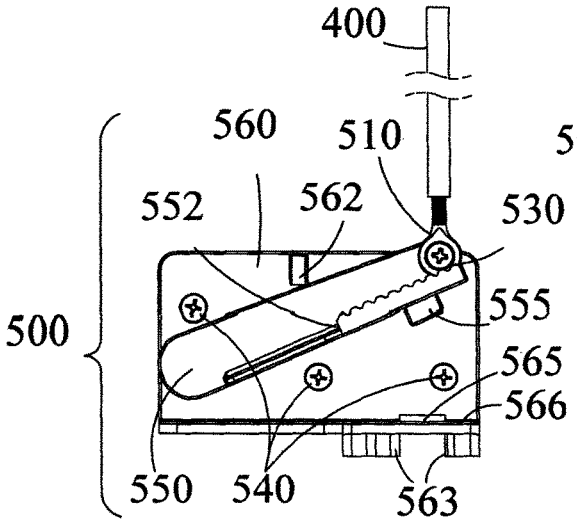
FIG. 4 is a front view of lower actuator and a portion of link in the embodiment according to FIG. 2.

FIG. 4 is a front view of the lower actuator 500 and a portion of link 400. In engaged mode with no external force applied, the link 400 is pulled up by the door-latch 200 and the inner foot-pad 550 is limited by the travel-stop 562 at inner mounting-plate 560. There is anchor 555 at the inner foot-pad 550 which can engage the anchor-hole 565 at the inner mounting-plate 560 if user applies force to rotate the inner foot-pad 550 downward for unlatching door. This anchor 555 to anchor-hole 565 arrangement will allow more tolerances when making parts for the embodiment.

For comfortable use, a desirable rotational range of the inner foot-pad 550 is from less than 45 degrees above horizontal level to less than 30 degrees below horizontal level. The inner mounting-plate 560 has a travel-stop 562 to limit the rotational movement of inner foot-pad 550 between it and the pad-stop 566.

Figure 5:
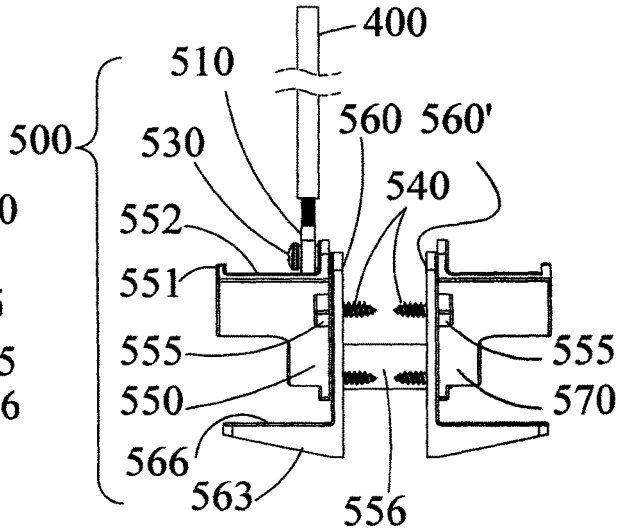
FIG. 5 is a side view of lower actuator and a portion of link in the embodiment according to FIG. 2.

FIG. 5 is the side view of the lower actuator 500 and a portion of link 400. The pad-stop 566 has optional ribs 563 for strengthening the inner-mounting-plate 560 and 560' if weaker material such as injection-molded plastics is used instead of metal for making the parts.

Figure 6:
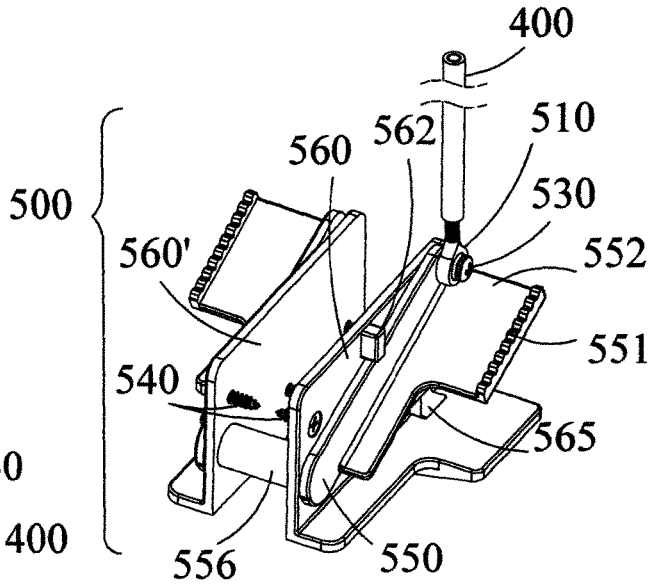
FIG. 6 is a perspective view of lower actuator and a portion of link in the embodiment according to FIG. 2.

FIG. 6 is a perspective view of the lower actuator 500 and a portion of the link 400. The inner foot-pad 550 may include a foot-placement-area 552. The foot-placement-area 552 may include a raised serration or patterned edge 551. The raised serration or patterned edge 551 is configured to enhance grip or traction for when a user actuates the inner foot-pad 550. These features may be mirrored on the outer foot-pad 570. When a user operates the device, the user has to first step on one of the foot-pads 550, 570 to rotate the foot-pads and cause downward movement of the link 400. The downward movement of the link 400 rotates the lever-arm 350 and urges the handle-mount 380 and the door-latch 200 to rotate together for unlatching the door. After this, the door can be pulled back or pushed forward to open with same foot on foot-placement-area 552. In doing this, good traction is required in order to prevent slippage and the user losing control of the door.

Figure 7:
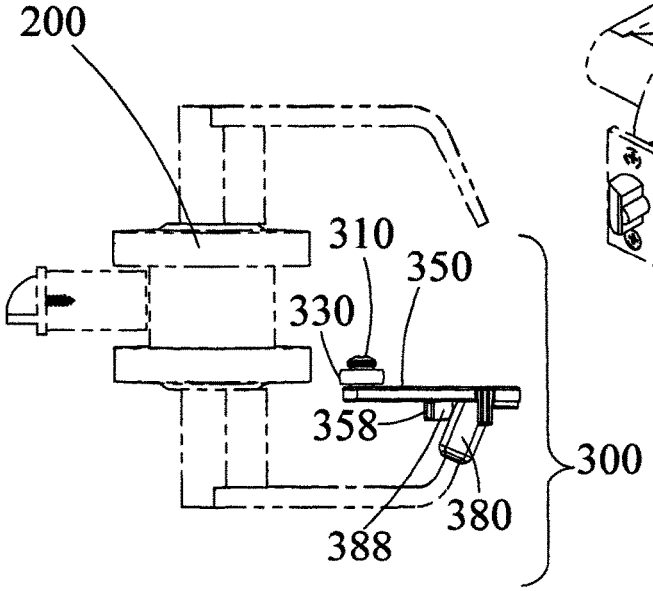
FIG. 7 is a top view of upper actuator and a portion of link in the embodiment according to FIG. 2

FIG. 7 is a top view of the upper actuator 300 with the link 400 as assembled in FIG. 2. The handle of door-latch 200 fits into the handle-mount 380, and is secured by two set screws 360 at handle-mount 380 from below.

Figure 8:
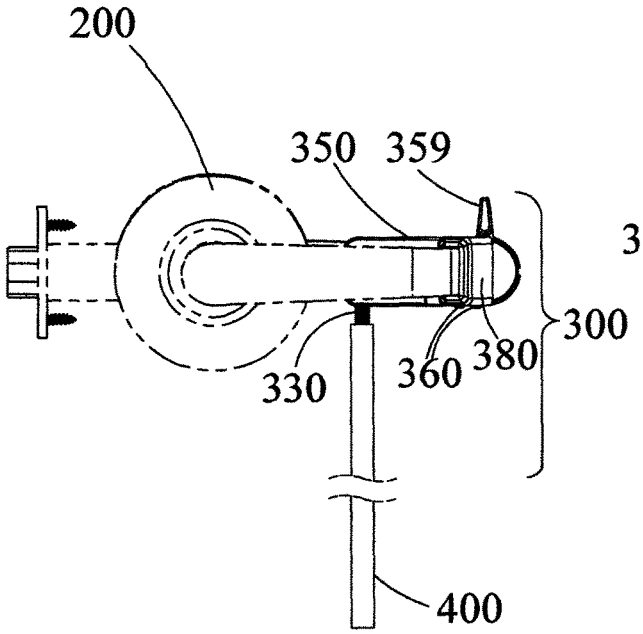
FIG. 8 is a front view of upper actuator and a portion of link in the embodiment according to FIG. 2.

FIG. 8 is a front view of the upper actuator 300 and a portion of the link 400 as assembled in FIG. 2.

Figure 9:
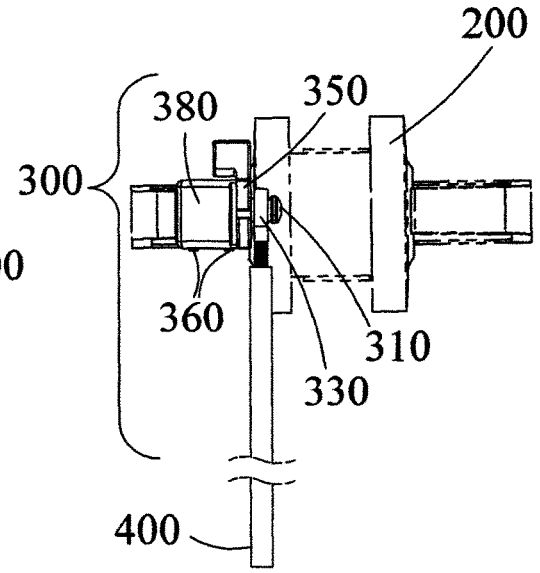
FIG. 9 is a side view of upper actuator and a portion of link in the embodiment according to FIG. 2.

FIG. 9 is a side view of the upper actuator 300 and a portion of the link 400 as assembled in FIG. 2.

Figure 10:
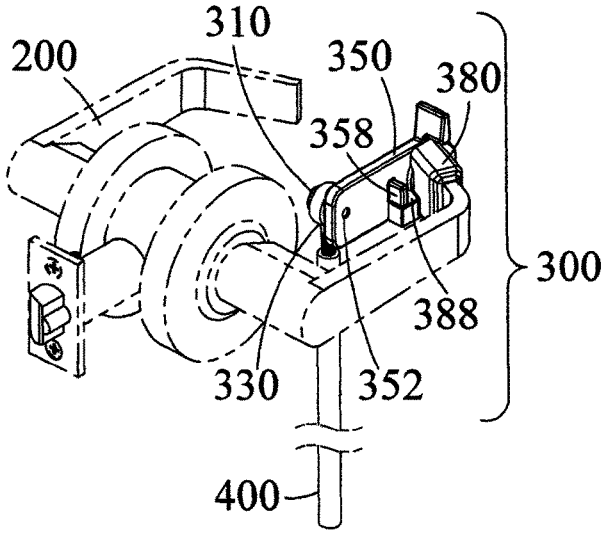
FIG. 10 is a perspective view of upper actuator and a portion of link in the embodiment according to FIG. 2.

FIG. 10 is a perspective view of the upper actuator 300 and a portion of the link 400 as assembled in FIG. 2. The lever-arm has the upper-swivel-joint 330 connected to the upper-end (403) of link 400 and secured at the upper-mounting-site 352 with a screw 310. The device is shown in engaged mode which is when the lever-arm 350 rotates around handle-mount 380 until the stop 358 rests on the engage-direction-stop 388. In this engaged mode, applying downward movement of link 400 will rotate lever-arm 350 and urge handle-mount 380 and door-latch 200 to rotate together for unlatching the door.

It is desirable to rotate the inner foot-pad 550 at the lower actuator by foot with less than 45 degrees rotational movement for comfortable door-unlatching, but the handle at a door-latch 200 usually needs to turn more than 45 degrees for unlatching a door. Therefore, arrangement to increase rotational movement of door-latch is made by turning the lever-arm 350, using lever-handle 359, around the handle-mount 380 and stop at the position as shown; which has the distance of upper-mounting-site 352 to the turning-axis of door-latch 200 (this distance is output moment arm) shorter than the distance of the lower-mounting-site 554 to the pivot-axle 556 at the lower actuator (this distance is input moment arm).

Usually, the shorter output moment arm occurs when the upper-mounting-site 352 is between handle-mount 380 and the turning-axis of door-latch 200 as shown in FIG. 10. With a shorter output moment arm, the handle of door-latch 200 will turn more than the rotation of inner foot-pad 550 at the lower actuator for an effective unlatching.

This is similar to the effect in a planar quadrilateral linkage in convex with no two links crossing over each other, and all four internal angles are less than 180 degrees. Planar quadrilateral linkage is a form of classical four-bar closed-chain linkage with four links connected in a loop by 4 rotating joints. A first link is fixed as ground link (also known as the frame), then two links connected to frame are the crank (as input link), and the rocker (as output link), and the last link is floating, also called coupler which connects the other end of crank (input) and rocker (output). Input rotational movement at crank, through the coupler will cause output rotational movement at rocker.

The crank and the rocker will rotate the same amount of angular displacement if they are of equal lengths. However, if the rocker is shorter than the crank, then the rocker as output will rotate a bigger angle than the crank because both rocker and crank joints at coupler will travel the same arc length. For same arc length, when radius of arc decreases, the angle of arc increases.

The analogy of the embodiment in engaged mode to the planar quadrilateral linkage is as following:

a. distance of upper-mounting-site 352 to turning axis of door-latch 200 (output moment arm) is the shorter rocker link;
b. distance of lower-mounting-site 554 to pivot-axle 556 at lower actuator (input moment arm) is the crank link;
c. Link 400 is the coupler;
d. Turning-axis of door-latch 200 and the pivot-axle 556 at lower actuator are the two ends of the frame (or ground link).

Figure 11:
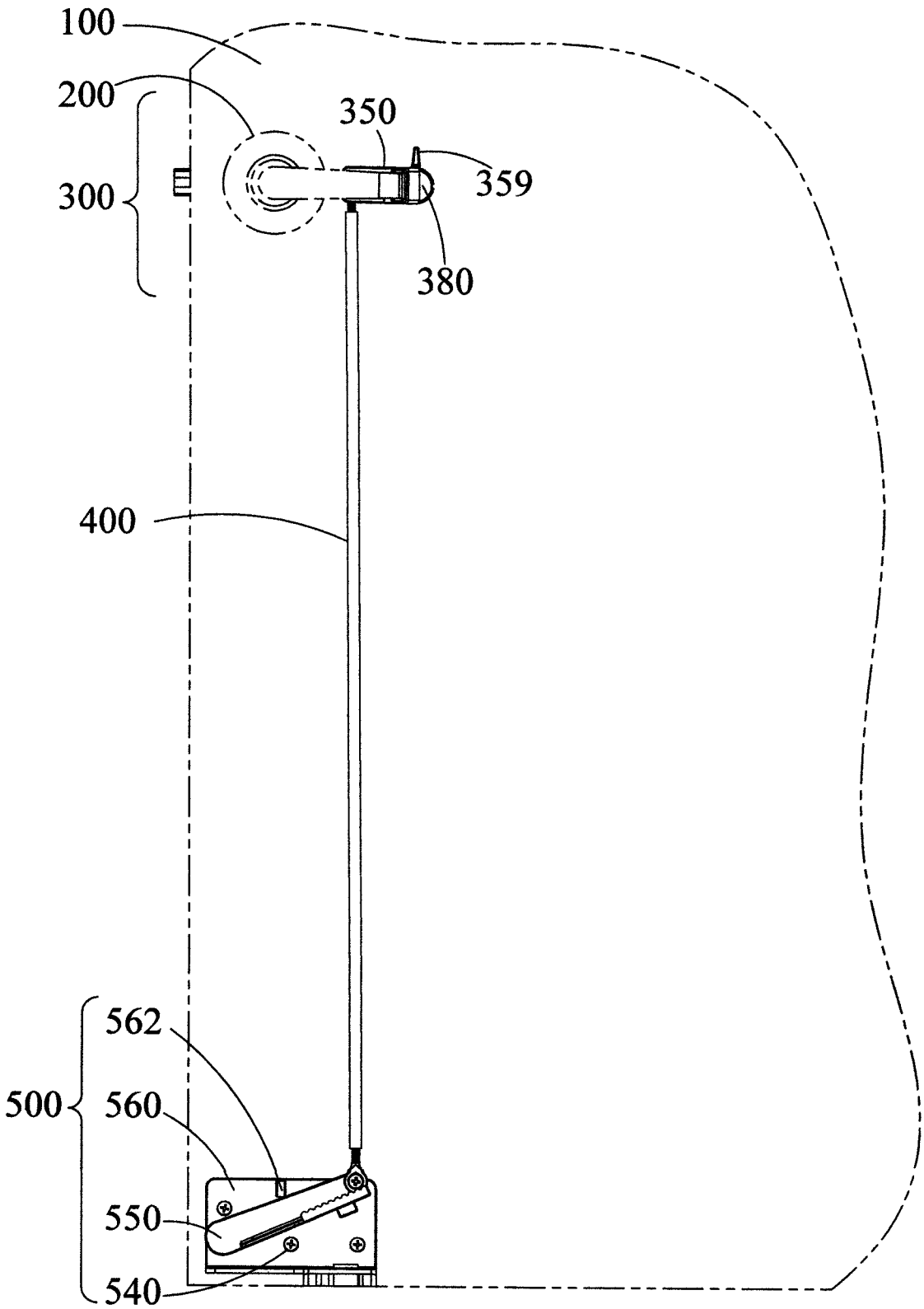
FIG. 11 is a front view of embodiment according to FIG. 2 in engaged mode with door in latched condition, viewed towards inside surface of door. Engaged mode is when embodiment allows foot or hand to unlatch the door.

FIG. 11 is a front view of embodiment as assembled in FIG. 2 which is in engaged mode, with door in latched condition, viewed towards inside surface of door. With no external force applied, the door-latch 200 with its neutral handle position pulls the link 400 up due to the stop 358 and engage-direction-stop 388 are touching to urge force on each other as shown in on FIG. 10. The rotational movement of the inner foot-pad 550 is limited by the travel-stop 562 at the inner mounting-plate 560.

Figure 12:
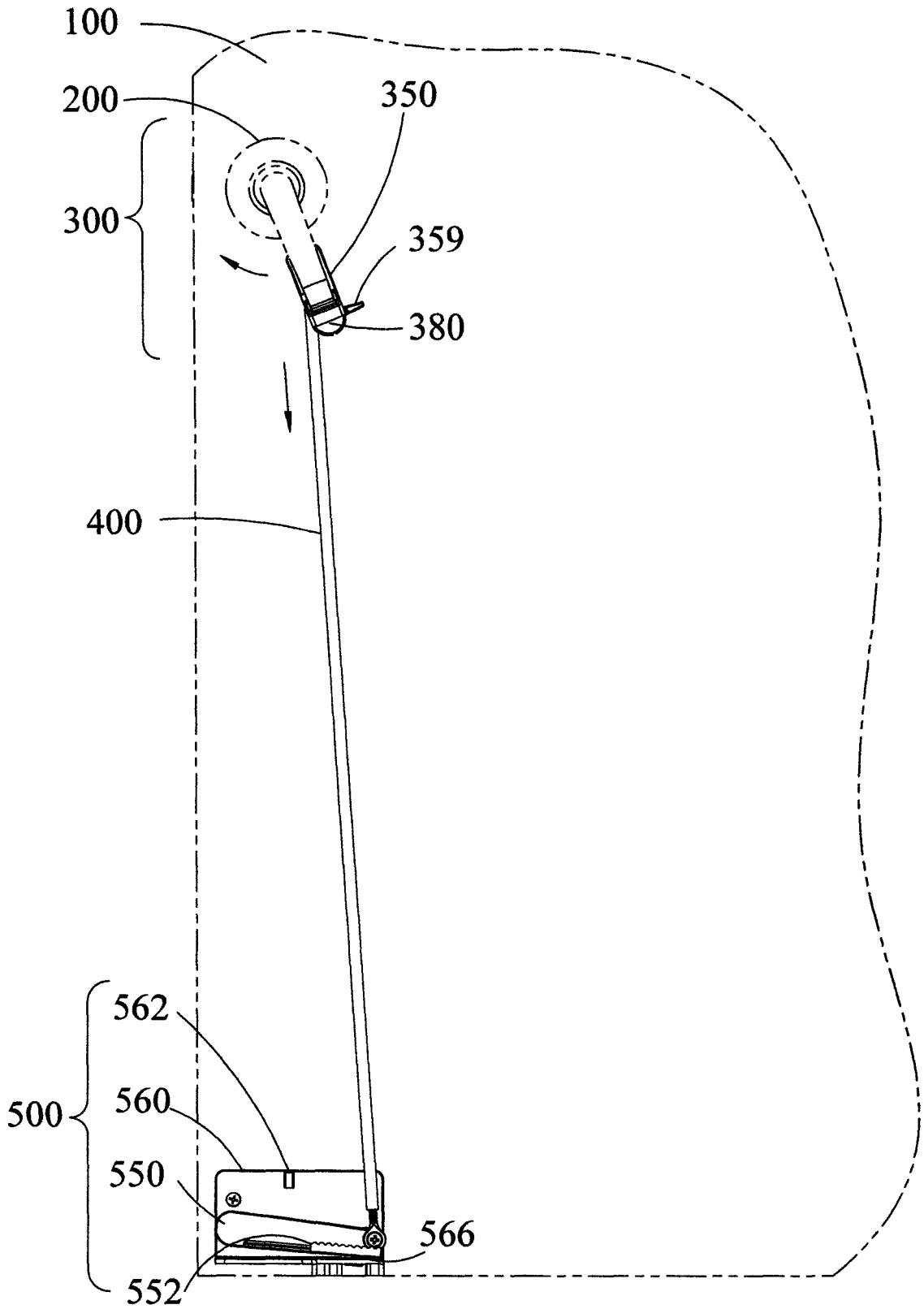
FIG. 12 is a front view of embodiment according to FIG. 2 in engaged mode with door in unlatched condition, viewed towards inside surface of door.

FIG. 12 is a front view of embodiment as assembled in FIG. 2 which is in engaged mode, but also with force applied by foot to either the inner foot-pad 550 or outer foot-pad 570 which is door in unlatched condition. A user applies force on the foot-placement-area 552 (at either inner or outer foot-pad) by foot wearing a shoe to rotate the inner foot-pad 550 which moves the link 400 downward and rotates the lever-arm 350 to urge the handle-mount 380 and the door-latch 200 to rotate together for unlatching the door. And the door can be pulled back to open with same foot on foot-placement-area 552. The handle of door-latch can be turned by hand in the engaged position to unlatch door too.

Figure 13:
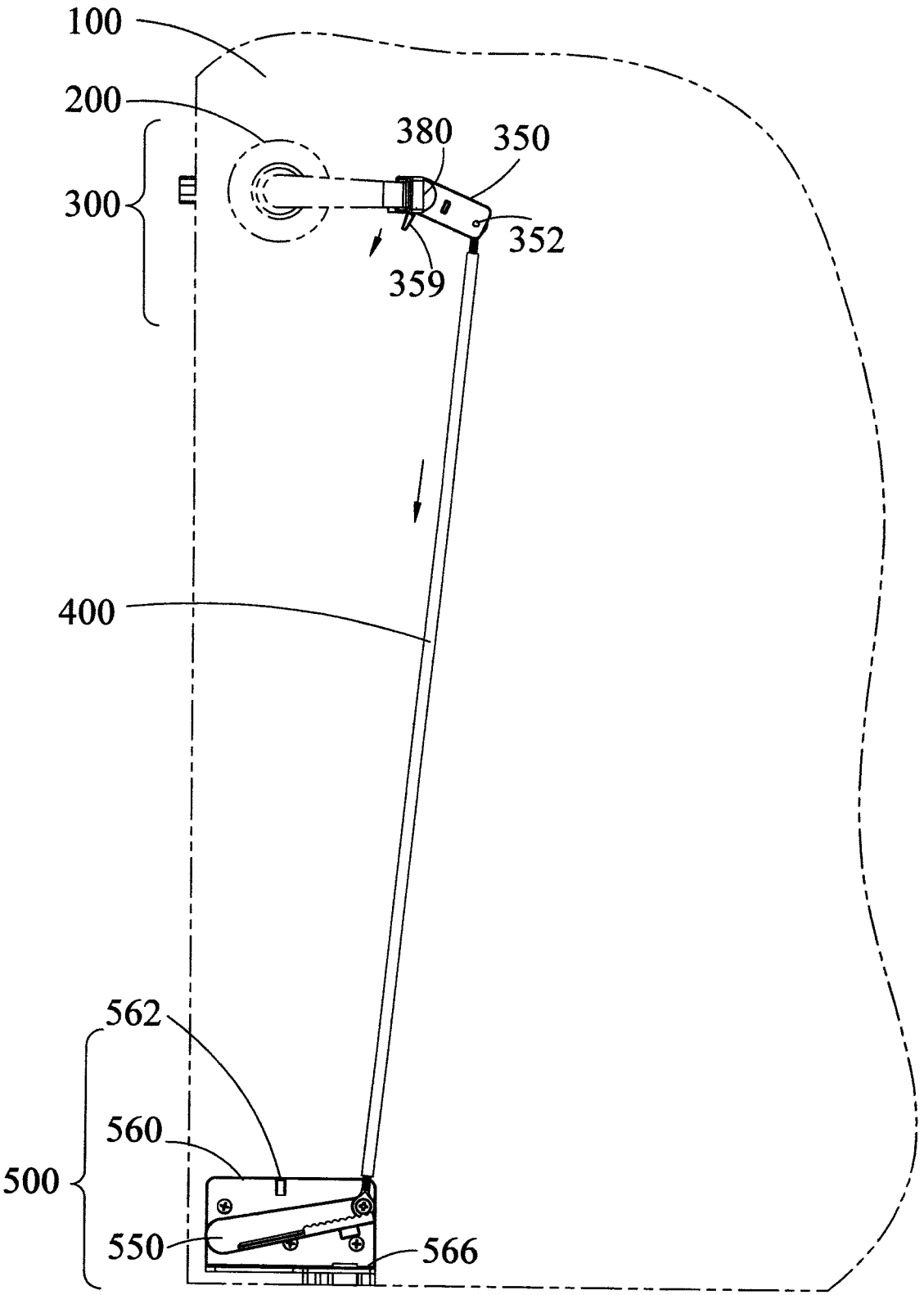
FIG. 13 is a front view of embodiment according to FIG. 2 in disengaged mode with door in latched condition, viewed towards inside surface of door. Disengaged mode is when embodiment disallow foot to unlatch the door.

FIG. 13 is a front view of embodiment as assembled in FIG. 2 in disengaged mode, with door in latched condition, viewed towards inside surface of door. A user can use the lever-handle 359 and rotate the lever-arm 350 with the stop 358 around the handle-mount 380 so that the upper-mounting-site 352 is further away from the turning axis of the door-latch 200. Usually it is when the handle-mount 380 is between the upper-mounting-site 352 and the turning axis of the door-latch 200 as shown. In this disengaged mode position, the distance between the upper-mounting-site 352 to the door-latch turning-axis (this distance is output-moment-arm) is increased and the stop 358 is away from the engage-direction-stop 388 at handle-mount 380, and cannot urge force on each other. The rotational movement of the inner foot-pad 550 at the lower actuator 500, through the link 400, can only turn the lever-arm 350 around the handle-mount 380 without affecting the door-latch 200, or until the lever-handle 359 touches the handle-mount 380 as shown. Then it still cannot urge the handle-mount 380 or the handle at the door-latch 200 to rotate far enough for unlatching the door because the increased output-moment arm at upper actuator 300 will turn a smaller angle with the same rotation of the inner foot-pad 550 at the lower actuator 500 having unchanged distance from the lower-mounting-site 554 to the pivot-axle 556 (this distance is input moment arm). This is a planar quadrilateral linkage as used in describing the engaged mode with FIG. 10, but with a longer rocker than the crank, and the output is a smaller degree of rotation than input.

The analogy of the embodiment in disengaged mode to the planar quadrilateral linkage is as following:

a. distance of upper-mounting-site 352 to turning axis of door-latch 200 (output moment arm) is the longer rocker link;
b. distance of lower-mounting-site 554 to pivot-axle 556 at lower actuator (input moment arm) is the crank link;
c. link 400 is the coupler;
d. turning axis of door-latch 200 and the pivot-axle 556 at lower actuator are the two ends of the frame (or ground link).

In some embodiments, in the disengaged mode the foot-pad 550 can rest on the pad-stop 566 so that the handle-mount does not move.

In some embodiments, the handle-mount does not move in the disengaged mode.

In other embodiments, the handle-mount may move but move insufficiently for unlatching the door-latch in the disengaged mode.

Only hand can be used to unlatch the door in this disengaged mode, and the door-latch 200 can be locked to prevent entry from outside as the pivoted-footpads are not effective.

For security and cosmetics reasons, it is important that the device can be controlled from the inside (or secured side) of door to an engaged mode which allows unlatching of door by foot, or in disengaged mode to disallow unlatching door by foot for controlling outside entry by hand or foot, especially in a controlled area such as a secured laboratory with an automated-always-latched-door which only allow hand to unlatch from inside. A foot-operated door-unlatching device which is disclosed in embodiment according to FIG. 2 meets the requirement of being able to set or configure the door-unlatching device to an engaged mode for unlatching of the door-latch by foot from both sides of the door, and also easily switching back to a disengaged mode for security where actuation of the foot-pad of the door-unlatching device does not unlatch the door.

Said another way, FIGS. 11 and 12 show a first position of the link 400 relative to the handle-mount 380, where the actuation of the inner foot-pad 550 or the outer foot-pad 570 can move the lever-arm 350 and the handle-mount 380 to unlatch the door-latch 200. FIG. 13 shows a second position of the link 400 relative to the handle-mount 380 where the actuation of the inner foot-pad 550 or the outer foot-pad 570 cannot move the handle-mount or far enough to unlatch the door-latch 200.

In a first position of the lever-arm 350 relative to the handle-mount 380, actuation of the inner foot-pad 550 or the outer foot-pad 570 moves the lever-arm 350 and the handle-mount 380. In doing so, the actuation of the inner foot-pad 550 may be sufficient to effect unlatching the door-latch 200 by movement of the handle-mount 380 and handle of door-latch 200.

Taking a vertical axis through where the handle-mount 380 is coupled to the lever-arm 350, it can be understood that the vertical axis divides a first and a second half-disk regions on opposed sides of the vertical axis when viewed from the front view. In the first position of the lever-arm 350 in FIGS. 11 and 12, it can be understood that the upper-mounting-site 352 of the lever-arm 350 where the link 400 is coupled to the lever-arm 350 is in the first half-disk region on one side of the vertical axis. In this configuration, the device is shown in engaged mode which is when the lever-arm 350 rotates around handle-mount 380 until the stop 358 rests on the engage-direction-stop 388.

In the second position of the lever-arm 350 in FIGS. 13, it can be understood that the upper-mounting-site 352 of the lever-arm 350 where the link 400 is coupled to the lever-arm 350 is in the second half-disk region on the other side of the vertical axis. In this configuration, the stop 358 is separated from the engage-direction-stop 388. In a second position of the lever-arm 350 relative to the handle-mount 380, actuation of the inner foot-pad 550 or the outer foot-pad 570 is isolated from moving the handle-mount 380.

In alternative embodiments, in the second position of the lever-arm, the lever-arm 350 may be positioned such that actuation of the foot-pad 550 or 570 does not result in movement of the handle-mount 380 sufficient to unlatch the door-latch 200. Said another way, in some embodiments, actuation of the foot-pad 550 or 570 may result in partial movement of the handle-mount 380 but only to an amount insufficient to unlatch the door-latch 200.

Figure 14:
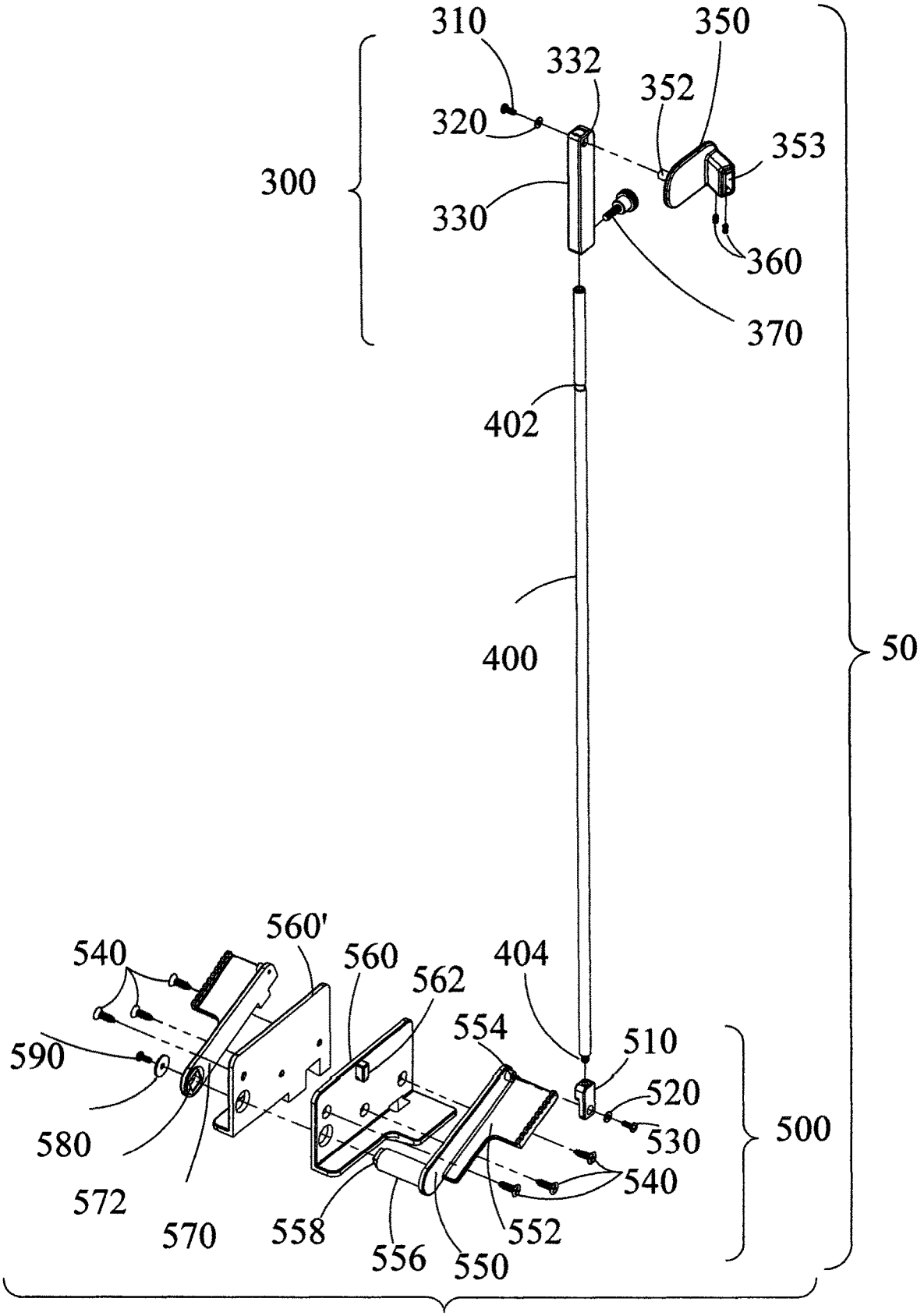
FIG. 14 is an exploded perspective view of an illustrative embodiment using a thumb-screw to connect or disconnect the upper actuator to the lower actuator.

FIG. 14 is another embodiment of the door-unlatching device 50 showing the element-for-link 370 (a thumb-screw in this configuration) is used to engage or disengage the upper actuator 300 and the lower actuator 500. The lower actuator 500 components are similar to those used in FIG. 2, but with a custom-made-lower-swivel-joint which is secured to the lower-mounting-site 554 (a short post with threaded hole in this configuration) at the lower actuator 500 by a screw 530 and a washer 520. The link 400 has external threaded lower end 404 which is attached to the custom-made lower-swivel-joint 510. The major different features are at the upper actuator 300 where the lever-arm 350 has a built-in hole 353 for attaching the handle of door-latch 200 with two set screw 360. A long upper-swivel-joint 330 is attached to the upper-mounting-site 352 (another short post with threaded hole in this configuration) at the lever-arm 350 by a screw 310 and a washer 320. The link 400 with a circumferential-groove 402 is secured inside a hole at the long upper-swivel-joint 330. The element-for-link 370 (thumb-screw) at the long upper-swivel-joint 330 is turned to secure the circumferential-groove 402 at link 400 for connecting upper and lower actuators in engaged mode to allow foot-operated door-unlatching. The element-for-link 370 can also be slackened to allow link 440 free-sliding inside the long upper-swivel-joint 330 which disconnects the upper and the lower actuators in disengaged mode to only allow hand-operated door-unlatching, with upper end of link 440 is still inside the hole at the long upper-swivel-joint 330 without separating from it.

Figure 15:
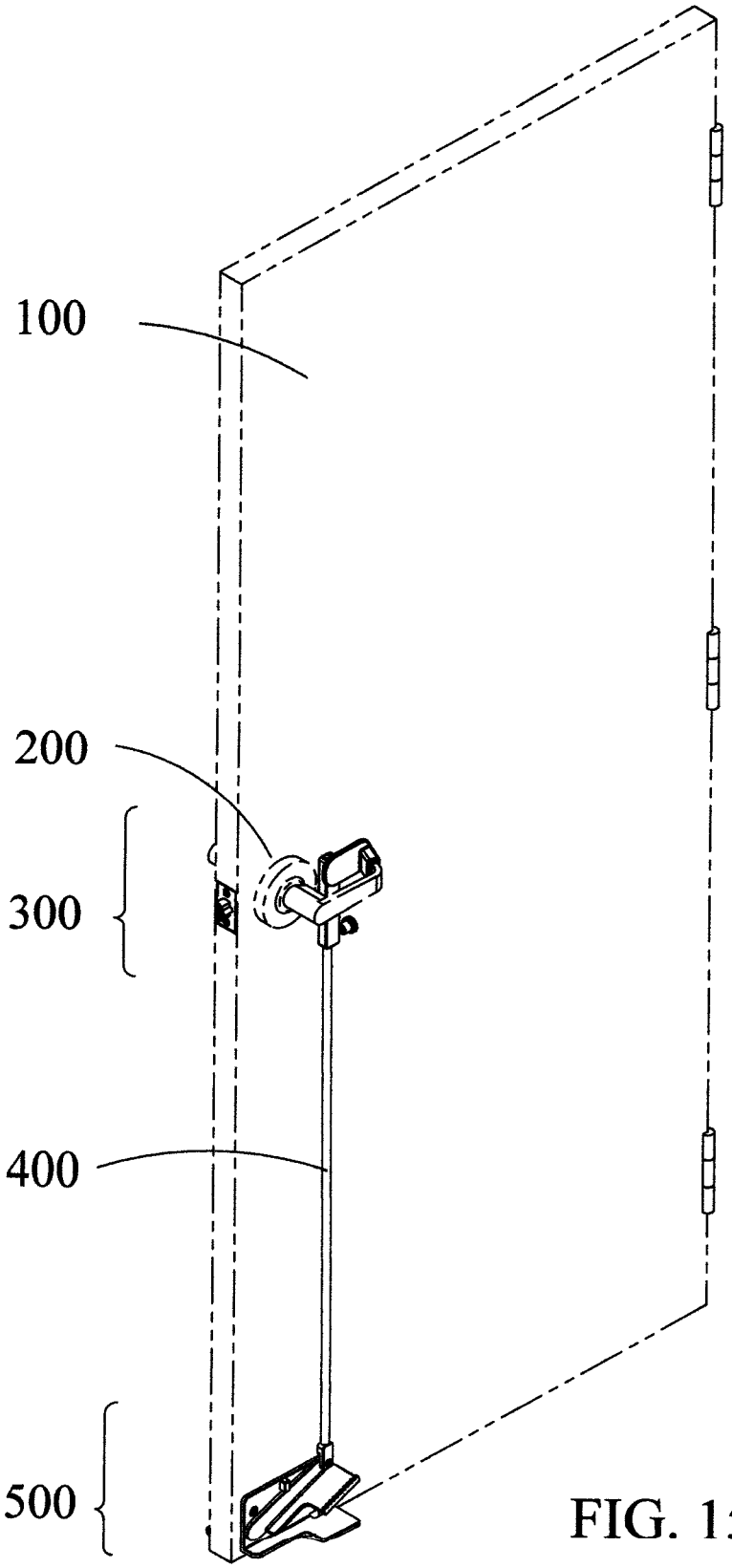
FIG. 15 is a perspective view of the embodiment according to FIG. 14, as installed in a door, in engaged mode with door in latched condition.

FIG. 15 is a perspective view of the illustrative embodiment according to FIG. 14 after all parts are put together to form the upper actuator 300 and the lower actuator 500 which are connected by the link 400; and installed in a hinged door having a door-latch with handle. The figure shows configuration in engaged mode with door in latched position.

Figure 16:
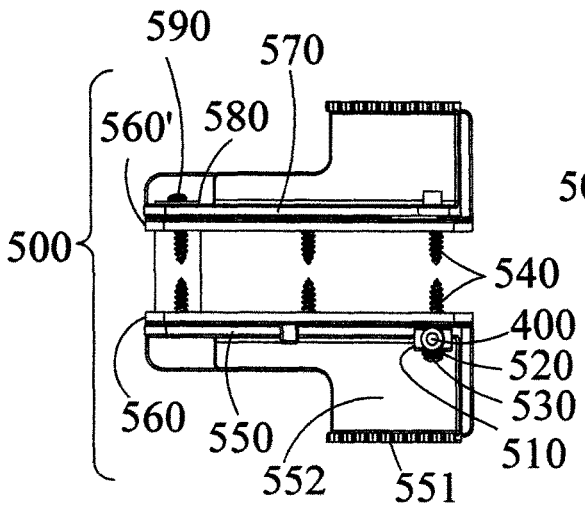
FIG. 16 is a top view of lower actuator and link in the embodiment according to FIG. 15.

FIG. 16 is a top view of lower actuator 500 and link 400 in the embodiment according to FIG. 14.

Figure 17:
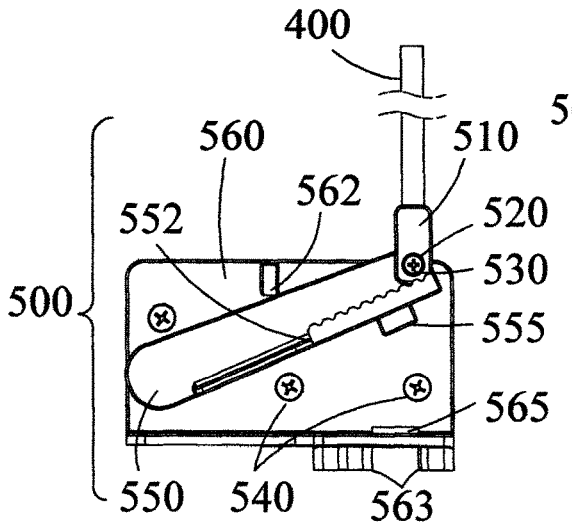
FIG. 17 is a front view of lower actuator and a portion of link in the embodiment according to FIG. 15.

FIG. 17 is a front view of lower actuator 500 and a portion of link 400 in the embodiment according to FIG. 14.

Figure 18:
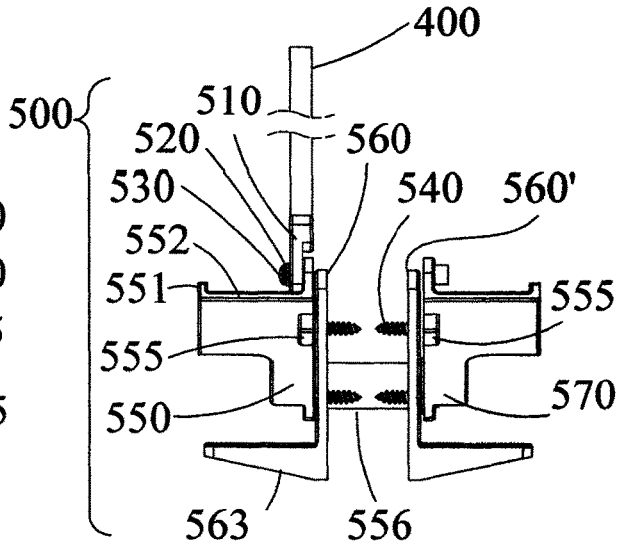
FIG. 18 is a side view of lower actuator and a portion of link in the embodiment according to FIG. 15.

FIG. 18 is a side view of lower actuator 500 and a portion of link 400 in the embodiment according to FIG. 14.

Figure 19:
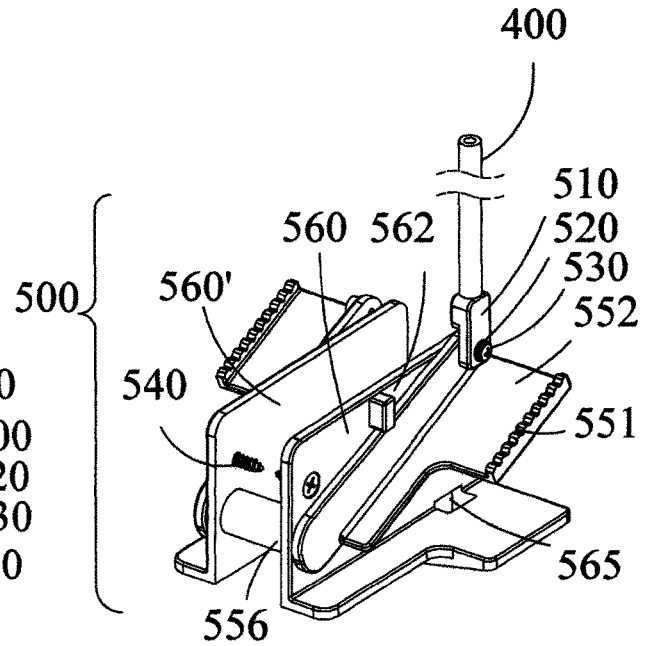
FIG. 19 is a perspective view of lower actuator and a portion of link in the embodiment according to FIG. 15.

FIG. 19 is a perspective view of lower actuator 500 and a portion of link 400 in the embodiment according to FIG. 14.

Figure 20:
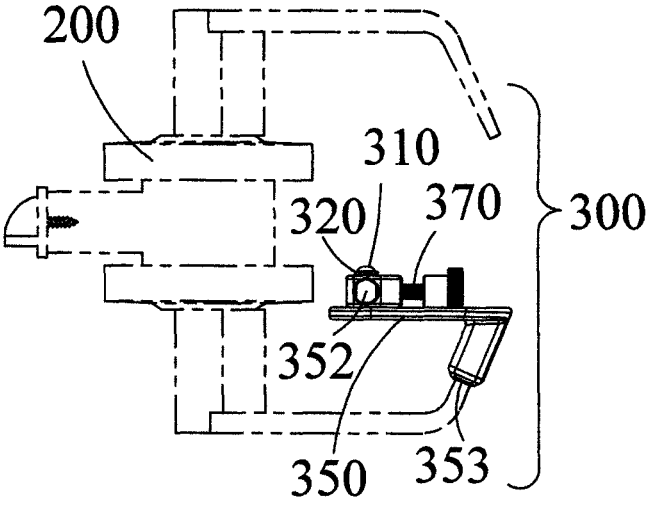
FIG. 20 is a top view of upper actuator and link in the embodiment according to FIG. 15 at engaged mode.

FIG. 20 is a top view of the upper actuator 300 with the link 400 as assembled with parts in FIG. 14. The handle of door-latch 200 fits inside the hole 353 at the lever-arm 350, and is secured by two set screws at the lever-arm 350 from below.

Figure 21:
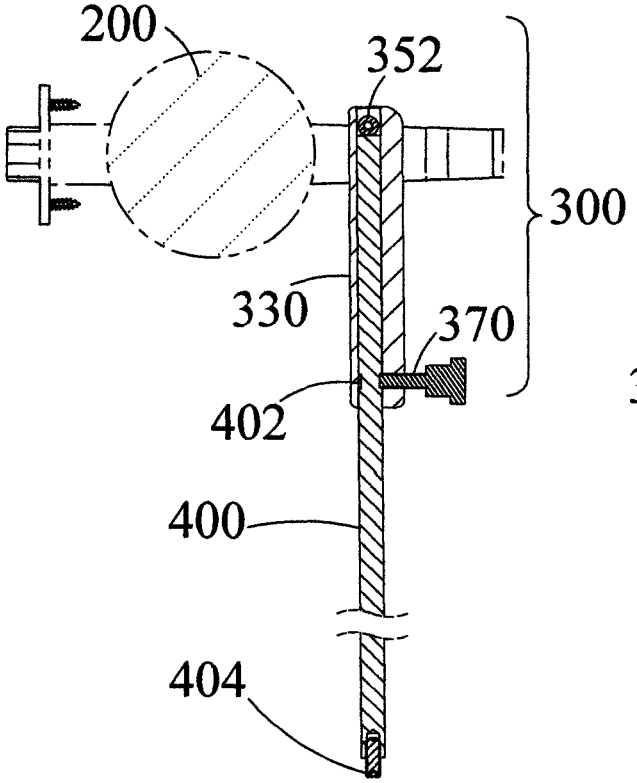
FIG. 21 is a sectional front view of upper actuator and a portion of link in the embodiment according to FIG. 15.
Figure 22:
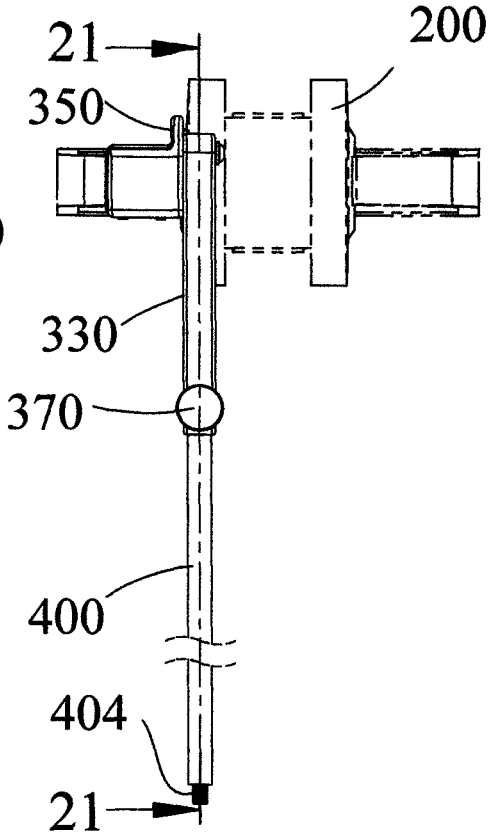
FIG. 22 is a side view of upper actuator and a portion of link in the embodiment according to FIG. 15.

FIG. 21 is sectional front view of the upper actuator 300 with a portion of link 400. The link 400 slides inside a hole at the long upper-swivel-joint 330 and stops at upper-mounting-site 352, then the element-for-link 370 (thumb-screw) at the long upper-swivel-joint 330 is turned to secure the circumferential-groove 402 at the link 400 for connecting the upper and the lower actuators in engaged mode to allow foot-operated door-unlatching;

FIG. 22 is a side view of upper actuator 300 and a portion of link 400 in the embodiment according to FIG. 14.

Figure 23:
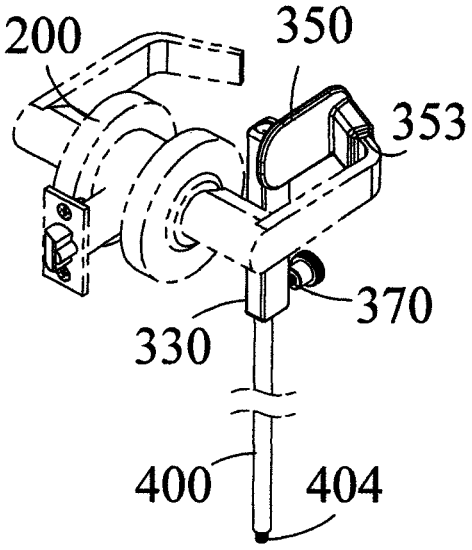
FIG. 23 is a perspective view of upper actuator and a portion of link in the embodiment according to FIG. 15.

FIG. 23 is a perspective view of upper actuator 300 and a portion of link 400 in the embodiment according to FIG. 14.

Figure 24:
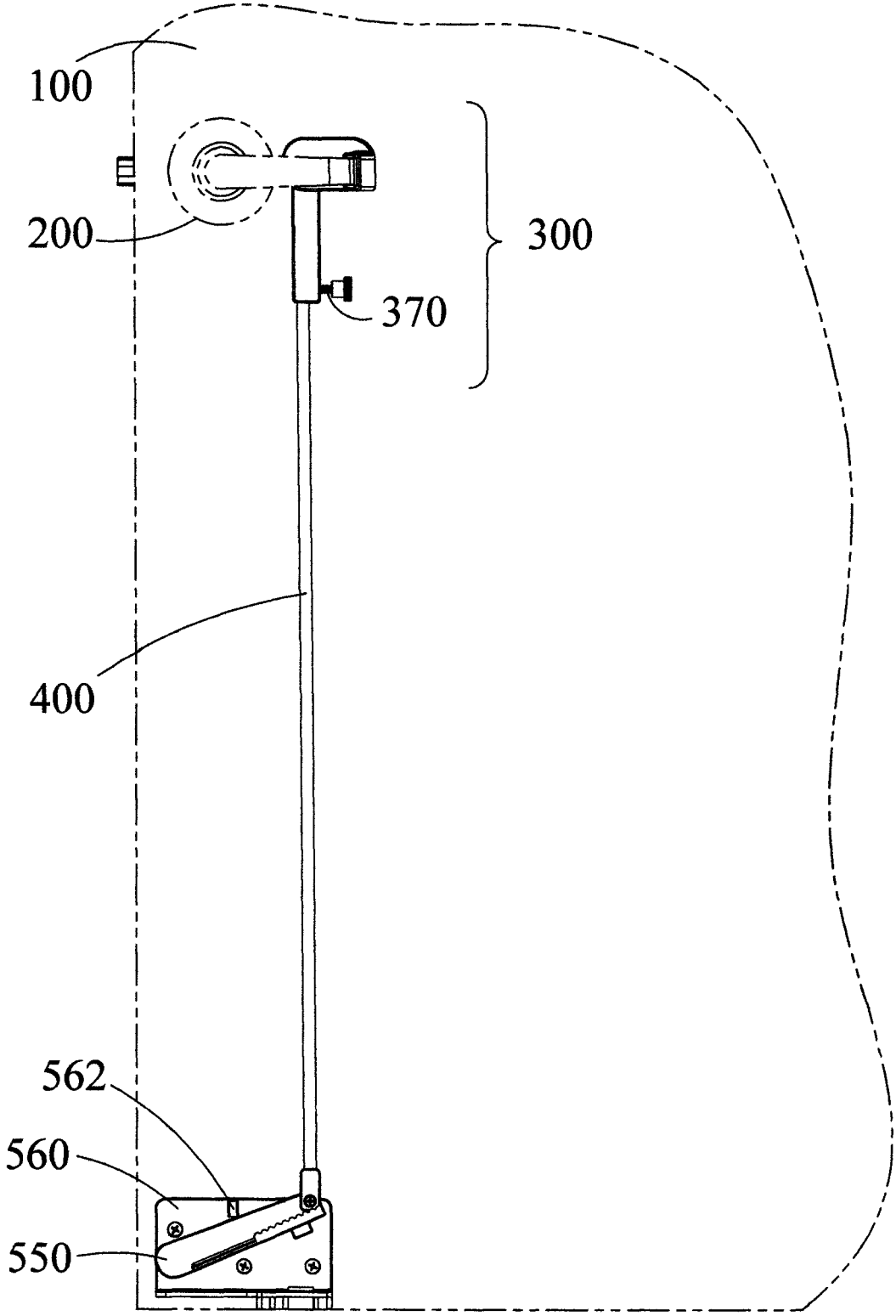
FIG. 24 is a front view of the embodiment according to FIG. 15, in engaged mode with door in latched condition, viewed towards inside surface of door.

FIG. 24 is a front view of the embodiment according to FIG. 14 with element-for-link 370 tightened as described in FIG. 21, in engaged mode with door in latched condition with no external force applied, viewed towards inside surface of door.

Figure 25:
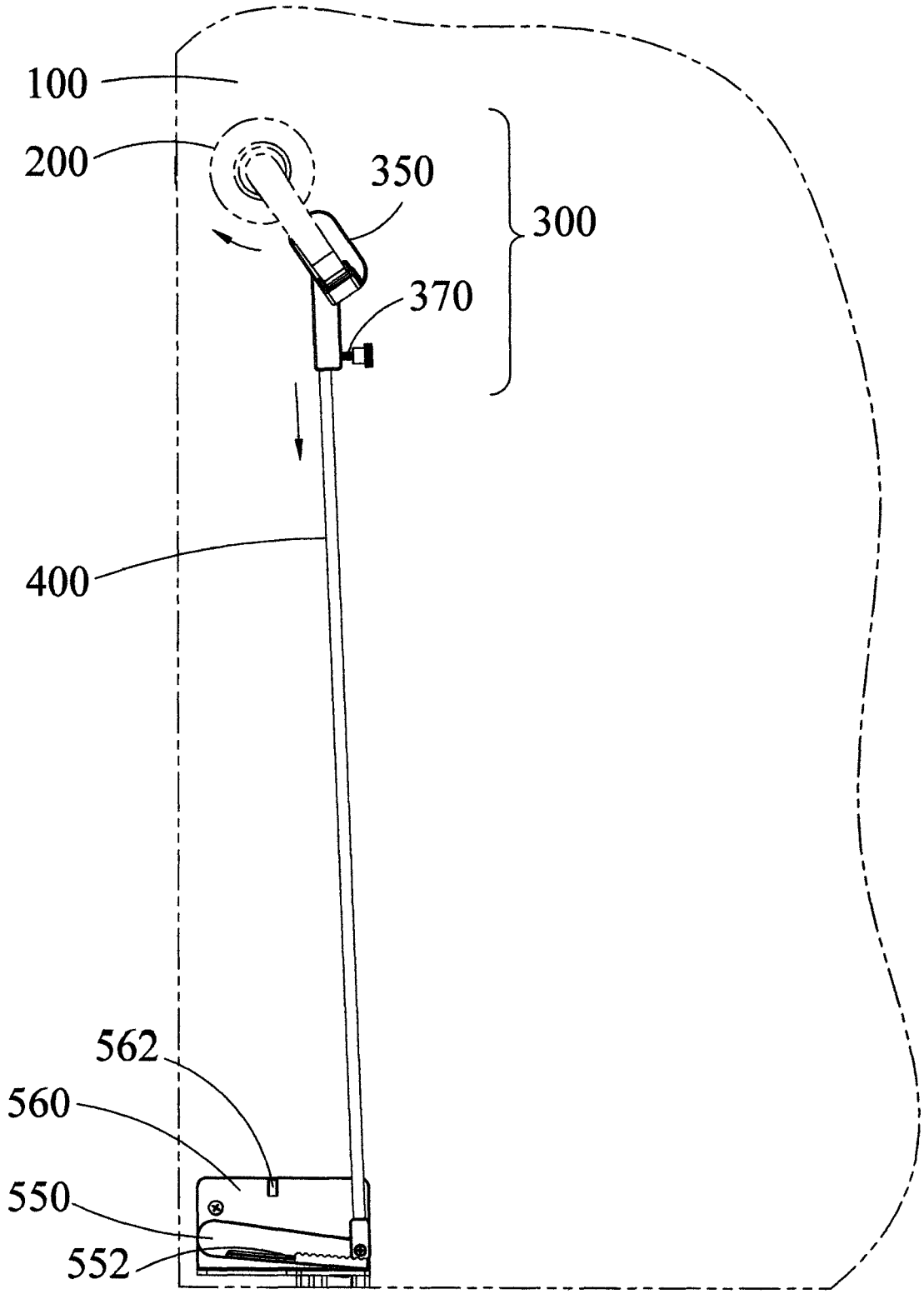
FIG. 25 is a front view of the embodiment according to FIG. 15, in engaged mode with door unlatched, viewed towards inside surface of door.

FIG. 25 is a front view of the embodiment according to FIG. 14 in engaged mode with door in unlatched condition when the user applies force on the foot-placement-area 552 (at either inner or outer-footpad) by foot wearing a shoe to rotate the inner foot-pad 550. The downward movement of the link 400 rotates the lever-arm 350 with the door-latch 200 for foot-operated door-unlatching. And the door can be pulled back to open with same foot on foot-placement-area 552. The door-latch can be turned by hand in this engaged position too.

Figure 26:
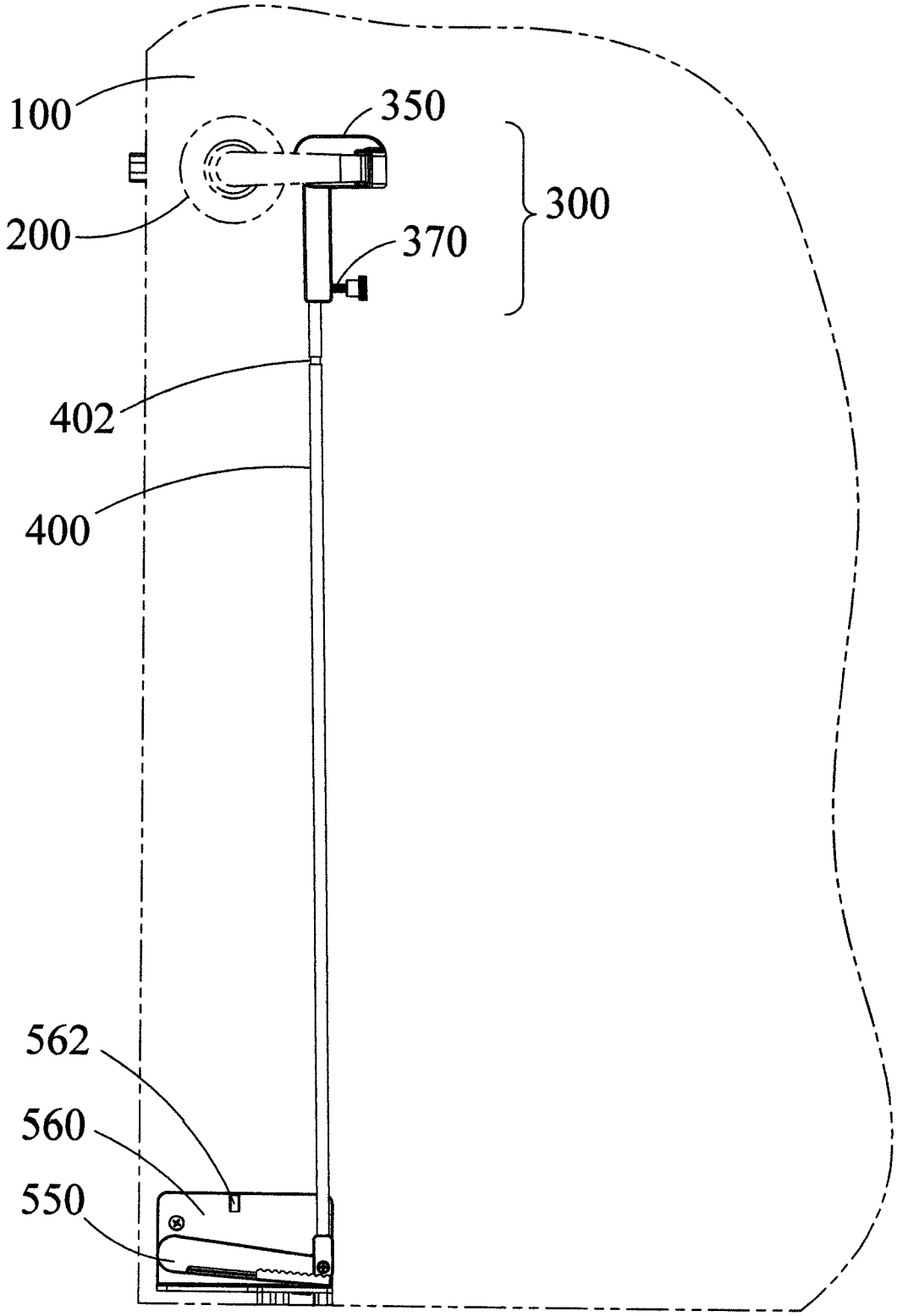
FIG. 26 is a front view of the embodiment according to FIG. 15, in disengaged mode with door in latched condition, viewed towards inside surface of door.

FIG. 26 is a front view of embodiment according to FIG. 14 in disengaged mode with door in latched condition, viewed towards inside surface of door. The element-for-link 370 (thumb-screw) is slackened to allow the link 400 to free-sliding inside the long upper-swivel-joint-330 and disconnects the lower actuator 500 movement to the upper actuator 300. Now only a hand can be used to unlatch the door, and the door-latch 200 can be locked to prevent entry from outside as the pivoted-footpads are not effective.

Figure 27:
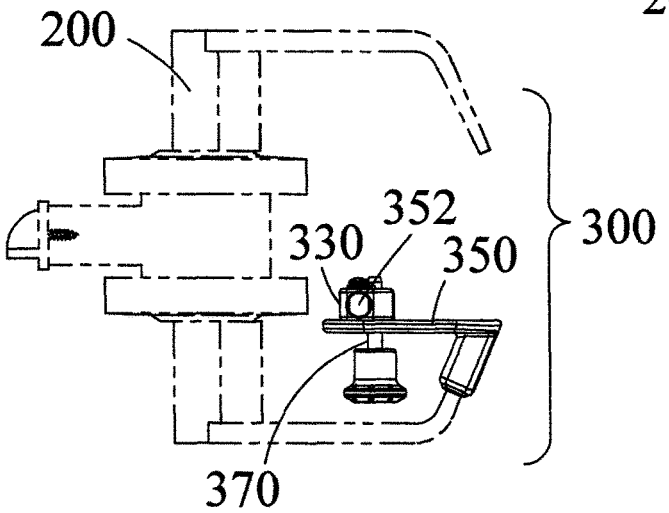
FIG. 27 is a top view of an upper actuator and link in an illustrative embodiment using a quick-release pin to connect or disconnect the upper actuator to lower actuator.
Figure 30:
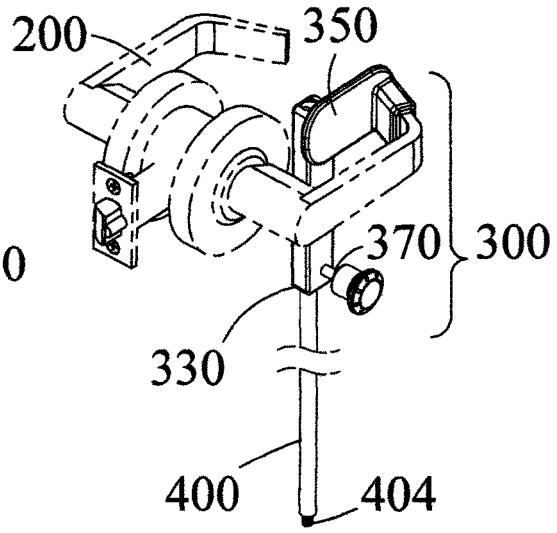
FIG. 30 is a perspective view of embodiment according to FIG. 27.
Figure 28:
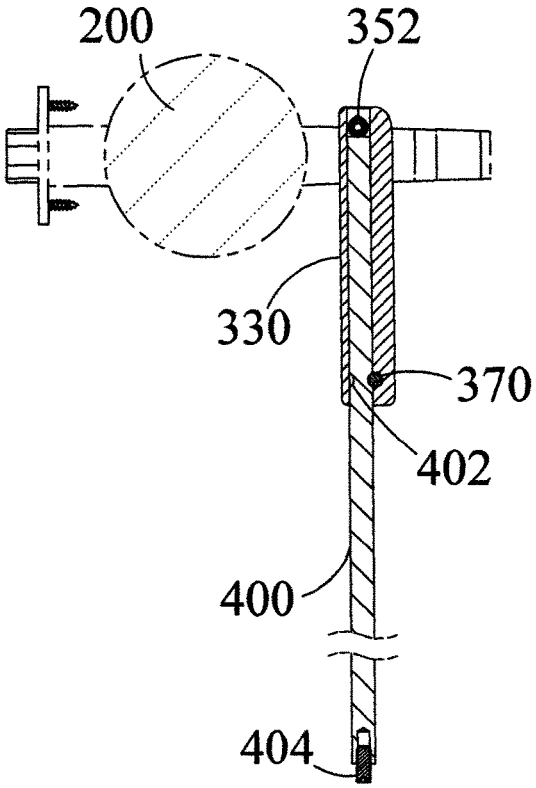
FIG. 28 is a sectional front view of embodiment according to FIG. 27.
Figure 29:
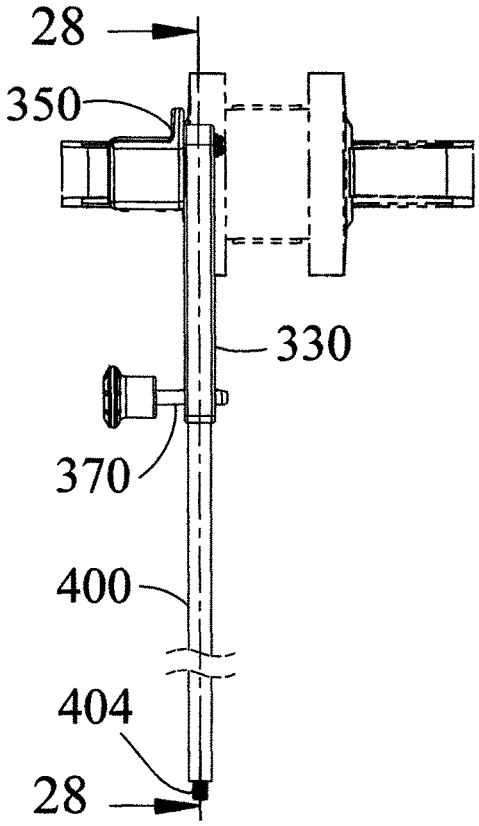
FIG. 29 is a side view of embodiment according to FIG. 27.

Another embodiment of the upper actuator 300 with the link 400 is shown on FIG. 27, a top view; FIG. 28, a sectional front view, FIG. 29, a side view and FIG. 30, a perspective view. Most parts of this embodiment are similar to the earlier embodiment disclosed with FIG. 14 except the element-for-link 370 is a quick-release pin at the long-body-swivel-joint 330 (with round hole to fit the quick-release pin) as shown on FIG. 28. The quick-release pin secures a circular-shape circumferential-groove 402 at the link 400 for connecting the upper and the lower actuators in engaged mode to allow foot-operated door unlatching.

If the element-for-link 370 (quick-release pin) is removed from long-body-swivel-joint 330 to allow the link 400 to free-sliding inside the long upper-swivel-joint 330 and disconnects the upper and the lower actuators, it will be in disengaged mode to only allow hand-operated door-unlatching.

Figure 31:
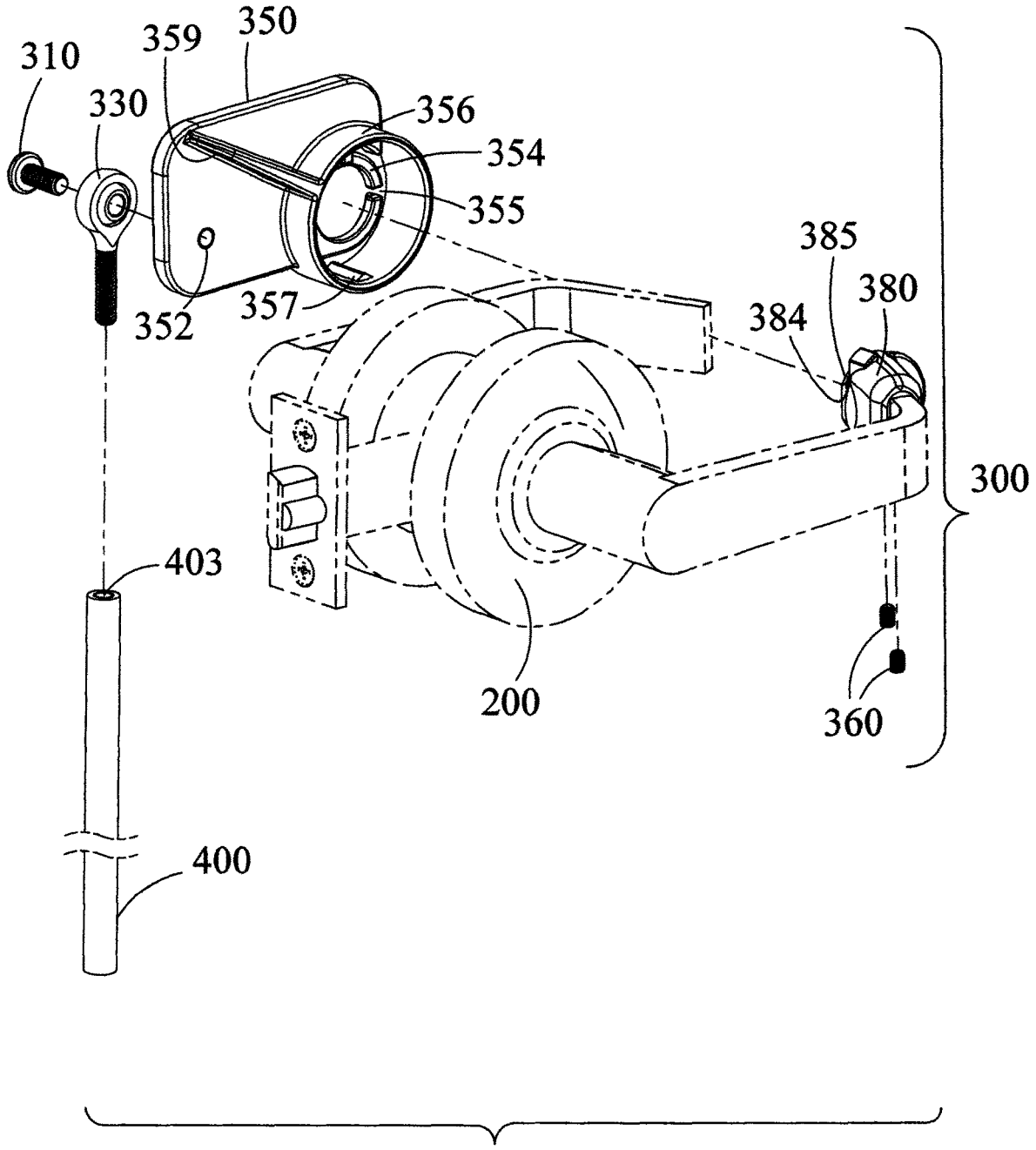
FIG. 31 is a perspective view of upper actuator and a portion of link in an illustrative embodiment with finger guard at lever-arm 350.

FIG. 31 is an exploded perspective view of the upper actuator 300 with a portion of link 400 in another illustrative embodiment similar to configuration shown on FIG. 2 but adding a ring-shaped finger-guard 356 to the lever-arm 350, with new locations of travel limits for controlling rotation of the lever-arm 350, and adding an optional indent 357 to distinguish the feel of rotating the lever-arm 350 towards engage or disengaged mode.

Figure 31A:
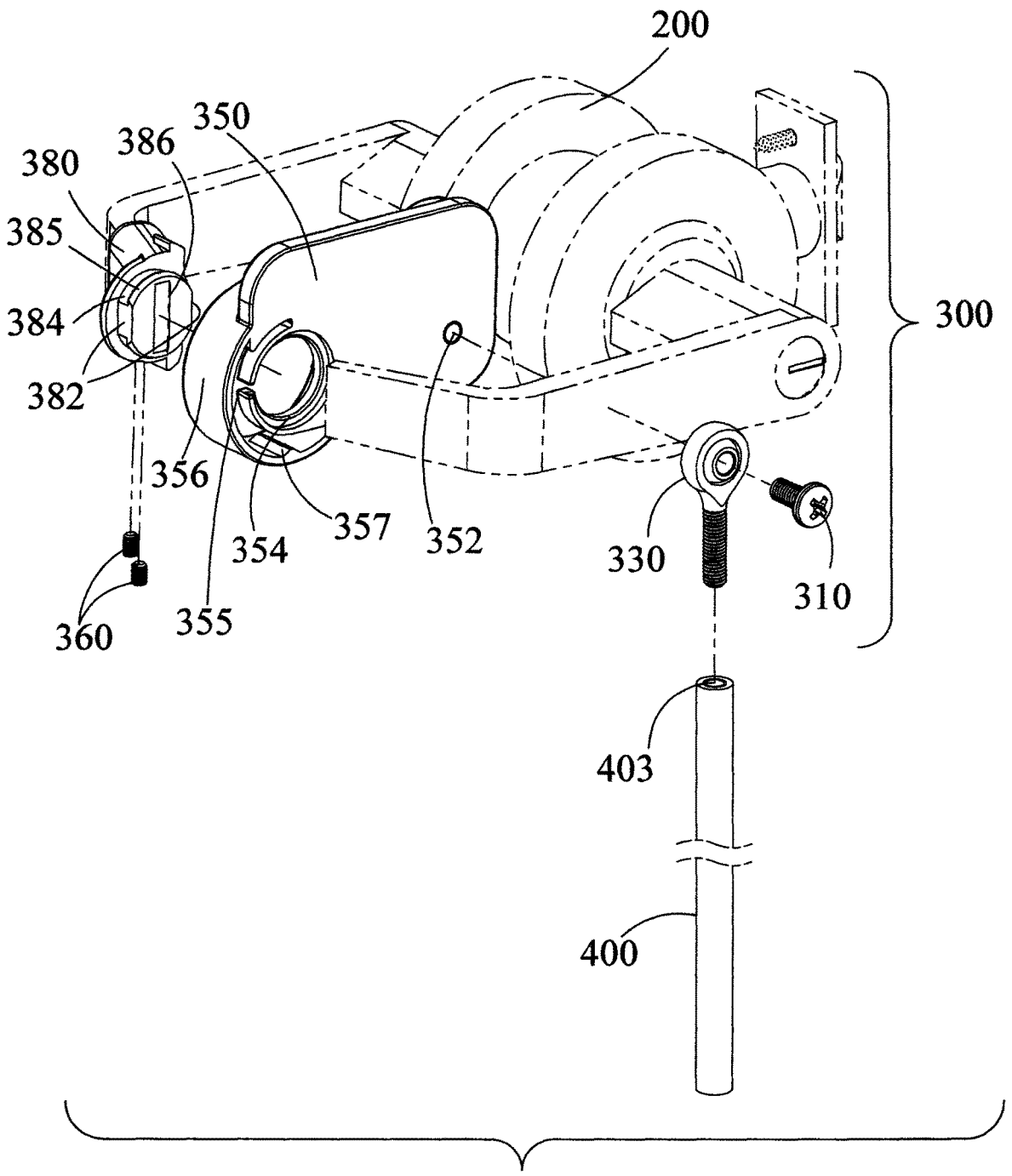
FIG. 31A is another perspective view of upper actuator and a portion of link in the embodiment according to FIG. 31.

FIG. 31A is another exploded perspective view of illustrative embodiment according to FIG. 31 showing more details. The lever-arm 350 has a pivot-hole 354 with a split 355, and the handle-mount 380 has a beveled-edge 385 leading to an undercut-groove 384, and two flat-land 382 to form a snap-fit rotary joint with the lever-arm 350. The upper-swivel-joint 330 is connected to the upper-end 403 of the link 400 and is fastened to the upper-mounting-site 352 (a threaded hole in this embodiment) at the lever-arm 350 by a screw 310. The handle of door-latch 200 is secured inside hole 386 at the handle-mount 380 with two set screws 360 from below.

Figure 32A:
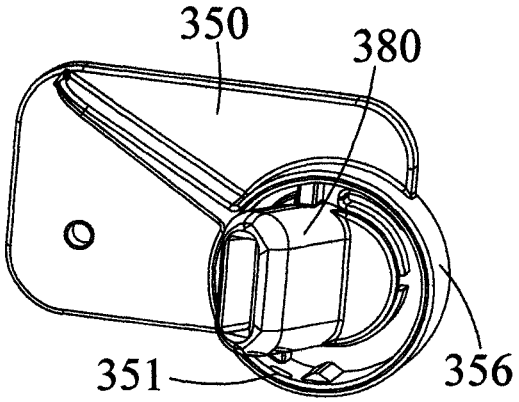
FIG. 32A is a perspective view of lever-arm attached to handle-mount according to FIG. 31.

By pushing the beveled-edge 385 of the handle-mount 380 to pass through the pivot-hole 354 of the lever-arm 350, with deflection at the split 355 at the lever-arm 350 under the assembling force, the undercut-groove 384 will anchor the pivot-hole 354 in place to form a rotating joint as shown on FIG. 32A which is a perspective view of lever-arm 350 attached to handle-mount 380.

Figure 32B:
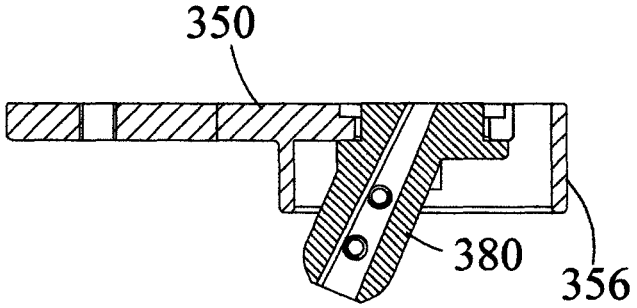
FIG. 32B is a sectional top view of lever-arm attached to handle-mount according to FIG. 31.

It is easier to see the relative position of two parts by examining following figures too:

FIG. 32B is a sectional top view of lever-arm attached to handle-mount according to FIG. 31.

Figure 32C:
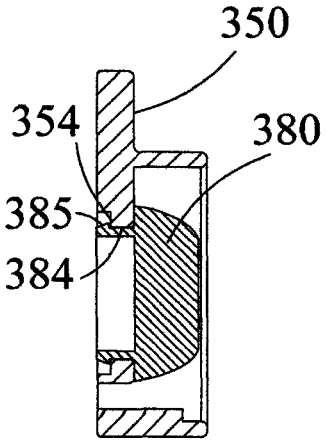
FIG. 32C is a sectional side view of lever-arm attached to handle-mount according to FIG. 31.

FIG. 32C is a sectional side view of lever-arm attached to handle-mount according to FIG. 31.

Figure 32D:
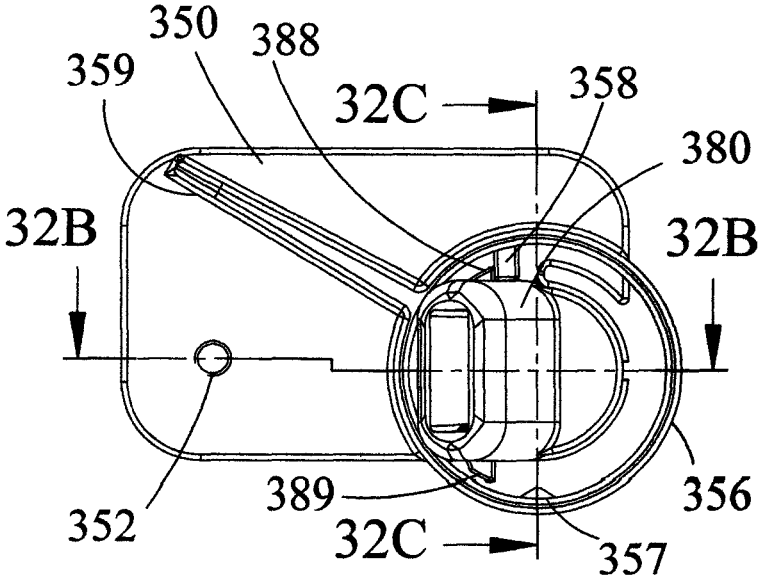
FIG. 32D is a front view of lever-arm attached to handle-mount according to FIG. 31.

FIG. 32D is a front view of lever-arm attached to handle-mount according to FIG. 31.

Figure 32E:
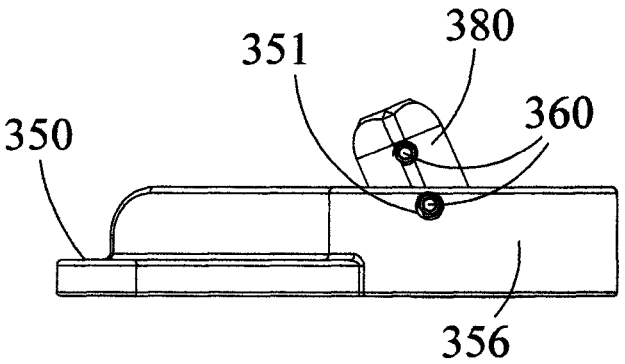
FIG. 32E is a bottom view of lever-arm attached to handle-mount according to FIG. 31.

FIG. 32E is a bottom view of lever-arm attached to handle-mount according to FIG. 31.

Figure 33:
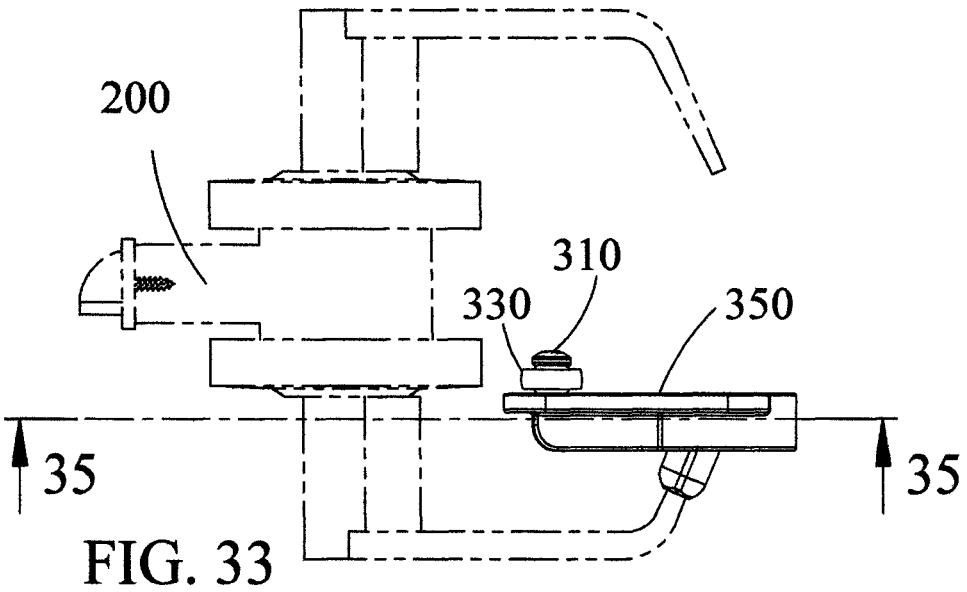
FIG. 33 is a top view of upper actuator and a portion of link in the embodiment according to FIG. 31.
Figure 34:
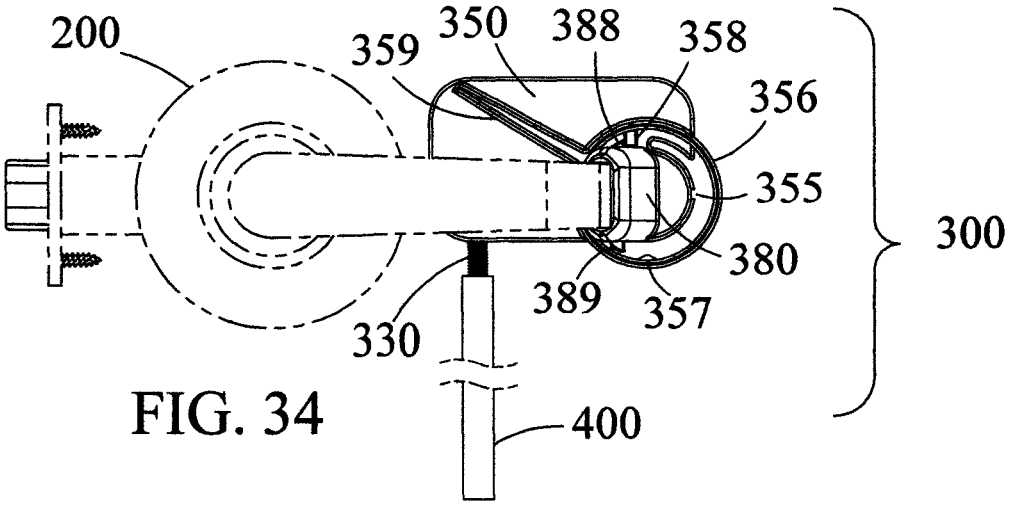
FIG. 34 is a front view of upper actuator and a portion of link in the embodiment according to FIG. 31.
Figure 35:
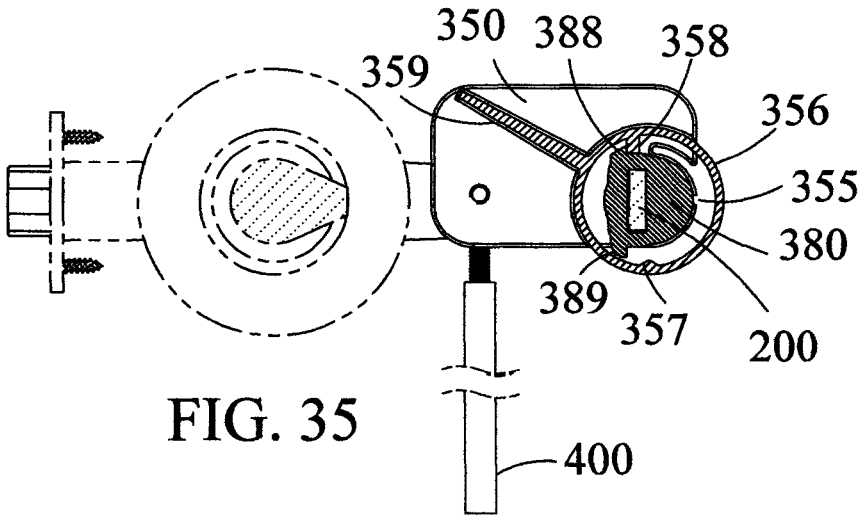
FIG. 35 is a sectional front view of upper actuator and a portion of link in the embodiment according to FIG. 31.

The operation will be understood easier after the parts are assembled together to form the upper actuator 300 and in engage mode, door latched condition as shown on FIG. 33 which is a top view; FIG. 34 which is front view; and FIG. 35 which is a sectional front view.

As on FIG. 34, the lever-arm 350 is rotated around the handle-mount 380 with its built-in stop 358 and stops at the built-in engaged-direction-stop 388 at the handle-mount 380 for an engaged mode as shown in figure, which a user can apply force by foot at the lower actuator 500 to move the link 400 down to turn the lever-arm 350 with the door-latch 200 for unlatching because the stop 358 can urge force on the engaged-direction-stop 388.

Figure 36:
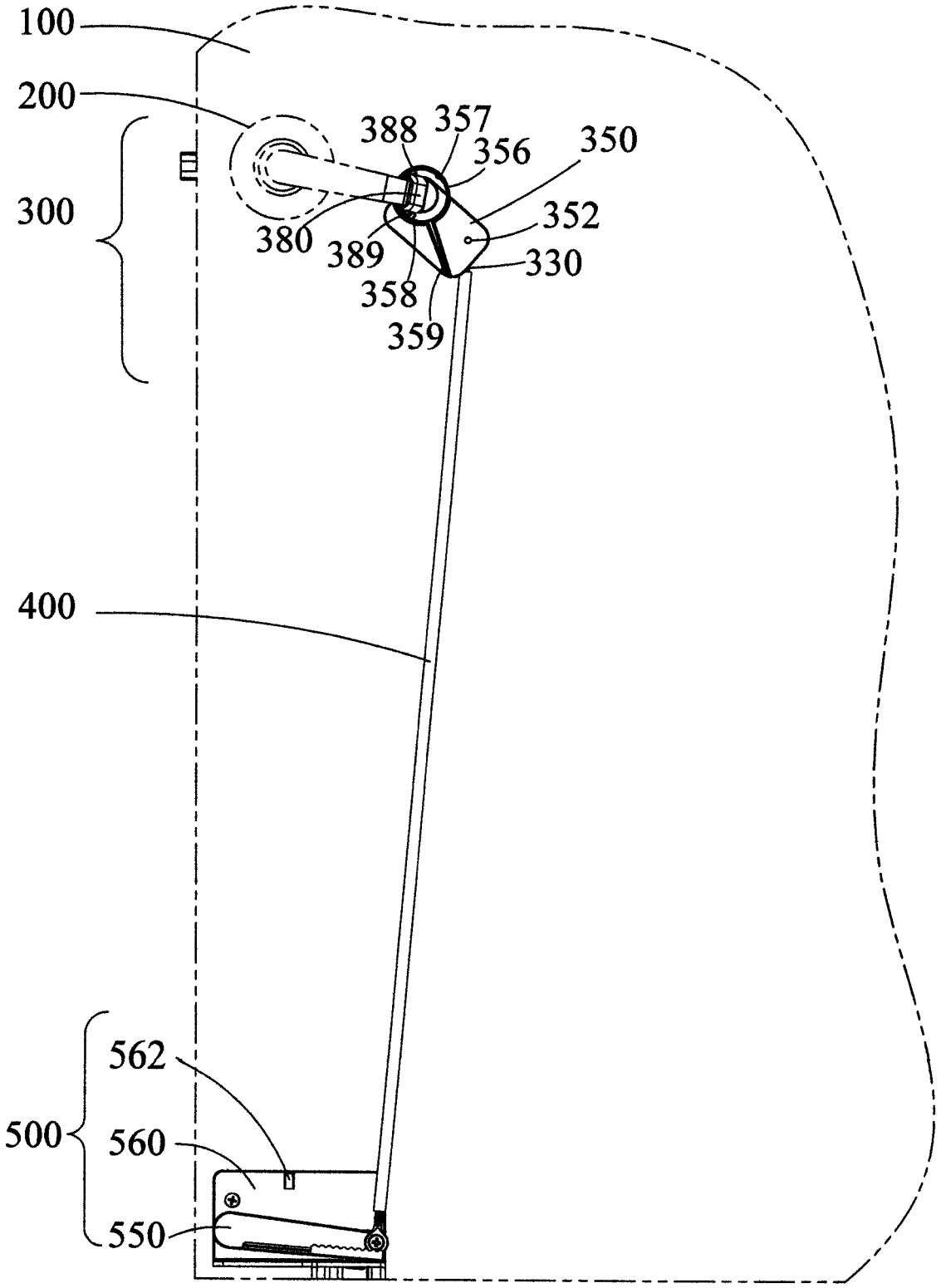
FIG. 36 is a front view of the embodiment according to FIG. 31, in disengaged mode with door in latched condition, viewed towards inside surface of door.

The lever-arm 350 can also be rotated around the handle-mount 380 to other side with its built-in stop 358 not touching anything or with travel limited by the disengaged-direction-stop 389 for a disengaged mode as shown on FIG. 36.

FIG. 36 is the front view of the embodiment according to FIG. 31, in disengaged mode with door in latched condition, viewed towards inside surface of door. Using the lever-handle 359, the lever-arm 350 is rotated around the handle-mount 380 so that upper-mounting-site 352 is further away from turning axis of door-latch 200. Usually it is when the handle-mount 380 is between the upper-mounting-site 352 and the turning-axis of door-latch 200 as shown. In this disengaged mode, the distance between the upper-mounting-site 352 to the door-latch turning-axis (also known as output-moment-arm) is increased. Working principal of this disengaged mode is same as the earlier in another embodiment disclosed with FIG. 13.

The rotational movement of the inner foot-pad 550 at the lower actuator 500, through the link 400, can only turn the lever-arm 350 around the handle-mount 380 without affecting the door-latch 200, or until the stop 358 at the handle-mount 380 touches the disengaged-direction-stop 389. Then it still cannot urge the handle-mount 380 or the handle at door-latch 200 to rotate far enough for unlatching the door because the increased output-moment arm will turn a smaller angle with the same rotation of the inner foot-pad 550 at the lower actuator which has same input-moment-arm, as in planar quadrilateral linkage described earlier for embodiment disclosed with FIG. 13.

Only hand can be used to unlatch door in this disengaged mode, and the door-latch 200 can be locked to prevent entry from outside as the pivoted-footpads are not effective.

Figure 37:
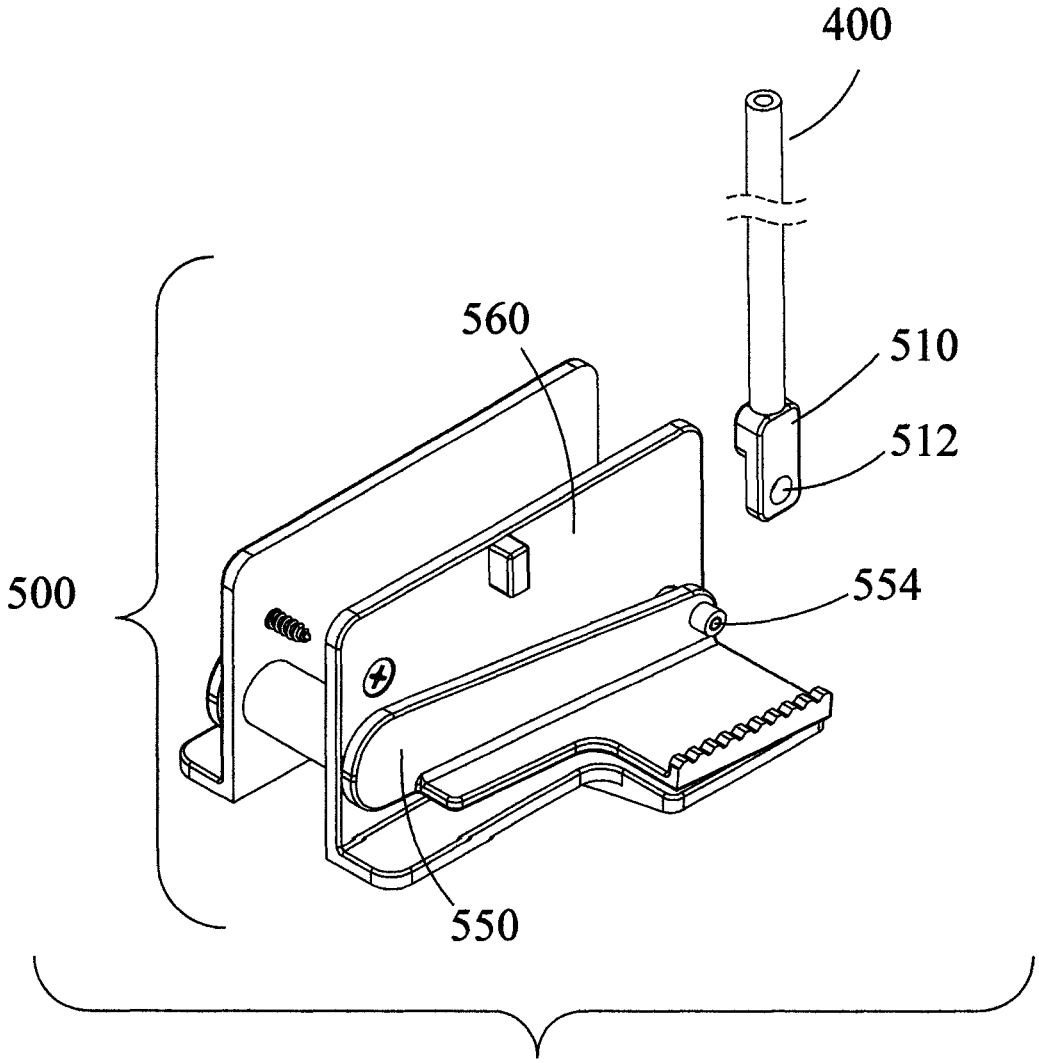
FIG. 37 is a perspective view of lower actuator and a portion of link in an embodiment which disconnects the upper actuator to lower actuator at a swivel joint.

FIG. 37 is an exploded perspective view of a lower actuator 500 in another illustrative embodiment of the door-unlatching device which disconnects upper and lower actuators by separating the mounting-hole 512 at the lower-swivel-joint 510 from its mating lower-mounting-site 554 at inner foot-pad 550.

Disconnection can be made at an intermediary location along the link 400 or at the other end of link 400.

Figure 38:
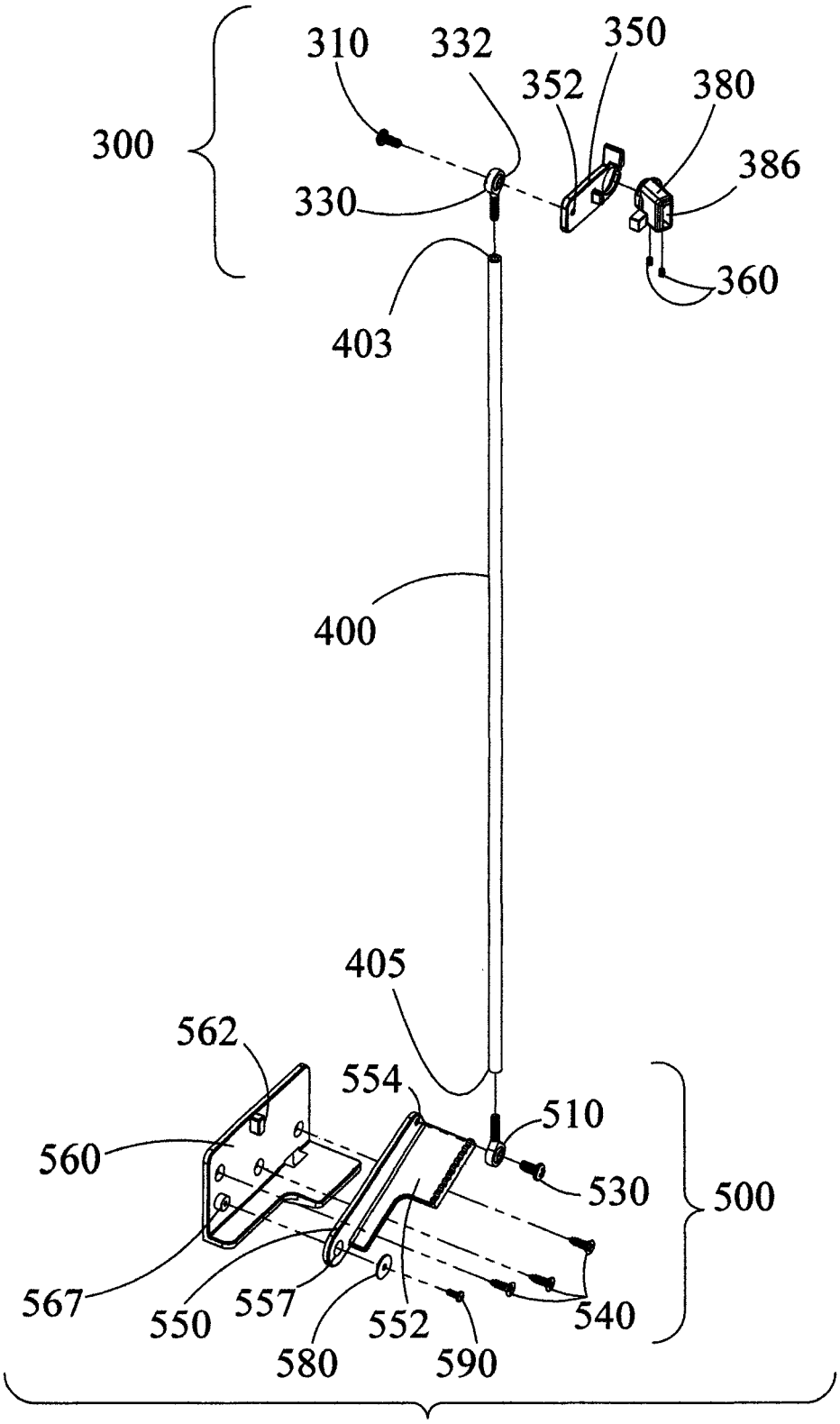
FIG. 38 is an exploded perspective view of an illustrative embodiment for use only on one side of door.

FIG. 38 is an exploded perspective view of another illustrative embodiment of the door-unlatching device for use on one side of door only. This embodiment has very similar parts on FIG. 2, but without the mirror image parts at lower actuator. In addition, a short-pivot 567 at inner mounting-plate 560 is used to support the pivot-hole 557 at the inner foot-pad 550.

Figure 39:
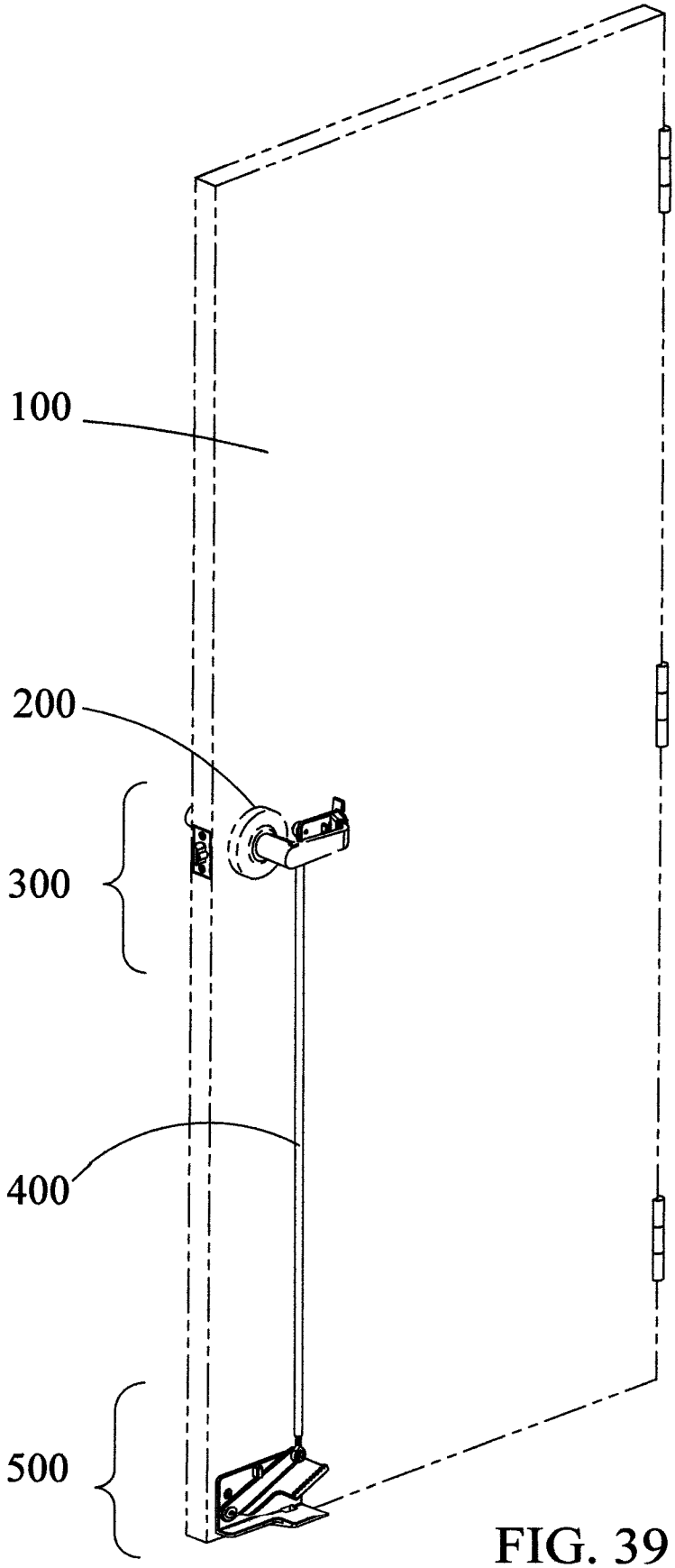
FIG. 39 is a perspective view the embodiment according to FIG. 38, as installed in a door.

FIG. 39 is the perspective view of the all parts assembled in the embodiment according to FIG. 38 and installed to a door with door-latch.

Figure 40:
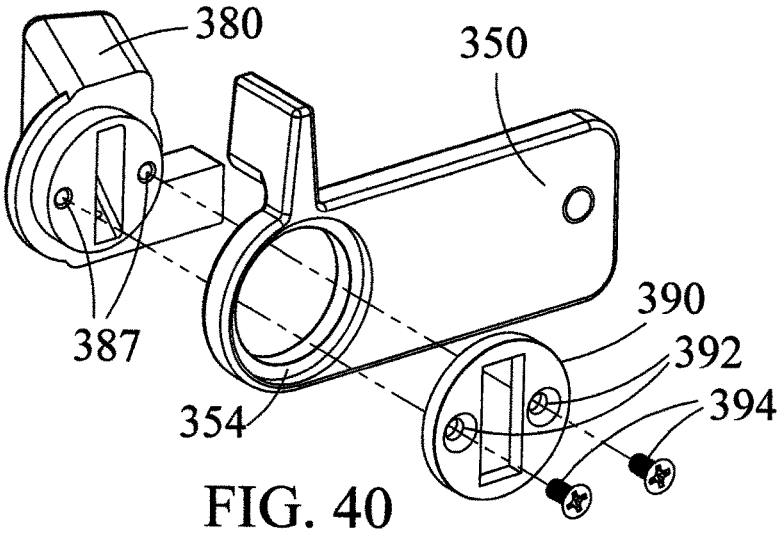
FIG. 40 is an exploded perspective view an illustrative embodiment using a flange with two screws to connect the lever-arm to handle-mount.

FIG. 40 is an exploded perspective view of another embodiment similar to earlier embodiment disclosed with FIG. 1 to FIG. 10 but instead of using a snap-fit joint to connect the lever-arm 350 and the handle-mount 380, this embodiment uses a flange 390 which has two holes 392, and 2 screws 394 to form the rotary joint between the lever-arm 350 and the handle-mount 380.

Figure 41:
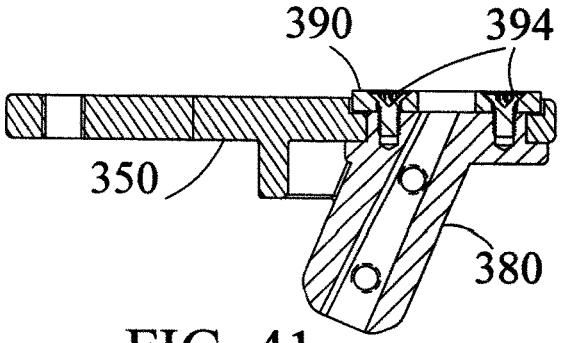
FIG. 41 is a sectional top view of the embodiment according to FIG. 40.

FIG. 41 shows the sectional top view of the assembled embodiment according to FIG. 40. The lever-arm 350 has a hole for a round extension of the handle-mount 380 to pass through. The flange 390 has an outer diameter larger than the round extension of the handle-mount 380 and with two holes 392 for screws 394. Two screws 394 are used to hold the flange 390 and the lever-arm 350 to the handle-mount 380 which has two threaded holes to match screws 394. This finished rotary joint subassembly will allow the lever-arm 350 to rotate around the handle-mount 380 to engaged or disengaged mode as in earlier embodiment disclosed with FIG. 1 to FIG. 10

Figure 42:
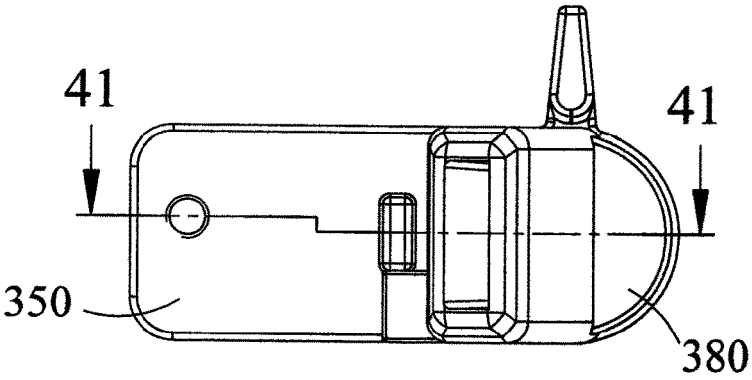
FIG. 42 is a front view of the embodiment according to FIG. 40.

FIG. 42 is a front view of the embodiment according to FIG. 40.

Figure 43:
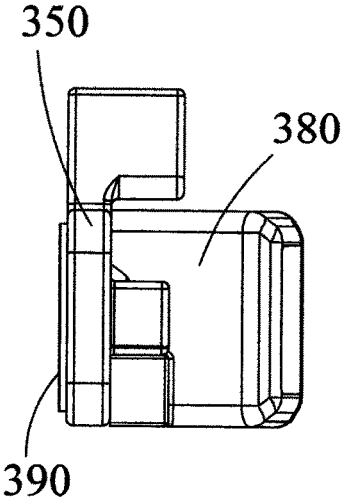
FIG. 43 is a side view of the embodiment according to FIG. 40.

FIG. 43 is a side view of the embodiment according to FIG. 40.

The foregoing description is intended primary for purposes of illustration. The door-unlatching device as a whole is not intended to be limited to the particular structural or operational features described above. Numerous modification and variation, still falling within the spirit of the scope of the door-unlatching device, will be apparent to those skilled in the art. Following are examples of modifications: In FIG. 1, instead of using two set screws 360 through the handle-mount 380 to secure a door-latch handle which will pass through the hole 386 during installation, the handle-mount 380 can be adhesive-bonded, welded, clamped to door-latch handle or as a built-in portion of the door-latch handle. Or the handle-mount 380 is modified to have a handle for securing to door-latch with knob. In FIG. 2, the door can be a sliding door instead of hinged door, if working with a door-latch having a hook-latching instead of a beveled-wedge-latching piece. In FIG. 2 where the door-unlatching device is shown as installed on inside of door, this door-unlatching device can be installed with the link 400 on outside of door too. In FIG. 6, instead of using flat head wood or sheet metal screws 540 as shown, long flat head machine screws can be used when mating threaded holes are made at either 560' or 560.

Figure 44:
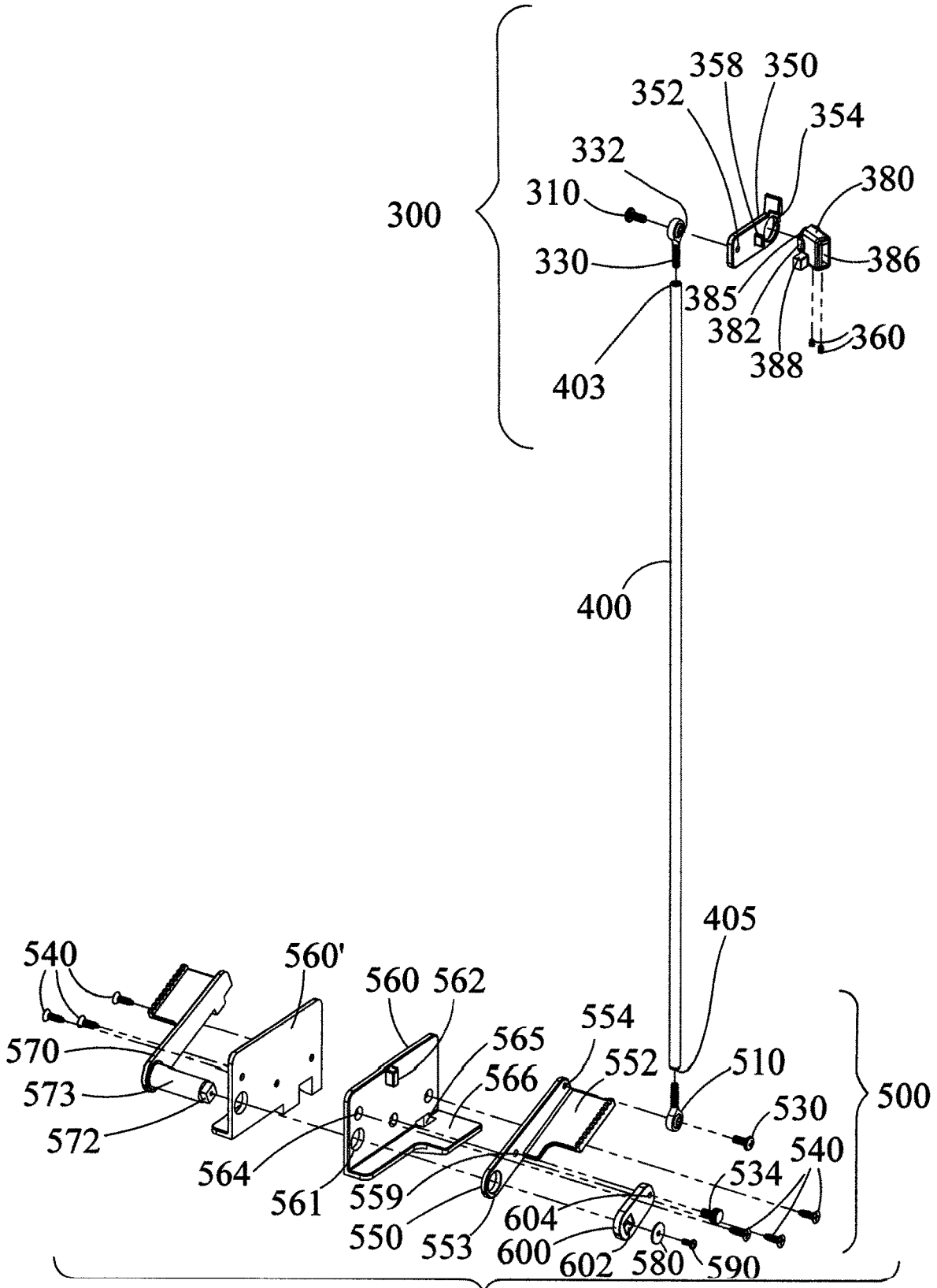
FIG. 44 is an exploded perspective of an embodiment of the door-unlatching device in accordance with the aspect of this disclosure which can also remove outside foot-operated-unlatching capability.

FIG. 44 is an exploded perspective of an embodiment in accordance with the aspect of this disclosure which can also remove outside foot-operated-unlatching capability, which is similar to earlier embodiment disclosed with FIG. 1 to FIG. 10; but with following change: The outer foot-pad 570 with pivot-axle 573 and mounting-feature 572 (a short square extension with threaded hole at center in this configuration) passes through a shaft hole at outer mounting-plate 560' (mirror-image part of inner mounting-plate 560), a clearance hole drilled at the door, a shaft-hole 561 at inner mounting-plate 560, a shaft-hole 553 at the inner foot-pad 550, then is secured to the coupling-plate 600 at the mounting-feature 602 (a square hole in this configuration) by a washer 580 and a screw 590, such that the coupling-plate 600 always rotates with the outside-provide-foot-pad. The coupling-plate 600 has a lower-mounting-site 604 (threaded hole at this configuration) holding a coupling-screw 534 which can extend to connect the inner foot-pad 550 at the coupling-site 559, so that inner foot-pad 550 will turn with the outer foot-pad 570. The coupling-screw 534 can separate from the coupling-site 559 so that the inner foot-pad 550 will rotate around pivot-axle 573 without turning the outside-foot-pad 570.

Figure 44A:
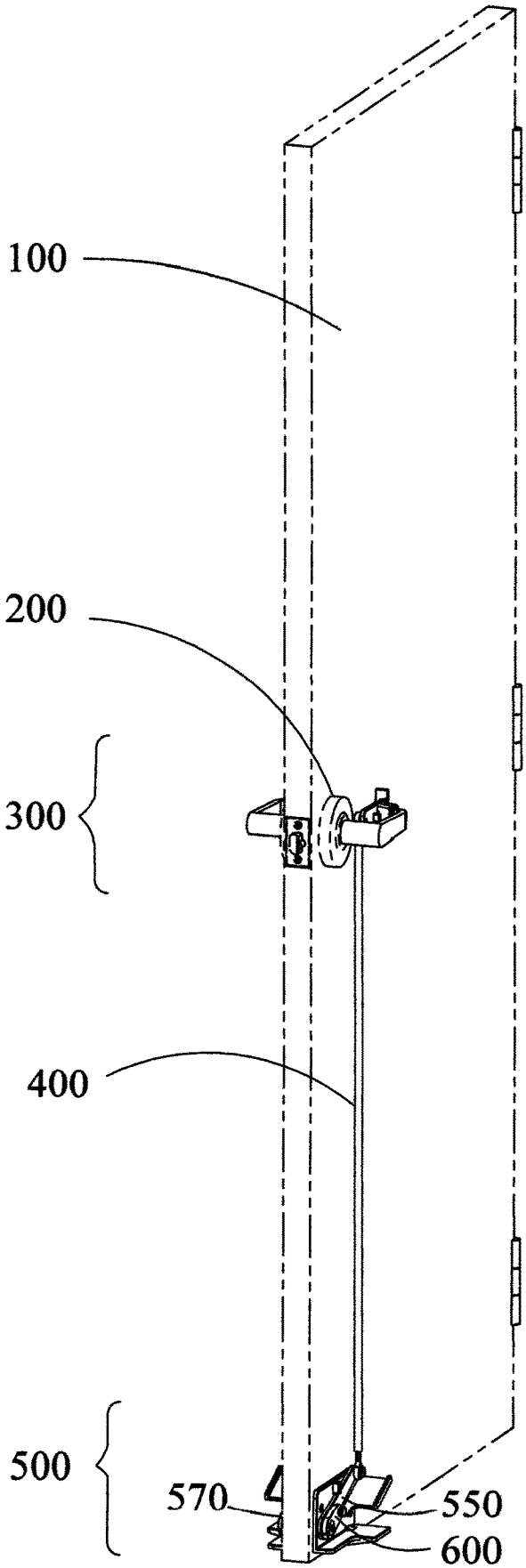
FIG. 44A is a perspective view of an illustrative embodiment according to FIG. 44, installed in a door and in engaged mode with door in latched condition, and with both outside and inside foot-operated-unlatching capability.

FIG. 44A is a perspective view of an illustrative embodiment according to FIG. 44, installed in a door and in engaged mode with door in latched condition, and with both outside and inside foot-operated-unlatching capability. The coupling-screw 534 at coupling-plate 600 is extended to connect the inner foot-pad 550 at the coupling-site 559, so that outer foot-pad 570 can turn with the inner-provide-foot-pad for both side foot-operated door-unlatching capability.

Figure 45:
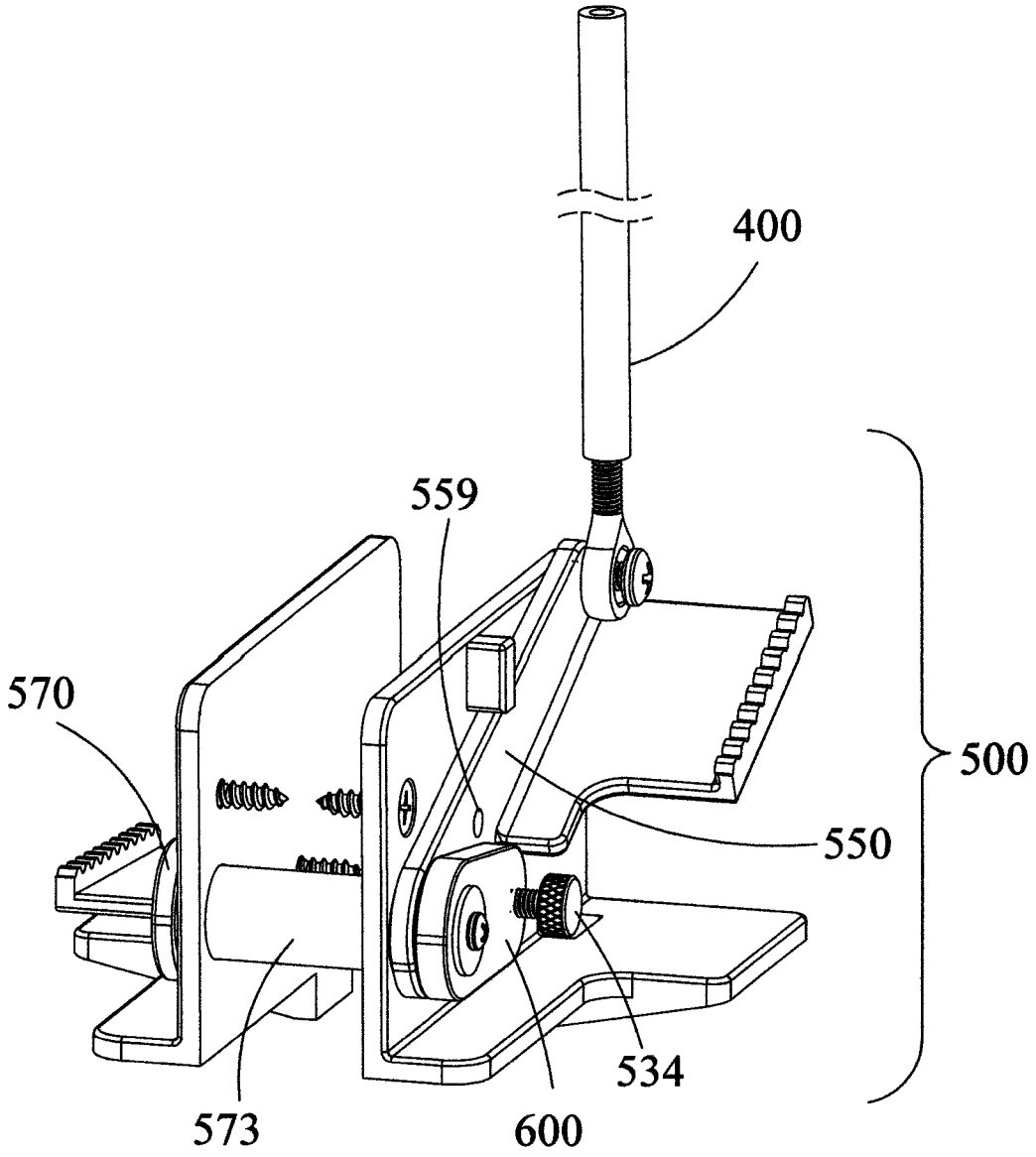
FIG. 45 is a perspective view of lower actuator and a portion of link in the embodiment according to FIG. 44, showing the outside foot-operated-unlatching capability is removed.

FIG. 45 is a perspective view of lower actuator 500 in the embodiment according to FIG. 44 at engaged mode, no external force condition and with the outside foot-operated-unlatching capability removed. The coupling-screw 534 at coupling-plate 600 is slackened to separate from the inner foot-pad 550, so that the outer foot-pad 570 is not connected to inner foot-pad 550 and will drop to the lower position by itself as shown.

Instead of using a coupling-screw 534, a quick-release pin can also be arranged to connect or separate the coupling-plate 600 and the inner foot-pad 550, when holes are made at the coupling-plate 600 and the inner foot-pad 550 to fit the quick-release pin. Alternative couplers would also be understood.

Figure 46:
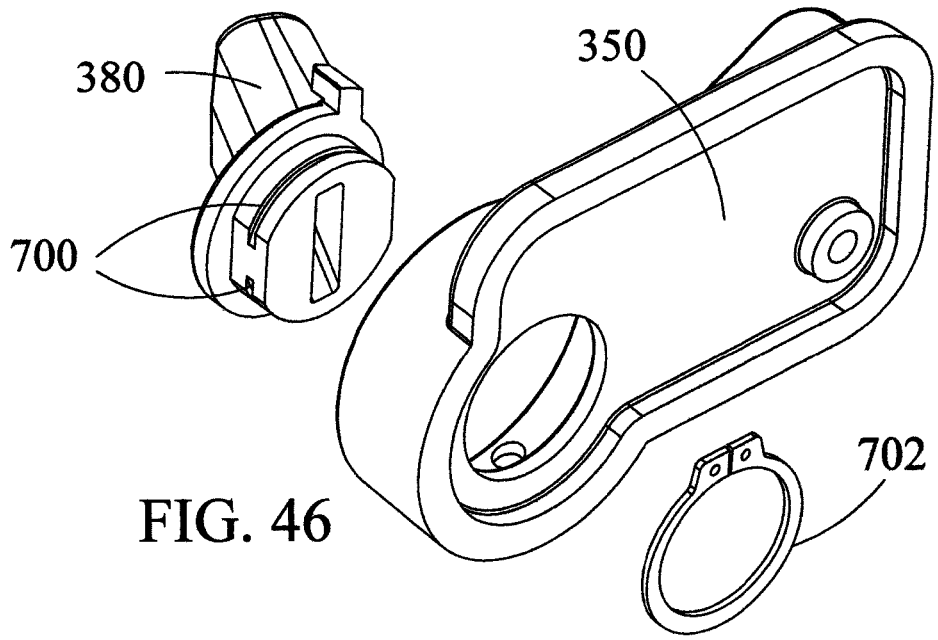
FIG. 46 is an exploded perspective view an illustrative embodiment using an external retaining ring for securing the handle-mount to the lever-arm at the upper actuator.

FIG. 46 is an exploded perspective view of an illustrative embodiment using an external retaining ring 702 for securing the handle-mount 380 to the lever-arm 350 at the upper actuator 300. A circular groove 700 at the handle-mount 380 is used to secure an external retaining ring 702 which keeps the handle-mount 380 attached to the lever-arm 350, and allows the handle-mount 350 to rotate on the lever-arm 350.

Figure 47:
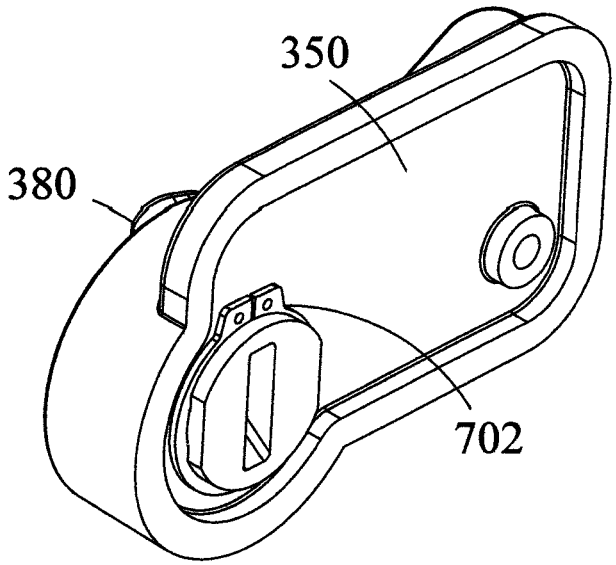
FIG. 47 is an assembled perspective view of the illustrative embodiment according to FIG. 46 from a rear view.

FIG. 47 is an assembled perspective view showing the external retaining ring securing the handle-mount 380 and the lever-arm 350 together at assembly.

Figure 48:
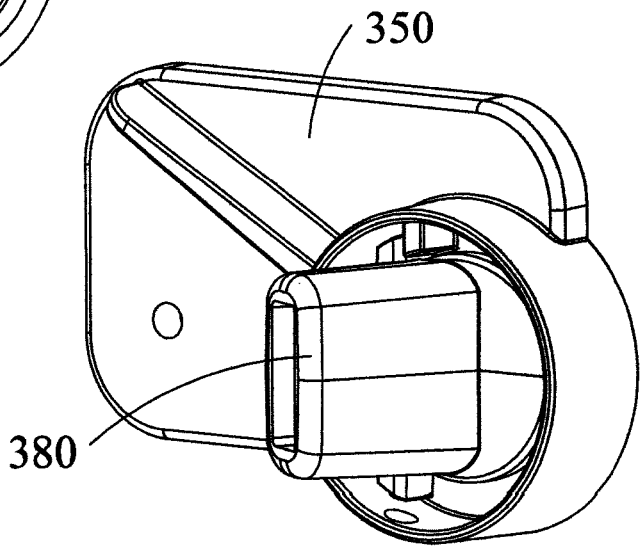
FIG. 48 is an assembled perspective view of the illustrative embodiment according to FIG. 46 from a front view.

FIG. 48 is another assembled perspective view showing the external retaining ring securing the handle-mount 380 and the lever-arm 350 together at assembly.

Figure 49:
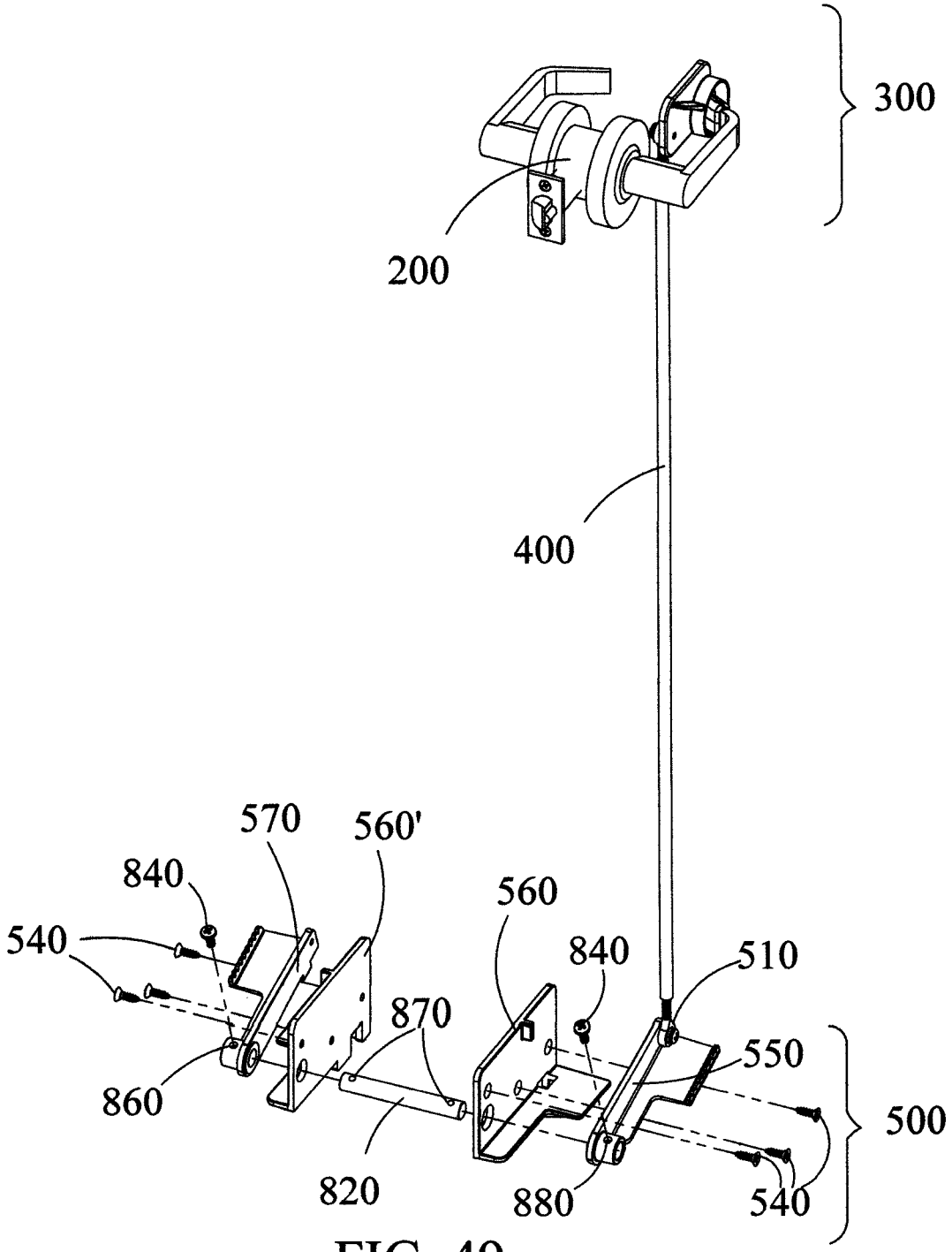
FIG. 49 is an exploded perspective view of the illustrative embodiment using a hinge shaft with screws to connect the inner foot-pad and outer foot-pad at the lower actuator.

FIG. 49 is an exploded perspective view of illustrative embodiment using a hinge shaft 820 with screws 840 to connect the inner foot-pad 550 and outer foot-pad 570 at the lower actuator 500.

The hinge shaft 820 passes through a corresponding shaft-hole at the inner foot-pad 550, a corresponding shaft-hole at the inner mounting-plate 560, a clearance hole drilled at the door 100 (door 100 is not shown in FIG. 49), a corresponding shaft-hole at the outer mounting-plate 560', and a corresponding shaft-hole at the outer foot-pad 570. Then a screw 840 passes through the hole 860 at the inner foot-pad 550 to secure one end of hinge shaft 820 at threaded hole 870, and another screw 840 passes through the hole 860 at the outer foot-pad 570 to secure the other end of hinge shaft 820 at another threaded hole 870, so that both inner foot-pad 550 and outer foot-pad 570 will both rotate together about the hinge shaft 820 based on actuation of either the inner foot-pad 550 or the outer foot-pad 570.

Other methods or fasteners such as adhesive, welding, cotter pin or clamping collar can also be used to attach either end of hinge shaft 820 to outer foot-pad 570 or inner foot-pad 550.

The fasteners, adhesive, weld, or hinge shaft 820 itself can be designed such that one can break when overloaded as an anti-theft feature by keeping the inner foot-pad 550 operating within its designed travel limits. Said another way, one of the fasteners, adhesive, weld, or hinge shaft 820 can be configured to fail or break if someone tampers with the door-unlatching device 50 by attempting to forcibly rotating one of the inner foot-pad 550 or outer foot-pad 770 beyond its intended range of rotation, thereby preventing unlatching.

Figure 50:
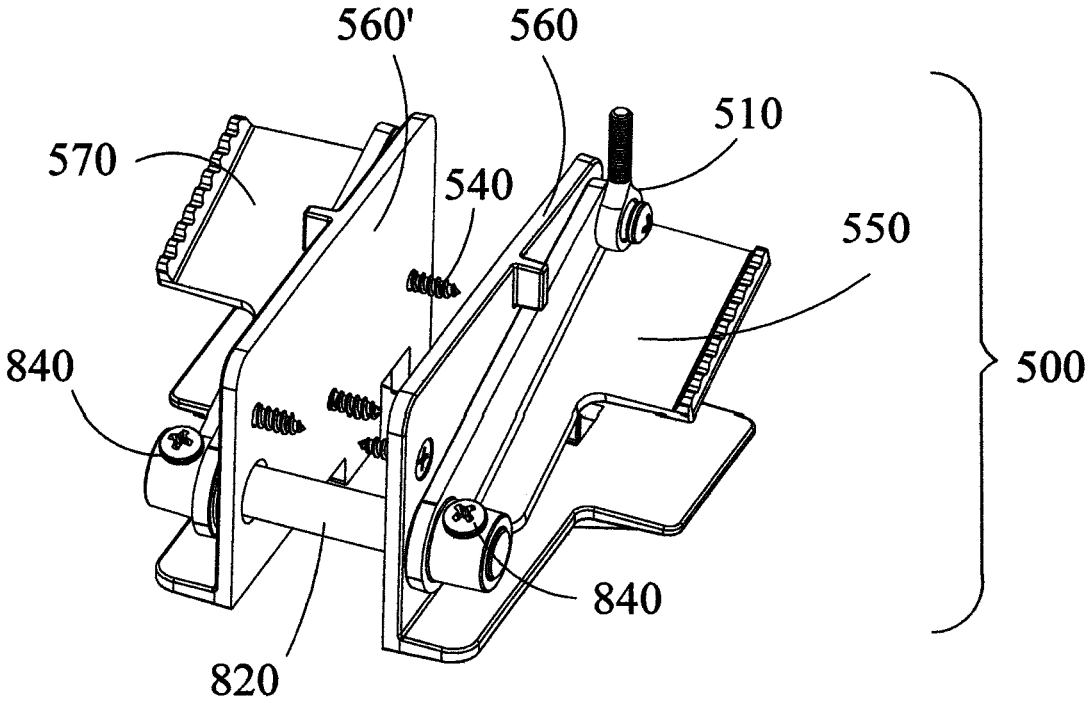
FIG. 50 is an assembled perspective view of the illustrative embodiment according to FIG. 49.

FIG. 50 is the assembled perspective view of illustrative embodiment using a hinge shaft 820 with screws 840 to connect the inner foot-pad 550 and the outer foot-pad 570 at the lower actuator 500 according to FIG. 49.

Methods of use include a method of using a door-unlatching device comprising a lower actuator comprising a foot-pad, an upper actuator comprising a lever-arm and a handle-mount attachable to a door-latch handle, and a link coupled to the foot-pad and the lever-arm, the method comprising: moving the lever-arm between a first position and a second position relative to the handle-mount.

Methods of use include a method wherein the moving of the lever-arm is achieved by rotating the lever-arm about the handle-mount.

Methods of use include a method wherein, in the first position of the lever-arm, actuation of the foot-pad moves the lever-arm and the handle-mount, and wherein, in the second position of the lever-arm, movement of the lever-arm is disconnected from the handle-mount.

Methods of assembly include a method of assembling a door-unlatching device, the method comprising coupling a handle-mount to a lever-arm, coupling the handle-mount to a door-latch handle, coupling a link to the lever-arm, and coupling the link to a lower actuator including a footpad.

Methods of assembly include a method further comprising wherein the lever-arm is coupled such that it can move between a first position and a second position relative to the handle-mount.

Methods of assembly include a method further comprising wherein, in the first position of the lever-arm, the lever-arm is positioned such that actuation of the foot-pad moves the lever-arm and the handle-mount, and wherein, in the second position of the lever-arm, the lever-arm is positioned such that actuation of the foot-pad does not result in movement of the handle-mount sufficient to unlatch the door-latch.

Although limited embodiments of door-unlatching devices, its components, and related methods have been specifically described and illustrated herein, many modifications and variations will be apparent to those skilled in the art. Furthermore, it is understood and contemplated that features specifically discussed for one door-unlatching device embodiment may be adopted for inclusion with another door-unlatching device, provided the functions are compatible. Accordingly, it is to be understood that the door-unlatching device, its components, and related methods constructed according to principles of the disclosed devices and methods may be embodied other than as specifically described herein. The disclosure is also defined in the following claims.

The invention claimed is:

1. A door-unlatching device comprising:

a lower actuator comprising a foot-pad, the lower actuator configured to be mounted at a bottom region of a door;

an upper actuator comprising a lever-arm and a handle-mount, wherein the handle mount is configured to connect to a handle for a door-latch of the door, wherein the handle is configured to operate the door-latch; and a link having a first end coupled to the foot-pad and the link having a second end coupled to the lever-arm, wherein the lever-arm is adjustably movable between a first position and a second position relative to the handle-mount, the lever arm being in the first position constitutes an engaged mode of the link and the lever arm being in the second position constitutes a disengaged mode of the link, wherein, when the lever arm is in the first position with the link in the engaged mode, actuating the lower actuator moves the link, lever-arm, and handle-mount to rotate the handle to unlatch the door-latch, and wherein, when the lever arm is in the second position with the link in the disengaged mode, actuating the lower actuator moves the link, but does not move the lever arm at all or enough to rotate or sufficiently to rotate the handle to unlatch the door-latch.

2. The door-unlatching device of claim 1, wherein the lever-arm is rotatable relative to the handle-mount.

3. The door-unlatching device of claim 2, wherein the lever-arm is rotatable about the handle-mount between the first position and the second position, wherein, in the first position of the lever-arm, the second end of the link is in a first position, and wherein, in the second position of the lever-arm, the second end of the link is in a second position.

4. The door-unlatching device of claim 3, wherein the lever-arm is rotatable between the first position and the second position, wherein, in the first position of the lever-arm, actuation of the foot-pad moves the lever-arm and the handle-mount through a first range of travel, and wherein, in the second position of the lever-arm, actuation of the foot-pad moves the lever-arm and the handle-mount through a second range of travel, the second range of travel being less than the first range of travel.

5. The door-unlatching device of claim 3, wherein the lever-arm is rotatable between the first position and the second position, wherein, in the first position of the lever-arm, actuation of the foot-pad moves the lever-arm and the handle-mount through a first range of travel, and wherein, in the second position of the lever-arm, actuation of the foot-pad either does not move the lever-arm and the handle-mount or moves the lever-arm and the handle-mount through a second range of travel, the second range of travel being less than the first range of travel.

6. The door-unlatching device of claim 1, wherein the lever-arm comprises an opening configured to receive a portion of the handle-mount.

7. The door-unlatching device of claim 2, wherein the lever-arm comprises a stop configured to contact the handle-mount.

8. The door-unlatching device of claim 7, wherein in the first position of the lever-arm, when the foot-pad is actuated, thereby moving the link and lever-arm, the handle-mount is moved by the stop of the lever-arm.

9. The door-unlatching device of claim 1, wherein the handle-mount is integrally formed with a handle for a door-latch.

10. The door-unlatching device of claim 1, wherein the handle-mount is configured to be attachable to the handle for a door-latch, and wherein the handle-mount comprises a hole configured to receive a distal end of the handle for the door-latch.

11. The door-unlatching device of claim 1, wherein the lower actuator further comprises a mounting-plate.

12. The door-unlatching device of claim 1, wherein the lower actuator further comprises a second mounting-plate and a second foot-pad, and wherein the foot-pad and the second foot-pad are fixed to one another.

13. The door-unlatching device of claim 1, wherein the lever-arm comprises a tab or lever-handle providing a feature for a user to grasp and rotation the lever-arm.

14. A door unlatching device comprising:

a lower actuator configured to be mounted at a lower region of a door, the lower actuator comprising a mounting-plate for attachment to a door, a first foot-pad, and a second foot-pad;

an upper actuator comprising a lever-arm and a handle-mount, wherein the handle mount is configured to connect to a handle for a door-latch of the door, wherein the handle is configured to operate the door-latch of the door; and a link having a first end coupled to the first foot-pad and the link having a second end coupled to the lever-arm;

wherein the lever arm is adjustably movable between a first position and a second position relative to the handle-mount, the lever arm being in the first position constitutes an engaged mode of the link and the lever arm being in the second position constitutes a disengaged mode of the link, wherein in a first position of the second end of the link relative to the handle-mount with the link in the engaged mode, actuation of the first foot-pad or the second foot-pad moves the lever-arm and the handle-mount to rotate the handle to unlatch the door-latch of the door, and wherein in a second position of the second end of the link relative to the handle-mount with the link in the disengaged mode, actuation of the first foot-pad or the second foot-pad moves the link, but does not move the handle-mount at all or enough to rotate or sufficiently to rotate the handle to unlatch the door-latch of the door.

15. The door-unlatching device of claim 14, wherein the lever-arm comprises a stop configured to contact the handle-mount.

16. The door-unlatching device of claim 14, wherein the lever-arm is rotatable relative to the handle-mount.

17. The door-unlatching device of claim 16, wherein the lever-arm is rotatable between a first position and a second position, wherein, in the first position of the lever-arm, the second end of the link is in the first position with the link in the engaged mode and actuation of the first foot-pad or the second foot-pad moves the lever-arm and the handle-mount, and wherein, in the second position of the lever-arm, the second end of the link is in the second position with the link in the disengaged mode and actuation of the first foot-pad or the second foot-pad does not move the handle-mount at all or enough to rotate or sufficiently to rotate the handle.

18. A door unlatching device comprising:

a lower actuator configured to be mounted at a lower region of a door, the lower actuator comprising a mounting-plate for attachment to a door, a first foot-pad, and a second foot-pad;

an upper actuator comprising a lever-arm and a handle-mount, the lever-arm being adjustably movable relative to the handle-mount, wherein the handle mount is configured to connect to a handle for a door-latch of the door, wherein the handle is configured to operate the door-latch; and a link having a first end connected to the first foot-pad and the link having a second end connected to the lever-arm, wherein the lever arm is adjustably movable between a first position and a second position relative to the handle-mount, the lever arm being in the first position constitutes an engaged mode of the link and the lever arm being in the second position constitutes a disengaged mode of the link;

wherein in the first position of the lever arm relative to the handle-mount with the link in the engaged mode, actuation of the first foot-pad or the second foot-pad moves the link, the lever-arm, and the handle-mount to rotate the handle to unlatch the door-latch, and wherein in the second position of the lever arm relative to the handle-mount with the link in the disengaged mode, actuation of the first foot-pad or the second foot-pad is isolated from moving the handle-mount such that the actuation of the foot-pad moves the link but does not move the lever-arm and/or handle-mount at all or enough to rotate or sufficiently to rotate the handle to unlatch the door-latch.

* * * * *